US008859173B2

(12) United States Patent
Yamada et al.

(10) Patent No.: US 8,859,173 B2
(45) Date of Patent: Oct. 14, 2014

(54) ELECTROPHOTOGRAPHIC PHOTORECEPTOR, PROCESS CARTRIDGE, IMAGE FORMING APPARATUS, CURED FILM, AND ORGANIC ELECTROLUMINESCENT DEVICE

(75) Inventors: Wataru Yamada, Kanagawa (JP); Katsumi Nukada, Kanagawa (JP); Takatsugu Doi, Kanagawa (JP); Tsuyoshi Miyamoto, Kanagawa (JP); Kenya Sonobe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 252 days.

(21) Appl. No.: 12/857,186

(22) Filed: Aug. 16, 2010

(65) Prior Publication Data

US 2011/0207039 A1 Aug. 25, 2011

(30) Foreign Application Priority Data

Feb. 23, 2010 (JP) ..... 2010-037797

(51) Int. Cl.

| | |
|---|---|
| ***G03G 5/14*** | (2006.01) |
| ***G03G 5/147*** | (2006.01) |
| ***G03G 15/00*** | (2006.01) |
| ***G03G 5/05*** | (2006.01) |
| ***G03G 5/07*** | (2006.01) |

(52) U.S. Cl.

CPC ..... *G03G 5/0592* (2013.01); *G03G 5/142* (2013.01); *G03G 5/14734* (2013.01); *G03G 15/751* (2013.01); *G03G 2221/183* (2013.01); *G03G 5/14791* (2013.01); *G03G 2215/00957* (2013.01); *G03G 5/14795* (2013.01); *G03G 5/14717* (2013.01); *G03G 5/071* (2013.01)

USPC ..... 430/66; 430/58.3; 430/58.7; 399/159

(58) Field of Classification Search

CPC ..... G03G 5/14786; G03G 5/14734; G03G 5/14717; G03G 5/071; G03G 5/0614; G03G 5/089; G03G 15/751

USPC ..... 430/58.3, 58.7, 66; 257/40, E51.018; 399/159

See application file for complete search history.

(56) References Cited

U.S. PATENT DOCUMENTS 4,281,054 A * 7/1981 Horgan et al. ..... 430/57.8
5,695,898 A 12/1997 Go et al.

(Continued)

FOREIGN PATENT DOCUMENTS

JP A-63-52150 3/1988
JP A-2000-019749 1/2000

(Continued)

OTHER PUBLICATIONS

Y. Tanaka et al, "Preprints of the 8th Polymer Material Forum," The Society of Polymer Science, Japan, Oct. 13, 1999, p. 89 (with partial translation).

(Continued)

*Primary Examiner* — Peter Vajda
(74) *Attorney, Agent, or Firm* — Oliff PLC

(57) ABSTRACT

An electrophotographic photoreceptor is disclosed, in which an outermost surface layer of the electrophotographic photoreceptor is made of a cured film of a composition including a compound represented by the following Formula (M1) and a charge transporting material having a chain polymerizable functional group:

(M1)

6 Claims, 6 Drawing Sheets

(56) References Cited

U.S. PATENT DOCUMENTS

| | | | | |
|---|---|---|---|---|
| 6,180,303 | B1 | 1/2001 | Uematsu et al. | |
| 2007/0027299 | A1 * | 2/2007 | Morishita et al. | 528/423 |
| 2007/0122724 | A1 * | 5/2007 | Suzuki et al. | 430/58.7 |
| 2008/0138725 | A1 | 6/2008 | Fujiwara et al. | |
| 2008/0153021 | A1 * | 6/2008 | Ikuno et al. | 430/66 |
| 2008/0199217 | A1 | 8/2008 | Iwamoto et al. | |

FOREIGN PATENT DOCUMENTS

| | | | |
|---|---|---|---|
| JP | A-2000-066424 | 3/2000 | |
| JP | A-2001-117250 | 4/2001 | |
| JP | A-2002-040686 | 2/2002 | |
| JP | B2-3287678 | 6/2002 | |
| JP | A-2004-240079 | 8/2004 | |
| JP | A-2005-062300 | 3/2005 | |
| JP | A-2005-062302 | 3/2005 | |
| JP | A-2005-234546 | 9/2005 | |
| JP | A-2005-345782 | 12/2005 | |
| JP | A-2006-234943 | 9/2006 | |
| JP | A-2007-072141 | 3/2007 | |
| JP | A-2007-79008 | 3/2007 | |
| JP | A-2007-163577 | 6/2007 | |
| JP | A-2008-058779 | 3/2008 | |
| JP | A-2008-170977 | 7/2008 | |
| JP | A-2008-233893 | 10/2008 | |
| JP | A-2009-186726 | 8/2009 | |
| JP | A-2011-133805 | 7/2011 | |
| WO | WO 2008/149829 | * 12/2008 | H05B 33/10 |

OTHER PUBLICATIONS

Jan. 21, 2014 Office Action issued in Japan Application No. 2010-061360 (with English Translation).

Mar. 4, 2014 Office Action issued in Japanese Application No. 2010-037797 (with English Translation).

Japanese Patent Office, Notice of Reasons for Rejection mailed May 7, 2014 in Japanese Patent Application No. 2010-061360 w/Partial English-language Translation.

Aug. 5, 2014 Office Action issued in Japanese Application No. 2010-037797 (with English Translation)

* cited by examiner

ELECTROPHOTOGRAPHIC PHOTORECEPTOR, PROCESS CARTRIDGE, IMAGE FORMING APPARATUS, CURED FILM, AND ORGANIC ELECTROLUMINESCENT DEVICE

CROSS-REFERENCE TO RELATED APPLICATIONS

This Application is based on and claims priority under 35 USC 119 from Japanese Patent Application No. 2010-037797 filed on Feb. 23, 2010.

BACKGROUND

1. Technical Field

The present invention relates to an electrophotographic photoreceptor, a process cartridge, an image forming apparatus, a cured film and an organic electroluminescent device.

2. Related Art

Generally, an electrophotographic image forming apparatus has the following structure and processes. Specifically, an image-formed material is obtained by charging the surface of an electrophotographic photoreceptor by a charging unit; forming an electrostatic latent image on the charged surface of the electrophotographic photoreceptor by exposing image-wise the surface to light so as to selectively discharge the surface; developing the latent image by attaching a toner thereto by a developing unit to form a toner image; and transferring the toner image onto a transferred image-receiving medium by a transfer unit.

In recent years, electrophotographic photoreceptors (organic photoreceptors) composed of organic photoconductive materials go mainstream.

Various materials have been proposed for the outermost surface layer of electrophotographic photoreceptors.

SUMMARY

According to a first aspect of the invention, there is provided an electrophotographic photoreceptor including at least a conductive substrate and a photosensitive layer formed on or above the conductive substrate, wherein an outermost surface layer of the electrophotographic photoreceptor is made of a cured film of a composition containing a compound represented by the following Formula (M1) and a charge transporting material having a chain polymerizable functional group.

(M1)

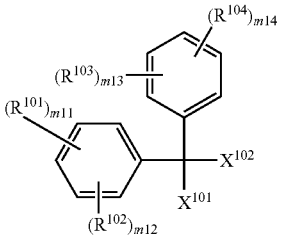

In Formula (M1), $X^{101}$ and $X^{102}$ each independently represent a hydrogen atom, a halogen atom, an alkyl group having 1 to 15 carbon atoms, an alkoxy group having 1 to 15 carbon atoms, a cyano group, a phenoxy group, an aryl group having 6 to 30 carbon atoms, —$Y^{101}$—$X^{103}$ (wherein $Y^{101}$ represents an azo group or a siloxy group; and $X^{103}$ represents an alkyl group having 1 to 15 carbon atoms, an alkoxy group having 1 to 15 carbon atoms, a cyano group, a phenoxy group, or an aryl group having 6 to 30 carbon atoms), or a substituent composed of any of these groups; $R^{101}$ and $R^{103}$ each independently represent a hydroxyl group or an alkoxy group having 1 to 15 carbon atoms; m11 and m13 each independently represent an integer of 0 or 1; $R^{102}$ and $R^{104}$ each independently represent an alkyl group having 1 to 15 carbon atoms; m12 and m14 each independently represent an integer of 0, 1, 2, or 3.

BRIEF DESCRIPTION OF THE DRAWINGS

Exemplary embodiment(s) of the present invention will be described in detail based on the following figures, wherein.

DETAILED DESCRIPTION

Figure 1:
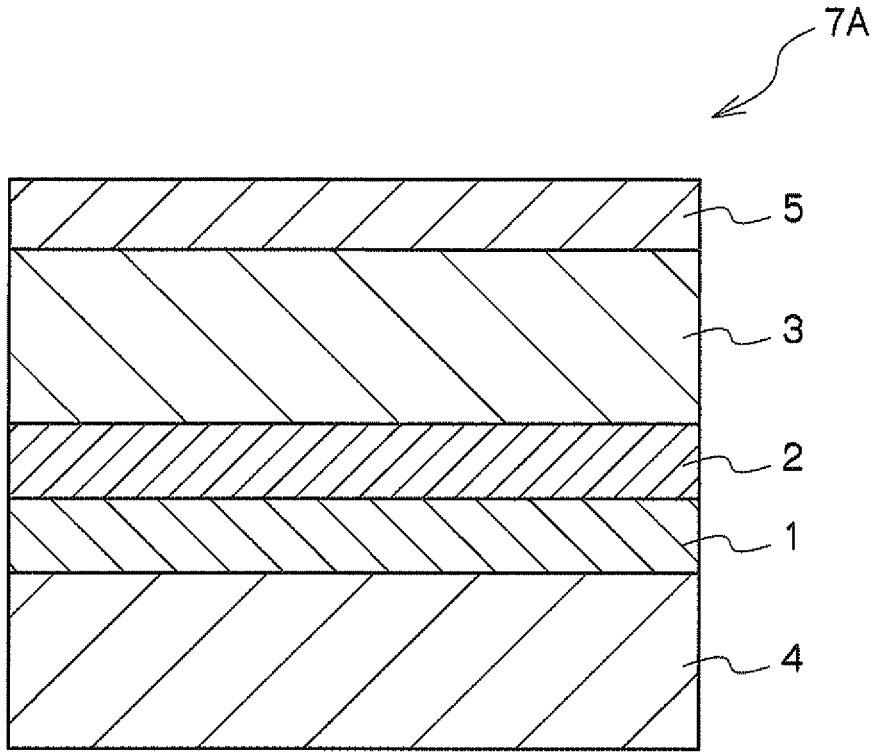
FIG. 1 is a schematic partial cross sectional view showing an electrophotographic photoreceptor according to an exemplary embodiment of the invention.

Other aspects of the invention are described below.

A second aspect of the invention is an electrophotographic photoreceptor of the first aspect, wherein the charge transporting material is at least one compound represented by the following Formula (I).

(I)

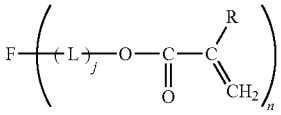

In Formula (I), F represents a hole-transporting organic group having an n valence, R represents a hydrogen atom or an alkyl group; L represents a divalent organic group; n represents an integer of 1 or more; and j represents 0 or 1.

A third aspect of the invention is the electrophotographic photoreceptor of the first or second aspect, wherein the outermost layer is a protective layer.

A forth aspect of the invention is the electrophotographic photoreceptor of any one of the first to third aspects, wherein the photosensitive layer is a monolayer photosensitive layer or a multilayer photosensitive layer including a charge generating layer and a charge transport layer.

A fifth aspect of the invention is the electrophotographic photoreceptor of the forth aspect, wherein the charge transport layer is the outermost surface layer of the electrophotographic photoreceptor being made of a cured film of a composition including the compound represented by Formula (M1) and the charge transporting material having a chain polymerizable functional group.

A sixth aspect of the invention is the electrophotographic photoreceptor of any one of the first to fifth aspects, further including an undercoat layer provided on the conductive substrate.

A seventh aspect of the invention is a process cartridge including the electrophotographic photoreceptor of any one of the first to sixth aspects and at least one unit selected from the group consisting of: a charging unit for charging the electrophotographic photoreceptor; a development unit for developing an electrostatic latent image formed on the electrophotographic photoreceptor with a toner; and a toner removal unit for removing residual toner from the surface of the electrophotographic photoreceptor.

An eighth aspect of the invention is an image forming apparatus including the electrophotographic photoreceptor of any one of the first to sixth aspects; a charging unit for charging the electrophotographic photoreceptor; an electrostatic latent image forming unit for forming an electrostatic latent image on the charged electrophotographic photoreceptor; a development unit for developing the electrostatic latent image formed on the electrophotographic photoreceptor with a toner thereby forming a toner image; and a transfer unit for transferring the toner image to a transferred image-receiving medium.

A ninth aspect of the invention is a cured film of a composition including a compound represented by the following Formula (M1) and a charge transporting material having a chain polymerizable functional group.

(M1)

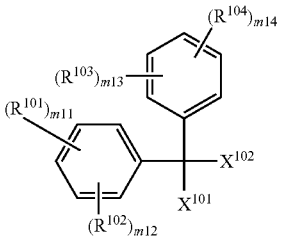

In Formula (M1), $X^{101}$ and $X^{102}$ each independently represent a hydrogen atom, a halogen atom, an alkyl group having 1 to 15 carbon atoms, an alkoxy group having 1 to 15 carbon atoms, a cyano group, a phenoxy group, an aryl group having 6 to 30 carbon atoms, —$Y^{101}$—$X^{103}$ (wherein $Y^{101}$ represents an azo group or a siloxy group; and $X^{103}$ represents alkyl group having 1 to 15 carbon atoms, an alkoxy group having 1 to 15 carbon atoms, a cyano group, a phenoxy group, or an aryl group having 6 to 30 carbon atoms), or a substituent composed of any of these groups; $R^{101}$ and $R^{103}$ each independently represent a hydroxyl group or an alkoxy group having 1 to 15 carbon atoms; m11 and m13 each independently represent an integer of 0 or 1; $R^{102}$ and $R^{104}$ each independently represent an alkyl group having 1 to 15 carbon atoms; m12 and m14 each independently represent an integer of 0, 1, 2, or 3.

A tenth aspect of the invention is the cured film of the ninth aspect, wherein the charge transporting material is at least one compound represented by the following Formula (I).

(I)

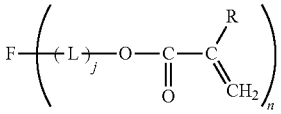

In Formula (I), F represents a hole-transporting organic group having an n valence; R represents a hydrogen atom or an alkyl group; L represents a divalent organic group; n represents an integer of 1 or more; and j represents 0 or 1.

An eleventh aspect of the invention is the organic electroluminescent device including an anode, a hole transporting layer, a luminescent layer and a cathode, wherein the hole transporting layer includes at least the cured film of the ninth or tenth aspect.

The first to sixth aspects of the invention provide an electrophotographic photoreceptor with less occurrence of an afterimage (ghost image) due to residual preceding images, in comparison with those not including the combination of a compound represented by Formula (M1) and a charge transporting material having a chain polymerizable functional group as a material of the outermost surface layer.

The seventh and eighth aspects of the invention provide a process cartridge and an image forming apparatus which give an image with less occurrence of an afterimage (ghost image) due to residual preceding images, in comparison with the case using an electrophotographic photoreceptor not including the combination of a compound represented by Formula (M1) and a charge transporting material having a chain polymerizable functional group as a material of the outermost surface layer.

The ninth and tenth aspects of the invention provide a cured film having high durability such as solvent resistance and heat resistance, and good charge transporting properties, in comparison with those not including the combination of a compound represented by Formula (M1) and a charge transporting material having a chain polymerizable functional group.

Electrophotographic Photoreceptor

The electrophotographic photoreceptor according to the present exemplary embodiment includes at least a conductive substrate, and a photosensitive layer formed on or above the conductive substrate. The outermost surface layer of the electrophotographic photoreceptor is made of a cured film of a composition containing the compound represented by Formula (M1), and a charge transporting material having a chain polymerizable functional group.

An electrophotographic photoreceptor including, as the outermost surface layer, a cured film of a composition containing a charge transporting material having a chain polymerizable functional group has a high mechanical strength, but may cause the deterioration in electrical properties such as occurrence of an afterimage (ghost image) due to residual preceding images.

In order to address the above, the electrophotographic photoreceptor according to the present exemplary embodiment includes an outermost surface layer which is a cured film of a composition containing a charge transporting material having a chain polymerizable functional group and a compound represented by the above-described Formula (M1), thereby preventing occurrence of an afterimage (ghost image) due to residual preceding images. The reason for this is not clear, but is presumed as follows.

It is know that, in the process of curing a charge transporting material having a chain polymerizable functional group in the form of a film, chain polymerization starts upon the attack on the chain polymerizable functional group by cations, anions, or radicals generated from an initiator and stimulation (for example, heat, electron beams, or light). At the time, the charge transporting portion (charge transporting skeleton) in the charge transporting material is also attacked in no small measure by cations, anions, or radicals generated from the initiator and stimulation (for example, heat, electron beams, or light), which likely results in the deterioration of the electrical properties. The deterioration can be prevented by providing the stimulation under mild conditions, but the crosslinking concentration may not increase under such mild conditions, which results in insufficient film strength.

On the other hand, in the presence of the compound represented by Formula (M1), cations, anions, or radicals generated from an initiator and stimulation (for example, heat, electron beams, or light) selectively attack the chain polymerizable functional group to start chain polymerization, thereby preventing the attack on the charge transporting portion (charge transporting skeleton) in the charge transporting material, which likely contributes to the formation of a cured film having unimpaired charge transporting properties and also having a high strength. In particular, a radical polymerization initiator which exhibits a living polymerization behavior allows more selective chain polymerization. A chain polymerization initiated by selective attack on the chain polymerizable functional group, whereby the attack on the charge transporting region (charge transporting skeleton) in the charge transporting material is likely prevented.

For this reason, it is considered that the electrophotographic photoreceptor according to the present exemplary embodiment prevents occurrence of an afterimage (ghost image) due to residual preceding images. As a result, the outermost surface layer made of a cured film of the composition shows a high mechanical strength, and deterioration of both electrical properties and image properties caused by repeated use over a long term is suppressed.

In addition, as a result, the process cartridge and image forming apparatus including the electrophotographic photoreceptor according to the present exemplary embodiment provides an image with minimized occurrence of an afterimage (ghost image) due to residual preceding images. A stable image is obtained.

The electrophotographic photoreceptor according to the present exemplary embodiment includes, as described above, an outermost surface layer made of a cured film of the specific composition. The outermost surface layer preferably forms the top surface of the electrophotographic photoreceptor, and particularly preferably functions as a protective layer or a charge transport layer.

When the outermost surface layer functions as a protective layer, for example, a photosensitive layer and the protective layer as the outermost surface layer are provided on or above a conductive substrate, the protective layer being made of a cured film of the specific composition.

When the outermost surface layer works as a charge transport layer, for example, a charge generating layer and the charge transport layer as the outermost surface layer are provided on or above a conductive substrate, the charge transport layer being made of a cured film of the specific composition.

Hereinafter, an electrophotographic photoreceptor directed to the exemplary embodiment in which an outermost surface layer is a layer that functions as a protective layer will be detailed with reference to the drawings. In the drawings, same or corresponding portions are provided with same reference marks and omitted from duplicating descriptions.

Figure 2:
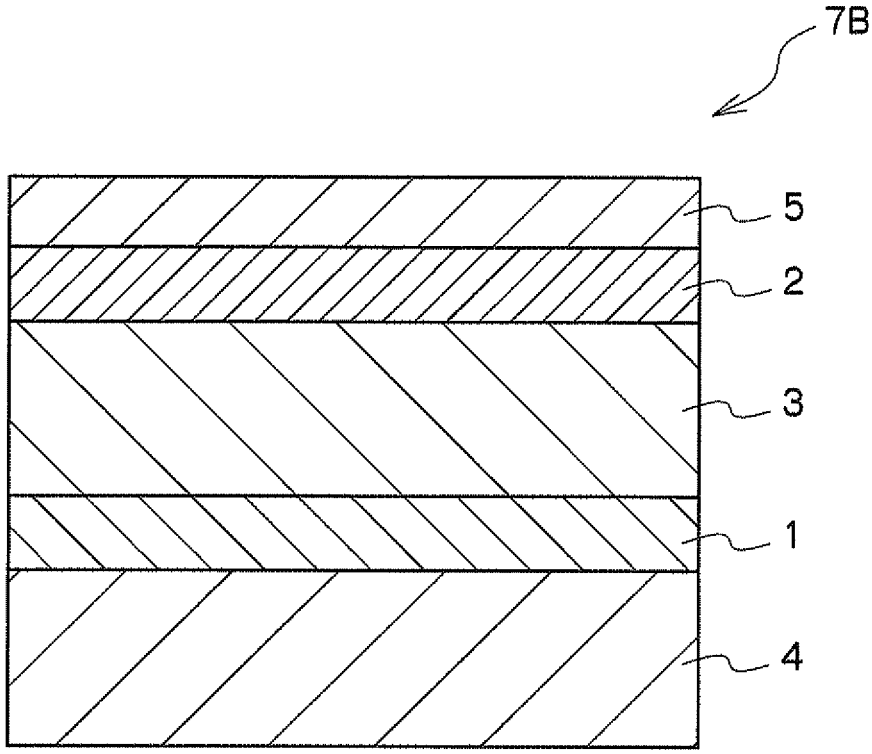
FIG. 2 is a schematic partial cross sectional view showing an electrophotographic photoreceptor according to an exemplary embodiment of the invention.
Figure 3:
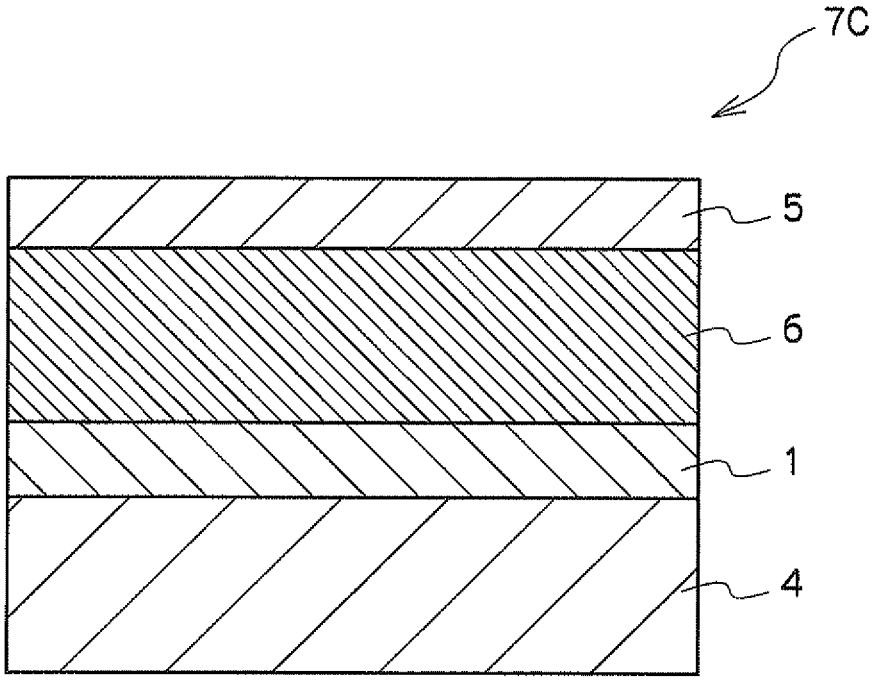
FIG. 3 is a schematic partial cross sectional view showing an electrophotographic photoreceptor according to an exemplary embodiment of the invention.

FIG. 1 is a schematic sectional view showing a preferable exemplary embodiment of an electrophotographic photoreceptor involved in an exemplary embodiment. FIG. 2 and FIG. 3 each are a schematic sectional view showing an electrophotographic photoreceptor involved in another exemplary embodiment.

An electrophotographic photoreceptor 7A shown in FIG. 1 is a so-called function separation type photoreceptor (or a multilayer type photoreceptor) and has a structure where an undercoat layer 1 is formed on a conductive substrate 4, and further thereon, a charge generating layer 2, a charge transport layer 3 and a protective layer 5 are sequentially formed. In the electrophotographic photoreceptor 7A, a photosensitive layer is constituted of the charge generating layer 2 and the charge transport layer 3.

An electrophotographic photoreceptor 7B shown in FIG. 2 is a function separation type photoreceptor where, similar to the electrophotographic photoreceptor 7A shown in FIG. 1, a function is divided into a charge generating layer 2 and a charge transport layer 3. An electrophotographic photoreceptor 7C shown in FIG. 3 contains a charge generating material and a charge transporting material in the same layer (monolayer type photosensitive layer 6 (charge generating/charge transport layer)).

The electrophotographic photoreceptor 7B shown in FIG. 2 has a structure where an undercoat layer 1 is formed on a conductive substrate 4, and, further thereon, a charge transport layer 3, a charge generating layer 2 and a protective layer 5 are sequentially formed. In the electrophotographic photoreceptor 7B, a photosensitive layer is formed of the charge transport layer 3 and the charge generating layer 2.

Furthermore, an electrophotographic photoreceptor 7C shown in FIG. 3 has a structure where an undercoat layer 1 is formed on a conductive substrate 4 and further thereon a monolayer type photosensitive layer 6 and a protective layer 5 are sequentially formed.

In the electrophotographic photoreceptors 7A to 7C shown in FIGS. 1 to 3, the protective layer 5 is the outermost surface layer located farthest from the conductive substrate 4, the outermost surface layer being made of a cured film of the specific composition.

In the electrophotographic photoreceptors shown in FIGS. 1 to 3, the undercoat layer 1 may be omitted.

Taking the electrophotographic photoreceptor 7A shown in FIG. 1 as a representative example, its components are described below.

Conductive Substrate

The conductive substrate may be freely selected from existing ones, such as plastic films having thereon a thin film (for example, a metal such as aluminium, nickel, chromium, stainless steel, or a film of aluminum, titanium, nickel, chromium, stainless steel, gold, vanadium, tin oxide, indium oxide, or indium tin oxide (ITO)), paper coated or impregnated with a conductivity-imparting agent, and plastic films coated or impregnated with a conductivity-imparting agent. The substrate may be in the form of a cylinder, a sheet, or a plate.

The conductive substrate particles preferably have a volume resistivity of, for example, less than $10^7$ Ω·cm.

When the conductive substrate is a metal pipe, the surface thereof may be untreated or treated by mirror finishing, etching, anodic oxidation, rough cutting, centerless grinding, sandblast, or wet honing.

Undercoat Layer

The undercoat layer is formed if necessary for the purpose of preventing light reflection on the conductive substrate surface, and inflow of unnecessary carriers from the conductive substrate into the photosensitive layer.

The undercoat layer is composed of, for example, a binder resin and, if needed, other additives.

Examples of the binder resin contained in the undercoat layer include known polymer resin compounds such as acetal resins such as polyvinyl butyral, polyvinyl alcohol resins, casein, polyamide resin, cellulose resin, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicon-alkyd resins, phenolic resins, phenol-formaldehyde resins, melamine resins, and urethane resins; charge transporting resins having a charge transporting group; and conductive resins such as polyaniline. Among them, resins insoluble in a coating solvent used in the upper layer are preferred. In particular, phenolic resins, phenol-formaldehyde resins, melamine resins, urethane resins, and epoxy resins are preferred.

The undercoat layer may contain a metal compound such as a silicon compound, an organozirconium compound, an organotitanium compound, or an organoaluminium compound.

The ratio of the metal compound to the binder resin is not specified, and is selected so as to achieve intended electrophotographic photoreceptor properties.

The undercoat layer may contain resin particles for controlling the surface roughness. Examples of the resin particles include silicone resin particles and crosslinked poly(methyl methacrylate) (PMMA) resin particles. For the purpose of controlling the surface roughness, the surface of the undercoat layer provided on a conductive substrate may be polished by, for example, buff polishing, sandblasting, wet honing, or grinding.

The undercoat layer may contain, for example, at least a binder resin and conductive particles. The conductive particles preferably have, for example, a volume resistivity of less than $10^7$ Ω·cm.

Examples of the conductive particles include metal particles (for example, aluminium, copper, nickel, and silver particles), conductive metal oxide particles (for examples, antimony oxide, indium oxide, tin oxide, and zinc oxide particles), and conductive substance particles (carbon fiber, carbon black, and graphite powder particles). Among them, conductive metal oxide particles are preferred. The conductive particles may be used in combination of two or more thereof.

The conductive particles may be subjected to surface treatment with a hydrophobizing agent (for example, a coupling agent), thereby controlling the resistance.

The content of the conductive particles is, for example, preferably from 10% by weight to 80% by weight with respect to the binder resin, and more preferably from 40% by weight to 80% by weight.

The undercoat layer is formed using a undercoat layer forming coating liquid that contains the above components in the solvent.

Examples of the method for dispersing particles in the undercoat layer forming coating liquid include media dispersers such as a ball mill, a vibrating ball mill, an attritor, a sand mill, and a horizontal sand mill; and medialess dispersers such as a stirrer, an ultrasonic disperser, a roll mill, and a high pressure homogenizer. The high pressure homogenizer may be of a collision type which achieves dispersion by liquid-liquid collision or liquid-wall collision under high pressure, or of a penetrating type which achieves dispersion by penetrating through fine channels under high pressure.

Examples of the method for coating the undercoat layer forming coating liquid to the conductive substrate include dip coating, push-up coating, wire-bar coating, spray coating, blade coating, knife coating, and curtain coating.

The thickness of the undercoat layer is preferably 15 μm or more, and more preferably from 20 μm to 50 μm.

Although not shown, an intermediate layer may be formed between the undercoat layer and the photosensitive layer. Examples of the binder resin contained in the intermediate layer include: polymer resin compounds such as acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organometallic compounds containing zirconium, titanium, aluminium, manganese, or silicon atoms. These compounds may be used alone, or a mixture or a polycondensate of two or more thereof. Among them, organometallic compounds containing zirconium or silicon are preferred, because they have a low residual electric potential and thus potential change caused by the environment or repeated use is suppressed.

The intermediate layer is formed using an intermediate layer forming coating liquid that contains the above components in the solvent.

Examples of the method for coating the intermediate layer forming coating liquid include ordinary methods such as dip coating, push-up coating, wire-bar coating, spray coating, blade coating, knife coating, and curtain coating.

The intermediate layer functions as an electrical blocking layer in addition to improvement of spreadability of the upper layer. If the film thickness is too large, the electrical barrier may become too high, whereby desensitization and increase of potential due to repetitions may be caused. Accordingly, if formed, the intermediate layer is preferably provided so as to have a thickness of from 0.1 μm to 3 μm. In this case, the intermediate layer may be used as the undercoat layer.

Charge Generating Layer

The charge generating layer is composed of, for example, a charge-generating material and a binder resin. Examples of the charge-generating material include phthalocyanine pigments such as metal-free phthalocyanine, chlorogallium phthalocyanine, hydroxygallium phthalocyanine, dichlorotin phthalocyanine, and titanylphthalocyanine. Specific examples include chlorogallium phthalocyanine crystals having strong diffraction peaks at a Bragg angle (2θ±0.2°) of at least 7.4°, 16.6°, 25.5°, and 28.3° with respect to CuKα characteristic x-ray, metal-free phthalocyanine crystals having strong diffraction peaks at a Bragg angle (2θ±0.2°) of at least 7.7°, 9.3°, 16.9°, 17.5°, 22.4°, and 28.8° with respect to CuKα characteristic x-ray, hydroxygallium phthalocyanine crystals having strong diffraction peaks at a Bragg angle (2θ±0.2°) of at least 7.5°, 9.9°, 12.5°, 16.3°, 18.6°, 25.1°, and 28.3° with respect to CuKα characteristic x-ray, and titanylphthalocyanine crystals having strong diffraction peaks at a Bragg angle (2θ±0.2°) of at least 9.6°, 24.1°, and 27.2° with CuKα x-ray radiation. Other examples of the charge-generating material include quinone pigments, perylene pigments, indigo pigments, bisbenzimidazole pigments, anthrone pigments, and quinacridone pigments. These charge-generating materials may be used alone or in combination of two or more thereof.

Examples of the binder resin composing the charge generating layer include polycarbonate resins such as those of bisphenol A type or bisphenol Z type, acrylic resins, methacrylic resins, polyarylate resins, polyester resins, polyvinyl chloride resins, polystyrene resins, acrylonitrile-styrene copolymer resins, acrylonitrile-butadiene copolymers, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinyl carbazole resins. These binder resins may be used alone or in combination of two or more thereof.

The mixing ratio of the charge-generating material to the binder resin is preferably, for example, from 10:1 to 1:10.

The charge generating layer is formed using a charge generating layer forming coating liquid that contains the above components in the solvent.

Examples of the method for dispersing particles (for example, a charge generating material) in the charge generating layer forming coating liquid include media dispersers such as a ball mill, a vibrating ball mill, an attritor, a sand mill, and a horizontal sand mill; and medialess dispersers such as a stirrer, an ultrasonic disperser, a roll mill, and a high pressure homogenizer. The high pressure homogenizer may be of a collision type which achieves dispersion by liquid-liquid collision or liquid-wall collision under high pressure, or of a penetrating type which achieves dispersion by penetrating through fine channels under high pressure.

Examples of the method for coating the charge generating layer forming coating liquid on or above the undercoat layer include dip coating, push-up coating, wire-bar coating, spray coating, blade coating, knife coating, and curtain coating.

The thickness of the charge generating layer is preferably from 0.01 μm to 5 μm, and more preferably from 0.05 μm to 2.0 μm.

Charge Transport Layer

The charge transport layer is composed of a charge transporting material and, if needed, a binder resin. When the charge transport layer is the outermost surface layer, as described above, the charge transport layer is made of a cured film of the specific composition.

Examples of the charge transporting material include: hole transporting substances such as oxadiazole derivatives such as 2,5-bis(p-diethyl aminophenyl)-1,3,4-oxadiazole; pyrazoline derivatives such as 1,3,5-triphenyl-pyrazoline and 1-[pyridyl-(2)]-3-(p-diethylaminostyryl)-5-(p-diethylaminostyryl)pyrazoline; aromatic tertiary amino compounds such as triphenylamine, N,N'-bis(3,4-dimethylphenyl)biphenyl-4-amine, and tri(p-methylphenyl)aminyl-4-amine, and dibenzylaniline; aromatic tertiary diamino compounds such as N,N'-bis(3-methylphenyl)-N,N'-diphenylbenzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone; quinazoline derivatives such as 2-phenyl-4-styryl-quinazoline; benzofuran derivatives such as 6-hydroxy-2,3-di(p-methoxyphenyl)benzofuran; α-stilbene derivatives such as p-(2,2-diphenylvinyl)-N,N-diphenylaniline; enamine derivatives; carbazole derivatives such as N-ethylcarbazole; poly-N-vinyl carbazole and derivatives thereof; and electron transporting substances such as quinone compounds such as chloranil and bromoanthraquinone; tetracyanoquinodimethane compounds; fluorenone compounds such as 2,4,7-trinitrofluorenone and 2,4,5,7-tetranitro-9-fluorenone; xanthone compounds; thiophene compounds; and polymers having a group derived from any of the above compound in the main chain or side chain. These charge transporting materials may be used alone or in combination of two or more thereof.

Examples of the binder resin composing the charge transporting layer include: insulative resins such as polycarbonate resins such as those of bisphenol A type or bisphenol Z type; acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl faunal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorine rubber; and organic photoconductive polymers such as polyvinylcarbazole, polyvinylanthracene, and polyvinylpyrene. These binder resins may be used alone or in combination of two or more thereof.

The mixing ratio of the charge transporting material to the binder resin is, for example, preferably from 10:1 to 1:5.

The charge transport layer is formed using a charge transporting layer forming coating liquid that contains the above components in the solvent.

Examples of the method for dispersing particles (for example, fluorine resin particles) in the charge transport layer forming coating liquid include media dispersers such as a ball mill, a vibrating ball mill, an attritor, a sand mill, and a horizontal sand mill; and medialess dispersers such as a stirrer, an ultrasonic disperser, a roll mill, and a high pressure homogenizer. The high pressure homogenizer may be of a collision type which achieves dispersion by liquid-liquid collision or liquid-wall collision under high pressure, or of a penetrating type which achieves dispersion by penetrating through fine channels under high pressure.

Examples of the method for coating the charge transport layer forming coating liquid to the charge generating layer include ordinary methods such as dip coating, push-up coating, wire-bar coating, spray coating, blade coating, knife coating, and curtain coating.

The thickness of the charge transport layer is preferably from 5 μm to 50 μm and more preferably from 10 μm to 40 μm.

Protective Layer

The protective layer is made of a cured film of the composition containing the compound represented by the following Formula (M1), and a charge transporting material having a chain polymerizable functional group.

The compound represented by Formula (M1) is further described below.

(M1)

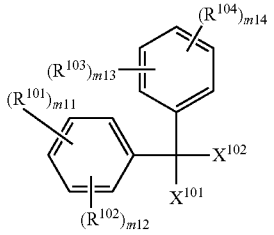

In Formula (M1), $X^{101}$ and $X^{102}$ each independently represent a hydrogen atom, a halogen atom, an alkyl group having 1 to 15 carbon atoms, an alkoxy group having 1 to 15 carbon atoms, a cyano group, a phenoxy group, an aryl group having 6 to 30 carbon atoms, —$Y^{101}$—$X^{103}$ (wherein $Y^{101}$ represents an azo group or a siloxy group; and $X^{103}$ represents an alkyl group having 1 to 15 carbon atoms, an alkoxy group having 1 to 15 carbon atoms, a cyano group, a phenoxy group, or an aryl group having 6 to 30 carbon atoms), or a substituent composed of any of these groups; $R^{101}$ and $R^{103}$ each independently represent a hydroxyl group or an alkoxy group having 1 to 15 carbon atoms; m11 and m13 each independently represent an integer of 0 or 1; $R^{102}$ and $R^{104}$ each independently represent an alkyl group having 1 to 15 carbon atoms; m12 and m14 each independently represent an integer of 0, 1, 2, or 3.

In Formula (M1), examples of the halogen atoms represented by $X^{101}$ and $X^{102}$ include a fluorine atom, a chlorine atom, and a bromine atom.

In Formula (M1), examples of the alkyl groups represented by $X^{101}$, $X^{102}$, and $X^{103}$ include substituted or unsubstituted linear, branched, and cyclic alkyl groups. The alkyl groups preferably have from 1 to 10 carbon atoms.

Specific examples of the alkyl groups include a methyl group, an ethyl group, an isopropyl group, a butyl group, a t-butyl group, an isopentyl group, an amyl group, a hexyl group, a cyclohexyl group, an octyl group, an ethylhexyl group, an isononyl group, a decyl group, a dodecyl group, and a tetradecyl group.

In Formula (M1), examples of the alkoxy groups represented by $X^{101}$, $X^{102}$, and $X^{103}$ include substituted or unsubstituted linear, branched, and cyclic alkoxy groups. The alkoxy groups preferably have from 1 to 15 carbon atoms, and more preferably from 1 to 10 carbon atoms.

Specific examples of the alkoxy group include a methoxy group, an ethoxy group, an isopropyloxy group, a butyloxy group, an isopentyloxy group, an amyloxy group, a hexyloxy group, a cyclohexyloxy group, an octyloxy group, an ethylhexyloxy group, an isononyloxy group, a decyloxy group, a dodecyloxy group, and a tetradecyloxy group.

In Formula (M1), examples of the phenoxy group represented by $X^{101}$, $X^{102}$, and $X^{103}$ include substituted or unsubstituted phenoxy groups.

In Formula (M1), examples of the aryl groups represented by $X^{101}$, $X^{102}$, and $X^{103}$ include a substituted or unsubstituted phenyl group, a substituted or unsubstituted polycyclic aromatic group (an aromatic group linked to a benzene ring), and a substituted or unsubstituted condensed aromatic group. The aryl groups preferably have from 6 to 30 carbon atoms, and more preferably from 6 to 20 carbon atoms.

Examples of the polycyclic aromatic group include a biphenyl group and a triphenyl group.

Examples of the condensed aromatic group include an indenyl group, a naphthyl group, an azulenyl group, a fluorenyl group, a phenanthrenyl group, an anthracenyl group, an acenaphthylenyl group, and a biphenylenyl group.

In the formula (M1), examples of the substituents composed of any of the above groups represent by $X^{101}$ and $X^{102}$ include the following structures (M1-A) to (M1-B).

In the structures (M1-A) to (M1-B), $X^{104}$, $X^{105}$, and $X^{106}$ each independently represent a hydrogen atom, a halogen atom, an alkyl group having 1 to 15 carbon atoms, an alkoxy group having 1 to 15 carbon atoms, a cyano group, a phenoxy group, an aryl group having 6 to 30 carbon atoms, —$Y^{101}$—$X^{103}$ (wherein $Y^{101}$ represents an azo group or a siloxy group, $X^{103}$ represents an alkyl group having 1 to 15 carbon atoms, an alkoxy group having 1 to 15 carbon atoms, a cyano group, a phenoxy group, or an aryl group having 6 to 30 carbon atoms). Details of $X^{104}$, $X^{105}$, and $X^{106}$ are the same as those of $X^{101}$.

(M1-A)

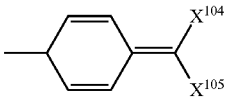

(M1-B)

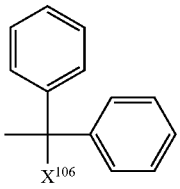

In Formula (M1), examples of the alkoxy groups represented by $R^{101}$ and $R^{103}$ include a linear, branched, or cyclic substituted or unsubstituted alkoxy groups. The alkoxy groups preferably have from 1 to 15 carbon atoms, and more preferably from 1 to 10 carbon atoms.

Specific examples of the alkoxy group include a methoxy group, an ethoxy group, a propoxy group, an isopropyloxy group, a butyloxy group, an isobutoxy group, a sec-butoxy group, and a t-butoxy group.

In Formula (M1), when m11 and m13 each represent an integer of 1, the hydroxyl groups or alkoxy groups represented by $R^{101}$ and $R^{103}$ are preferably located at the p-position of each phenyl group in Formula (M1).

In Formula (M1), examples of the alkyl group represented by $R^{102}$ and $R^{104}$ include linear, branched, or cyclic substituted or unsubstituted alkyl groups. The alkyl group preferably has from 1 to 15 carbon atoms, and more preferably from 1 to 10 carbon atoms.

Specific examples of the alkyl group include a methyl group, an ethyl group, an isopropyl group, a butyl group, a t-butyl group, an isopentyl group, an amyl group, a hexyl group, a cyclohexyl group, an octyl group, an ethylhexyl group, an isononyl group, and a decyl group.

In Formula (M1), when any of the above groups have a substituent, examples of the substituent include a hydrogen atom, an alkyl group, an alkoxy group, a phenoxy group, an aryl group, an aralkyl group, a substituted amino group, and a halogen atom.

The alkyl group as a substituent preferably has 1 to 10 carbon atoms, and examples thereof include a methyl group, an ethyl group, a propyl group, and an isopropyl group. The alkoxyl group as a substituent preferably has 1 to 10 carbon atoms, and examples thereof include a methoxy group, an ethoxy group, a propoxy group, and an isopropoxy group. The aryl group as a substituent preferably has 6 to 20 carbon atoms, and examples thereof include a phenyl group and a toluyl group. The aralkyl group preferably has 7 to 20 carbon atoms, and examples thereof include a benzyl group and a phenethyl group. Examples of the substituent of the substituted amino group include an alkyl group, an aryl group, and an aralkyl group, and specific examples thereof are the same as those described above.

The compound represented by Formula (M1) is preferably any of the compound represented by the formulae (M2) to (M3), particularly from the viewpoint of preventing the occurrence of an afterimage (ghost image) due to residual preceding images.

Other examples of the compound represented by the formula (M1) include the compounds wherein $X^{101}$ represents a hydrogen atom, $X^{102}$ represents an alkyl group having 1 to 15 carbon atoms, $R^{101}$ and $R^{103}$ each independently represent a hydroxyl group or an alkoxy group having 1 to 15 carbon atoms, m11 and m13 each independently represent an integer of 1, and m12 and m14 represent 0.

Among them, the compound represented by the formula (M2) is preferred.

(M2)

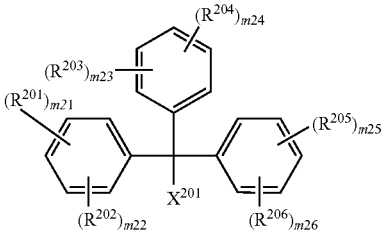

In Formula (M2), $X^{201}$ represents a hydrogen atom, a halogen atom, an alkyl group having 1 to 15 carbon atoms, an alkoxy group having 1 to 15 carbon atoms, a cyano group, a phenoxy group, an aryl group having 6 to 30 carbon atoms, or —$Y^{201}$—$X^{202}$ (wherein $Y^{201}$ represents an azo group or a siloxy group, $X^{102}$ represents an alkyl group having 1 to 15 carbon atoms, an alkoxy group having 1 to 15 carbon atoms, a cyano group, a phenoxy group, or an aryl group having 6 to 30 carbon atoms).

Details of $X^{201}$ are the same as those of $X^{101}$ in Formula (M1).

In the formula (M2), $R^{201}$, $R^{203}$, and $R^{205}$ each independently represent a hydroxyl group; m21, m23, and m25 each independently represent an integer of 0 or 1.

Details of $R^{201}$, $R^{203}$ and $R^{205}$, and details of m21, m23, and m25 are the same as those of $R^{101}$ and m11 in Formula (M1), respectively.

In Formula (M2), $R^{202}$, $R^{204}$, and $R^{206}$ each independently represent an alkyl group having 1 to 15 carbon atoms; m22, m24, and m26 each independently represent an integer of 0, 1, 2, or 3.

Details of $R^{202}$, $R^{204}$, and $R^{206}$, and Details of m22, m24, and m26 are the same as those of $R^{102}$ and m12 in the formula (M1), respectively.

Particularly preferably, in Formula (M2), $X^{201}$ represents a hydrogen atom or —$Y^{201}$—$X^{202}$ (wherein $Y^{201}$ represents an azo group, and $X^{202}$ represents an aryl group having 6 to 30 carbon atoms); $R^{201}$, $R^{203}$, and $R^{205}$ each independently represent a hydroxyl group; m21, m23, and m25 each independently represent an integer of 0 or 1; and m22, m24, and m26 represent 0.

(M3)

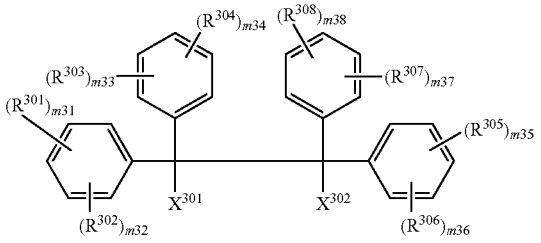

In Formula (M3), $X^{301}$, and $X^{302}$ each independently represent a hydrogen atom, a halogen atom, an alkyl group having 1 to 15 carbon atoms, an alkoxy group having 1 to 15 carbon atoms, a cyano group, a phenoxy group, an aryl group having 6 to 30 carbon atoms, or —$Y^{301}$—$X^{303}$ (wherein $Y^{301}$ represents an azo group or a siloxy group, $X^{303}$ represents an alkyl group having 1 to 15 carbon atoms, an alkoxy group having 1 to 15 carbon atoms, a cyano group, a phenoxy group, or an aryl group having 6 to 30 carbon atoms).

Details of $X^{301}$ and $X^{302}$ are the same as those of $X^{101}$ in Formula (M1).

In Formula (M3), $R^{301}$, $R^{303}$, $R^{305}$, and $R^{307}$ each independently represent a hydroxyl group; m31, m33, m35, and m37 each independently represent an integer of 0 or 1.

Details of $R^{301}$, $R^{303}$, $R^{305}$, and $R^{307}$, and details of m31, m33, m35, and m37 are the same as those of $R^{101}$ and m11 in the formula (M1), respectively.

In Formula (M3), $R^{302}$, $R^{304}$, $R^{306}$, and $R^{308}$ each independently represent an alkyl group having 1 to 15 carbon atoms; m32, m34, m36, and m38 each independently represent an integer of 0, 1, 2, or 3.

Details of $R^{302}$, $R^{304}$, $R^{306}$, and $R^{308}$, and details of m32, m34, m36, and m38 are the same as those of $R^{102}$ and m12 in Formula (M1), respectively.

Particularly preferably, in the formula (M3), $X^{301}$ represents a cyano group or a phenoxy group.

Specific examples of the compound represented by Formula (M1) include the following compounds. However, the exemplary embodiment of the invention is not limited thereto.

(M-1)

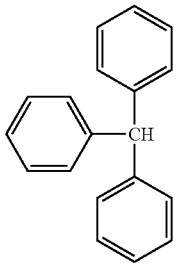

(M-2)

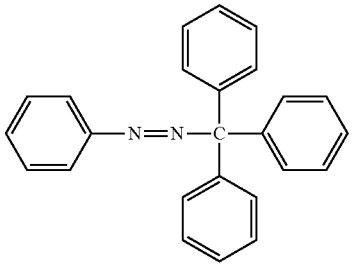

(M-3)

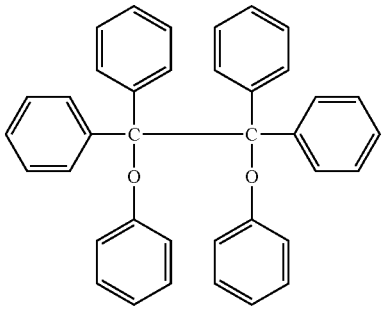

-continued (M-4)

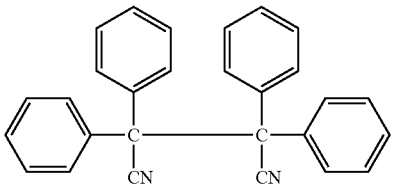

(M-5)

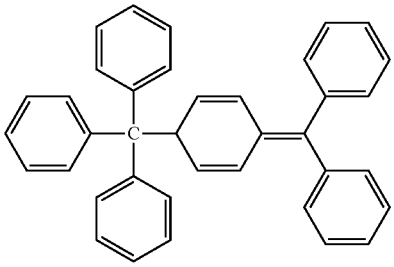

(M-6)

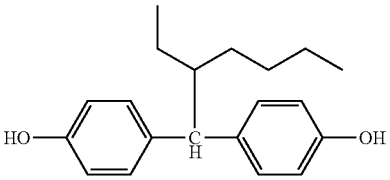

(M-7)

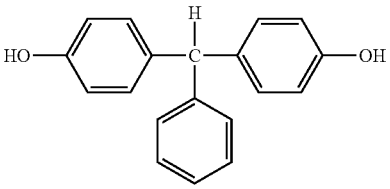

(M-8)

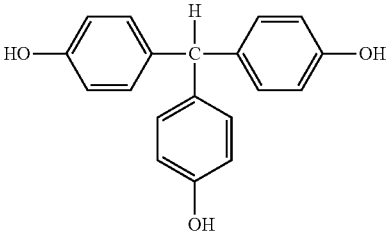

(M-9)

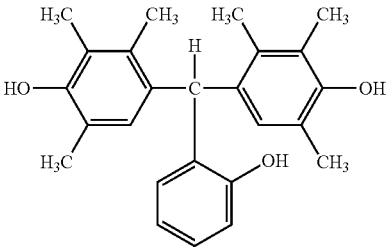

(M-10)

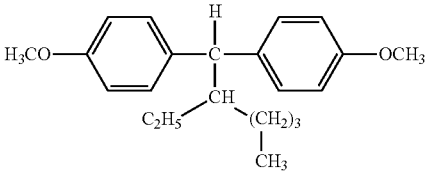

-continued (M-11)

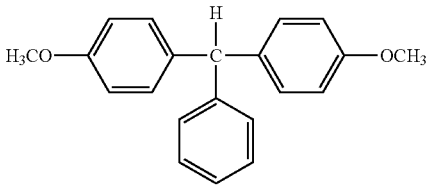

(M-12)

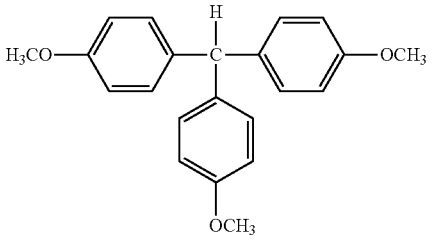

(M-13)

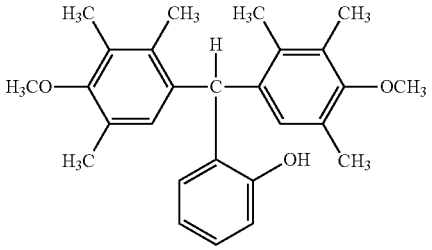

From the viewpoint of preventing occurrence of an after-image (ghost image) due to residual preceding images, the compound represented by Formula (M1) preferably has a weight average molecular weight of 5000 or less, more preferably from 100 to 2000, and even more preferably from 150 to 1000.

The content of the compound represented by Formula (M1) is preferably from 0.01% by weight to 20% by weight, more preferably from 0.05% by weight to 10% by weight, even more preferably from 0.1% by weight to 5% by weight, with respect to the composition used for the formation of the protective layer.

The charge transporting material having a chain polymerizable functional group is further described below.

The charge transporting material having a chain polymerizable functional group is a compound having a charge transporting skeleton and a chain polymerizing functional group in the molecule thereof.

The charge transporting skeleton may be a skeleton derived from a nitrogen-containing hole-transporting compound such as a triarylamine compound, a benzidine compound, or a hydrazone compound, wherein the structure is conjugated to a nitrogen atom.

Examples of the chain polymerizable functional group include an acryloyl group, a methacryloyl group, and a styrene group. Particularly a methacryloyl group is preferable.

Specific examples of the charge transporting material having a chain polymerizable functional group are preferably a compound represented by the following Formula (I).

(I)

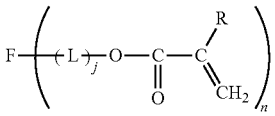

In Formula (I), F represents a hole-transporting organic group having an n valence, R represents a hydrogen atom or an alkyl group, L represents a divalent organic group, n represents an integer of 1 or more, and j represents 0 or 1.

F in Formula (I) represents an n-valent organic group having a hole transporting property. Examples of the organic group include an organic group derived from an arylamine derivative, that is, an organic group obtained by removing n hydrogen atoms from an arylamine derivative. Among arylamine derivatives, an n-valent organic group derived from an arylamine derivative such as a triphenylamine derivative or a tetraphenylbenzidine derivative is preferable.

Then, n in Formula (I) represents an integer of 1 or more. However, n is preferably 2 or more and more preferably 4 or more from the viewpoint of improving a crosslinking density and thereby obtaining a stronger crosslinked film (cured film). An upper limit value of n is preferably 20 and more preferably 10 from the viewpoints of stability of a coating solution and electric characteristics.

When n is set in the preferable range as described above, rotating torque of an electrophotographic photoreceptor is reduced in particular when a blade cleaner is used; accordingly, damage to a blade and wear of the electrophotographic photoreceptor are suppressed. The mechanisms thereof are not clear. However, it is assumed that when the number of reactive functional groups increases, a cured film having a high crosslinking density is obtained, and thereby a molecular motion of a very surface of the electrophotographic photoreceptor is suppressed to weaken an interaction with molecules in a surface of a blade member.

Furthermore, R in Formula (I) represents a hydrogen atom or an alkyl group. As the alkyl group, straight chain or branched alkyl groups having from 1 to 5 carbon atoms are preferable.

Among these, R is preferably a methyl group. That is, in a compound represented by Formula (I), a terminal of a substituent in a parenthesis is preferably a methacryloyl group. Although a reason for this is not clear, inventors consider as shown below.

Usually, an acryl group having a high reactivity is often used in a curing reaction. However, it is thought that, when an acryl group having a high reactivity is used as a substituent of a bulky charge transporting material like a compound represented by Formula (I), an inhomogeneous curing reaction tends to occur, which results in a micro (or macro)-sea-island structure. The sea-island structure like this is not particularly problematic in a field other than an electronic field. However, when the sea-island structure is used for an electrophotographic photoreceptor, disadvantages such as unevenness or crimp in the outmost surface layer or density unevenness are caused. Accordingly, R is preferable to be a methyl group.

It is thought that formation of such sea-island structure is particularly noticeable when plural functional groups attaches to one charge transporting skeleton (F in formula (I)).

Furthermore, L in Formula (I) represents a divalent organic group. As the divalent organic group, an organic group containing an alkylene group having 2 or more carbon atoms is preferable. Still furthermore, j is preferably 1 from the viewpoints of electric characteristics and mechanical strength. A reason why such a structure is preferable is not necessarily clear. However, the inventors consider as shown below.

That is, it is thought that, in the case where, like a compound represented by Formula (I), a radically polymerizable substituent is polymerized, when a radical generated during polymerization has a structure readily moving to a charge transporting skeleton (F in Formula (I)), the generated radical deteriorates a charge transporting function, which results in deterioration of electric characteristics. Furthermore, concerning the mechanical strength, it is thought that, when a bulky charge transporting skeleton and a polymerizable site are near to each other and rigid, polymerizable sites are difficult to move each other, which results in remarkable reduction of reaction probability. From these reasons, it is thought that it is preferable for L to contain an alkylene group having two or more carbon atoms and for j to be 1.

Herein, when L is an organic group containing an alkylene group having two or more carbon atoms, the organic group may be constituted of only an alkylene group having two or more carbon atoms, or may be a combination of an alkylene group having two or more carbon atoms and a divalent group such as alkenylene, alkynylene, ether, thioether, ester or arylene (for example, phenylene). An upper limit value of a number of carbon atoms of an alkylene group is preferably 20 and more preferably 10 from the viewpoint of mechanical strength.

The compound represented by Formula (I) is preferably a compound represented by Formula (II) shown below.

The compound represented by Formula (II) is excellent in particular in the stability to charge mobility and oxidation.

(II)

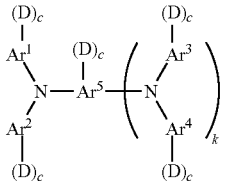

In Formula (II), $Ar^1$ to $Ar^4$ each independently represent a substituted or unsubstituted aryl group, $Ar^5$ represents a substituted or unsubstituted aryl group or a substituted or unsubstituted arylene group, D represents $-(L)_j-O-CO-C(R)=CH_2$, j represents 0 or 1, five cs each independently represent 0 or 1, k represents 0 or 1, and the total number of Ds is 1 or more, and L, R and j each have the same definitions as those of L, R and j in Formula (II). Furthermore, R is preferably a hydrogen atom or a straight chain or branched alkyl group having from 1 to 5 carbon atoms.

The total number of Ds in Formula (II) corresponds to n in Formula (I) and is preferably 2 or more and more preferably 4 or more from the viewpoint of improving a crosslinking density and being able to obtain a crosslinked film (cured film) having a higher mechanical strength as mentioned above.

R is, as mentioned above, preferably a methyl group.

In Formula (II), $Ar^1$ to $Ar^4$ each independently represent a substituted or unsubstituted aryl group. $Ar^1$ to $Ar^4$ may be the same or different from each other.

Herein, with respect to a substituent in the substituted aryl group, examples of the substituent other than D: $-(L)_j-O-CO-C(R)=CH_2$ include an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms, and a halogen atom are cited.

$Ar^1$ to $Ar^4$ each are preferably any one of structural formulas (1) to (7) shown below. The structural formulas (1) to (7) shown below are shown together with "-(D)c" that is linkable with each of $Ar^1$ to $Ar^4$. Herein, "-(D)c" has the same meaning as "-(D)c" in Formula (II), and preferable examples are also the same as those of "-(D)c" in Formula (II).

(1)

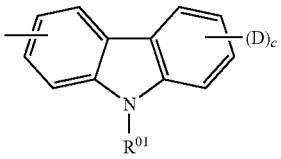

(2)

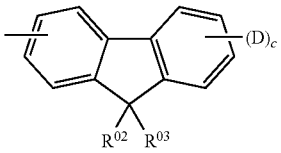

(3)

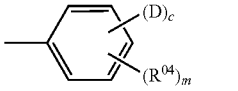

(4)

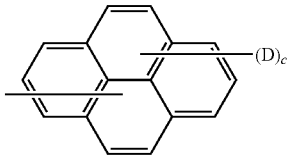

(5)

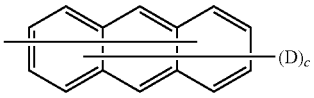

(6)

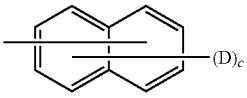

(7)

In structural formula (1), $R^{01}$ represents one selected from the group consisting of a hydrogen atom, an alkyl group having from 1 to 4 carbon atoms, a phenyl group substituted by an alkyl group having from 1 to 4 carbon atoms or an alkoxy group having from 1 to 4 carbon atoms, an unsubstituted phenyl group, and an aralkyl group having from 7 to 10 carbon atoms.

In structural formulas (2) and (3), $R^{02}$ to $R^{04}$ each independently represent one selected from the group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms and a halogen atom. Furthermore, m represents an integer of from 1 to 3.

In structural formula (7), Ar represents a substituted or unsubstituted arylene group.

Herein, Ar in formula (7) is preferably represented by structural formula (8) or (9) shown below.

(8)

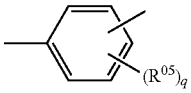

(9)

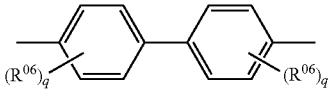

In structural formulas (8) and (9), $R^{05}$ and $R^{06}$ each independently represent one selected from the group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms and a halogen atom. Furthermore, qs each represent an integer of from 1 to 3.

In structural formula (7), Z' represents a divalent organic linking group and is preferably represented by any one of structural formulas (10) to (17) shown below. Furthermore, p represents 0 or 1.

(10)

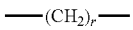

(11)

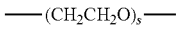

(12)

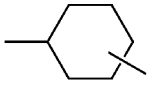

(13)

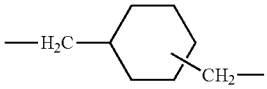

(14)

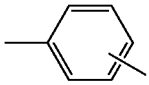

(15)

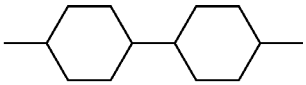

(16)

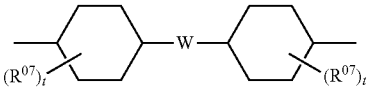

(17)

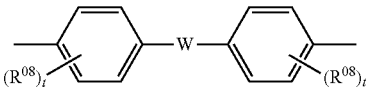

In structural formulas (10) to (17), $R^{07}$ and $R^{08}$ each independently represent one selected from a group consisting of a hydrogen atom, an alkyl group having from 1 to 4 carbon atoms, an alkoxy group having from 1 to 4 carbon atoms, a phenyl group substituted by an alkoxy group having from 1 to 4 carbon atoms, an unsubstituted phenyl group, an aralkyl group having from 7 to 10 carbon atoms and a halogen atom, W represents a divalent group, r and s each independently represent an integer of from 1 to 10, and is each represent an integer of from 1 to 3.

Furthermore, W in structural formulas (16) to (17) is preferably any one of divalent groups represented by any one of structural formulas (18) to (26) shown below. However, in formula (25), u represents an integer of from 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

(25)

(26)

In formula (II), $Ar^5$ is a substituted or unsubstituted aryl group when k is 0, and, examples of the aryl group are the same as those of aryl groups in $Ar^1$ to $Ar^4$. $Ar^5$ is a substituted or unsubstituted arylene group when k is 1, and, as the arylene group, an arylene group obtained by removing one hydrogen atom at a predetermined site from an aryl group exemplified in the description of $Ar^1$ to $Ar^4$ is cited.

Hereinafter, specific examples of the compound represented by Formula (I) will be shown. Compounds represented by Formula (I) are not at all restricted thereto.

In the beginning, specific examples (compounds i-1 to i-14) when n in Formula (I) is 1 are shown without restricting thereto.

| No. | |
|---|---|
| i-1 | |

-continued

| No. | |
|---|---|
| i-2 | |
| i-3 | |
| i-4 | |
| i-5 | |
| i-6 | |

No.
i-7
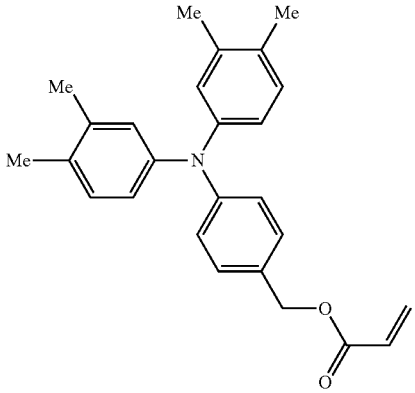
i-8
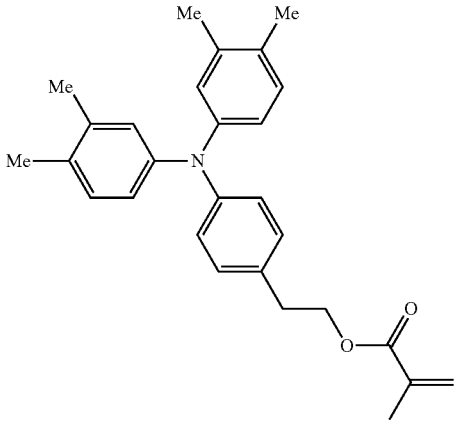
i-9
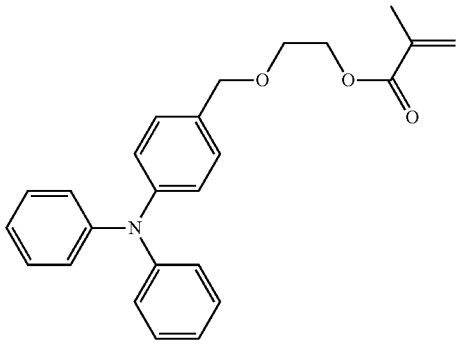
i-10
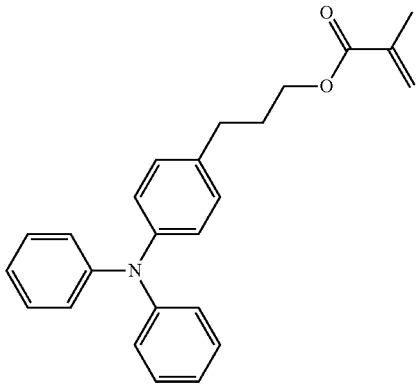
No.
i-11
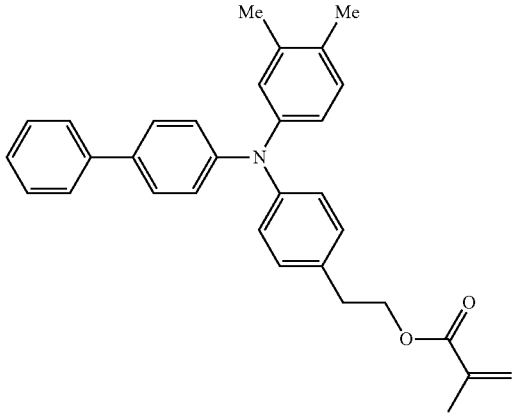
i-12
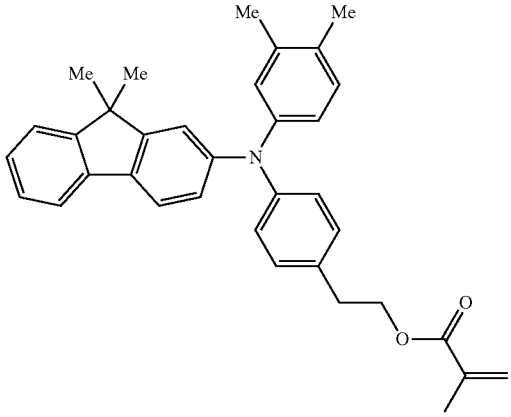
i-13
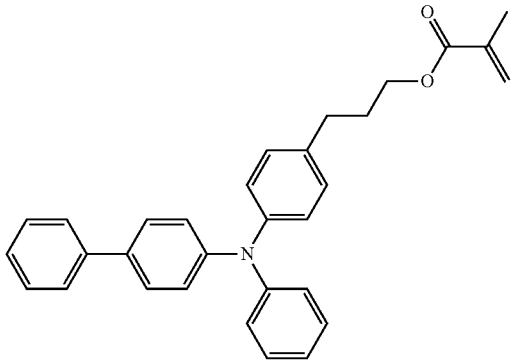
i-14
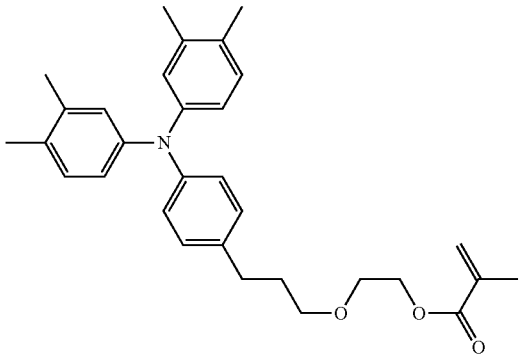

The following compounds are the specific examples of the compound represented by Formula (I) wherein n is 2 (compounds ii-1 to ii-26). However, the compound will not be limited to these examples.
| No. |
|---|
| ii-1 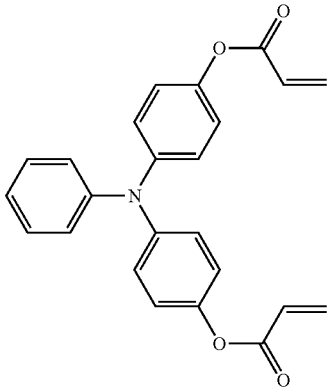 |
| ii-2 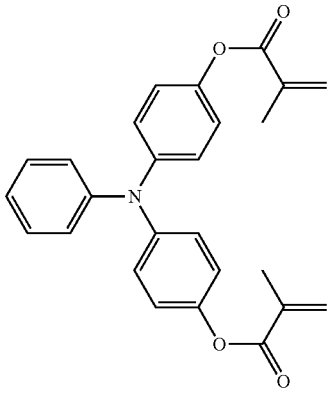 |
| ii-3 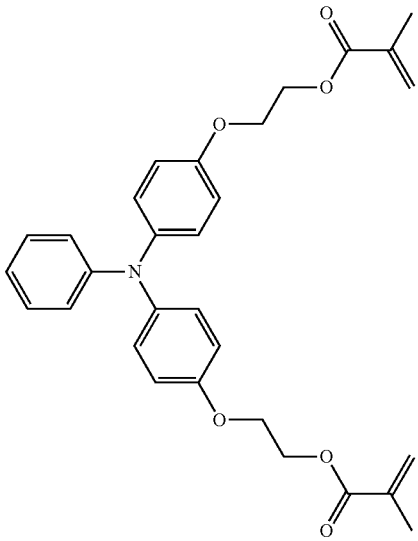 |

-continued
| No. | |
|---|---|
| ii-4 | 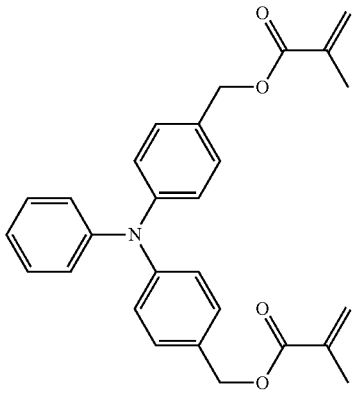 |
| ii-5 | 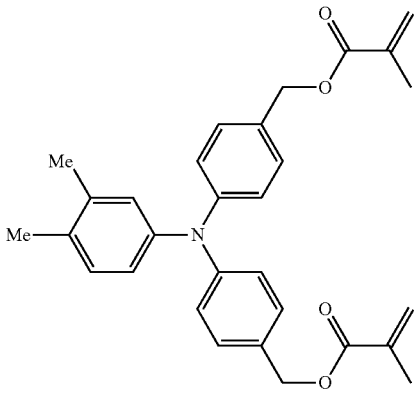 |
| ii-6 | 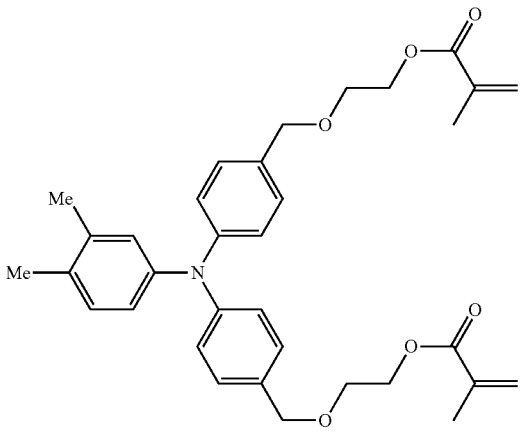 |

-continued
| No. | |
|---|---|
| ii-7 | 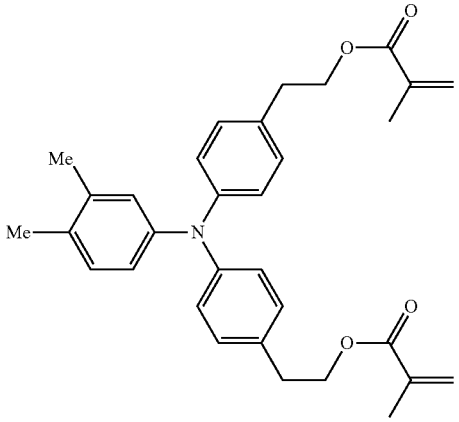 |
| ii-8 | 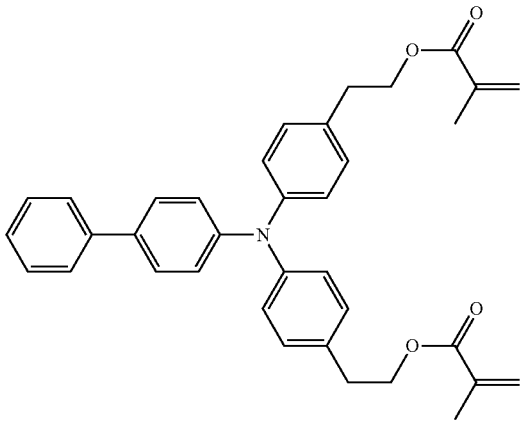 |
| ii-9 | 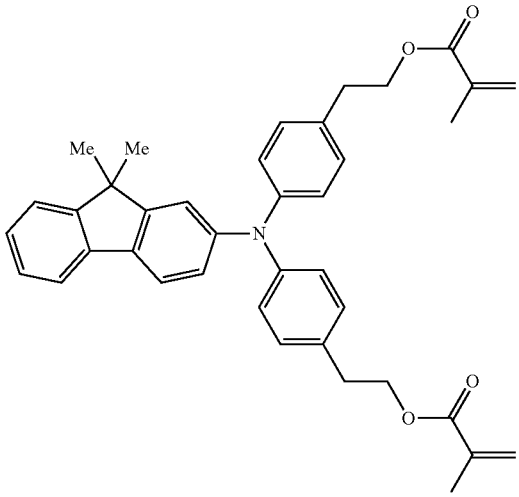 |

-continued
| No. | |
|---|---|
| ii-10 | 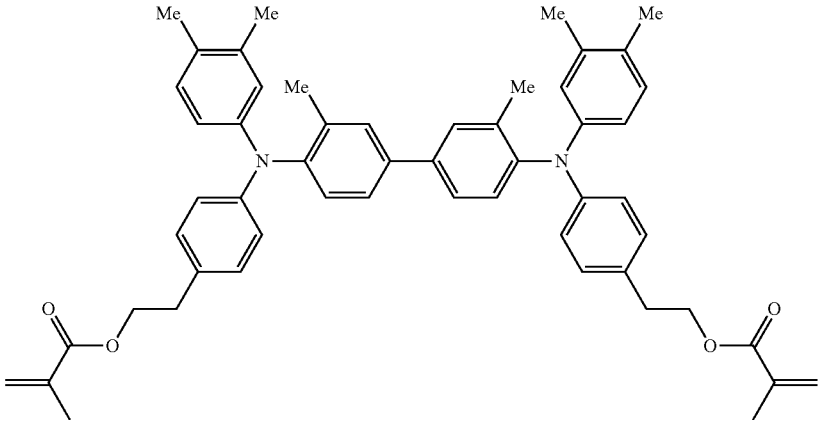 |
| ii-11 | 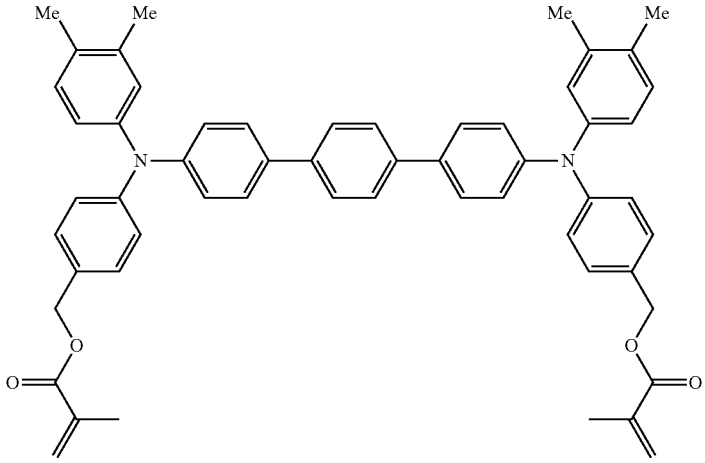 |
| ii-12 | 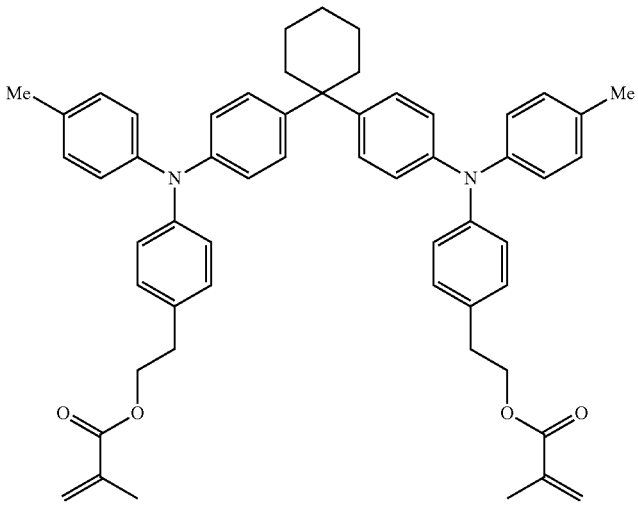 |

-continued
| No. | |
|---|---|
| ii-13 | 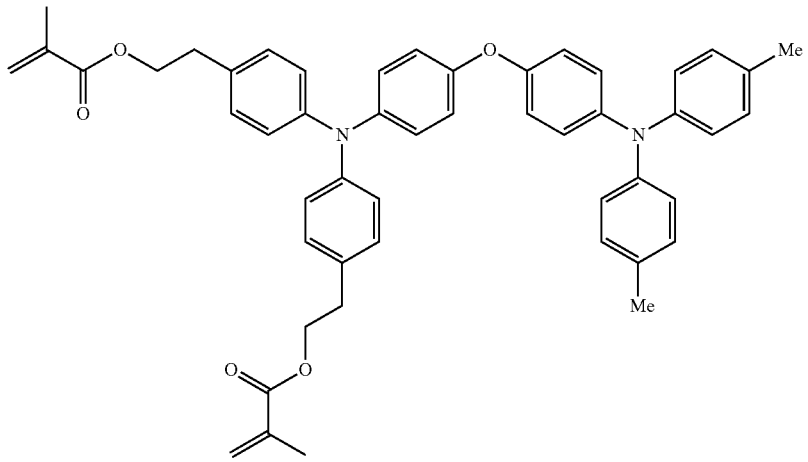 |
| ii-14 | 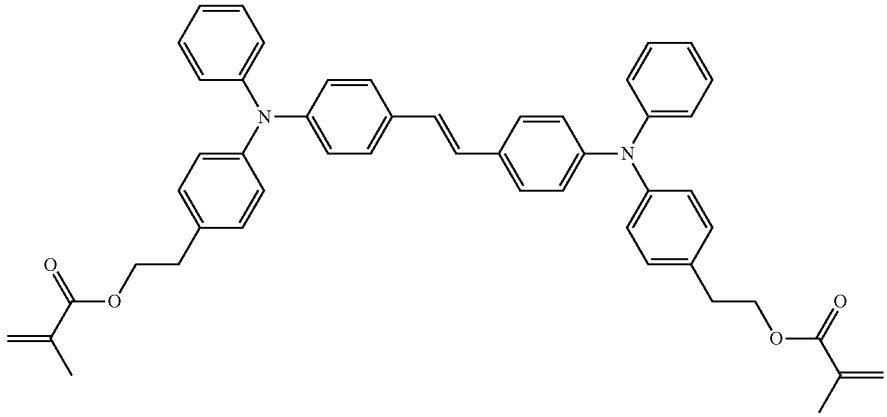 |
| ii-15 | 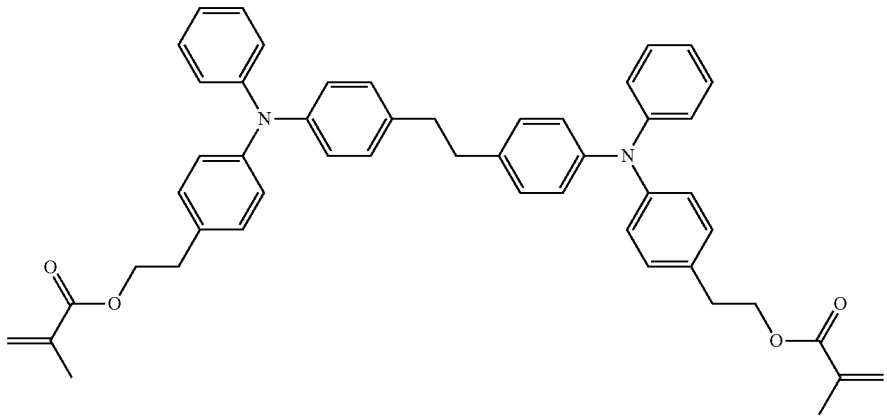 |

-continued
| No. |
| --- |
| ii-16 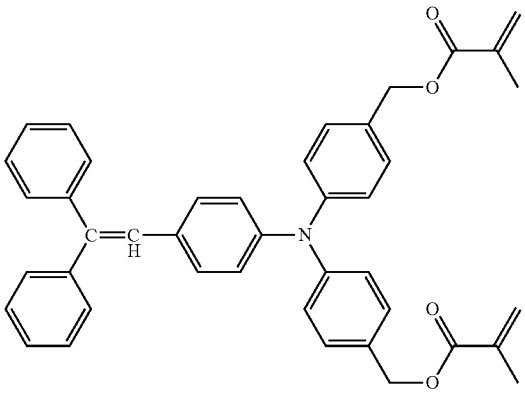 |
| ii-17 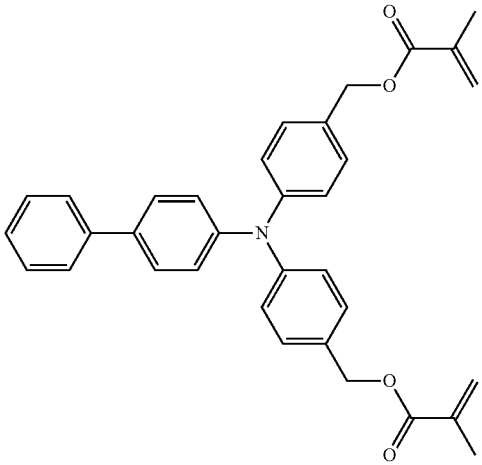 |
| ii-18 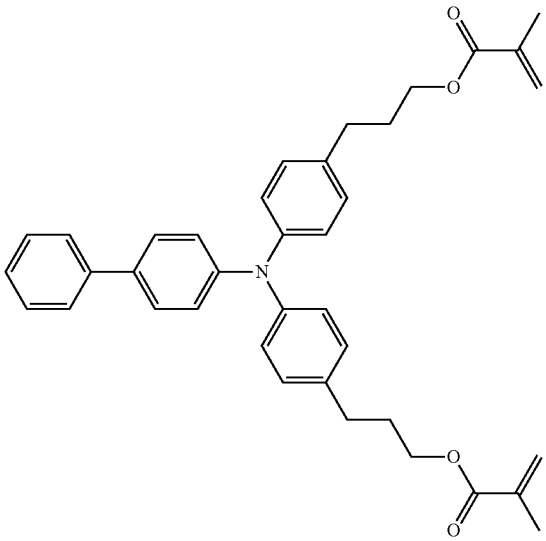 |

-continued
| No. | |
|---|---|
| ii-19 | 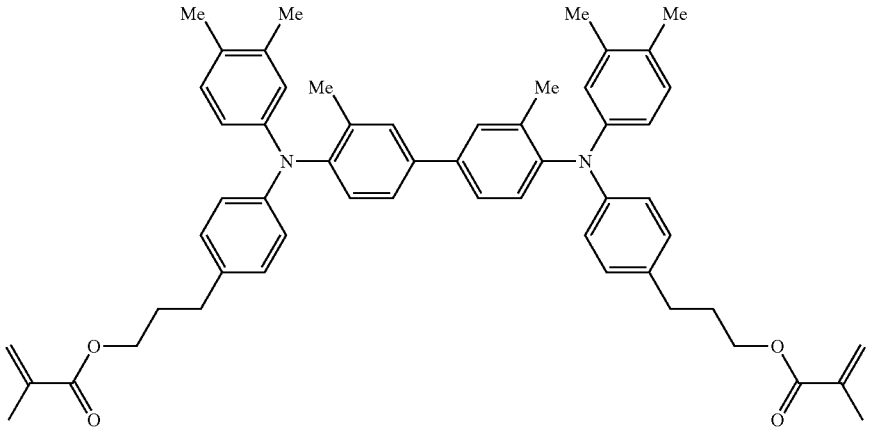 |
| ii-20 | 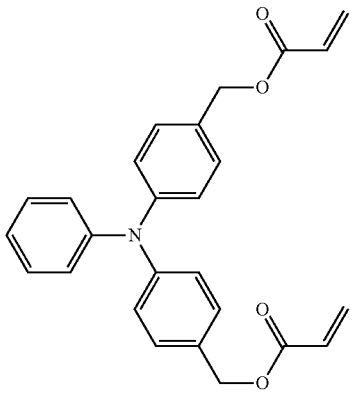 |
| ii-21 | 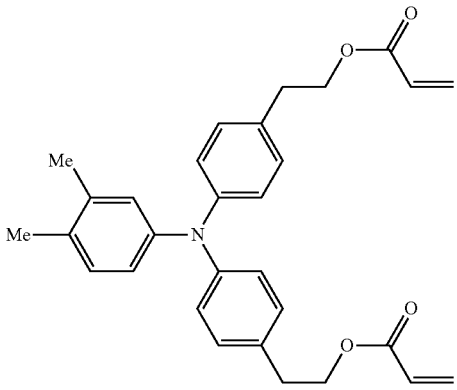 |

-continued
No.
ii-22
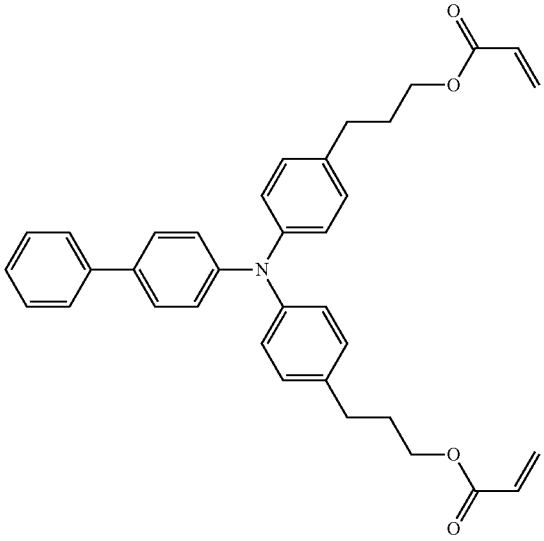
ii-23
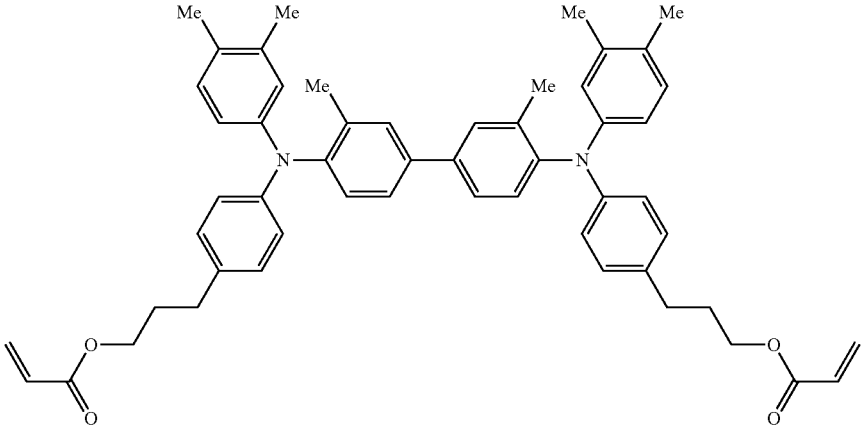
ii-24
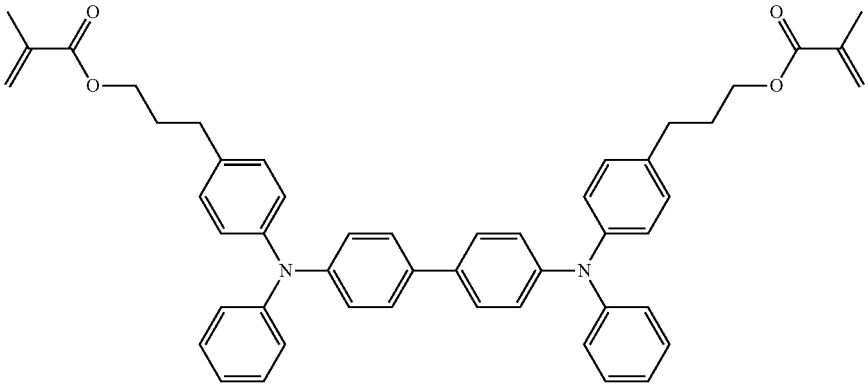

-continued
| No. | |
|---|---|
| ii-25 | 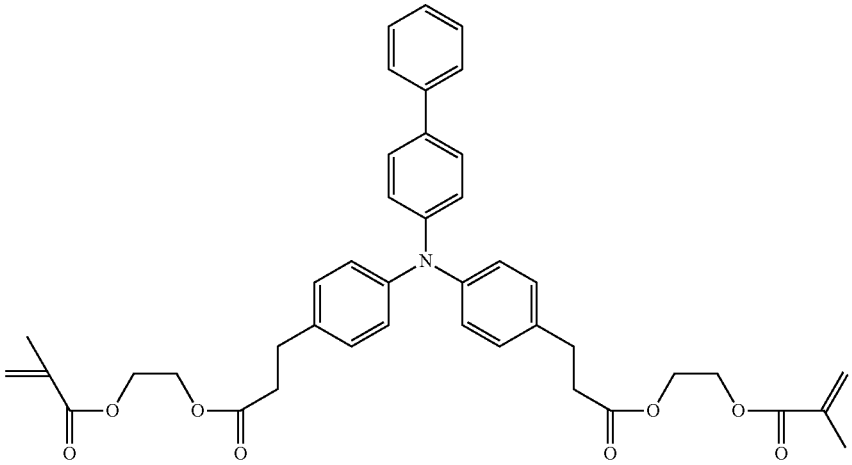 |
| ii-26 | 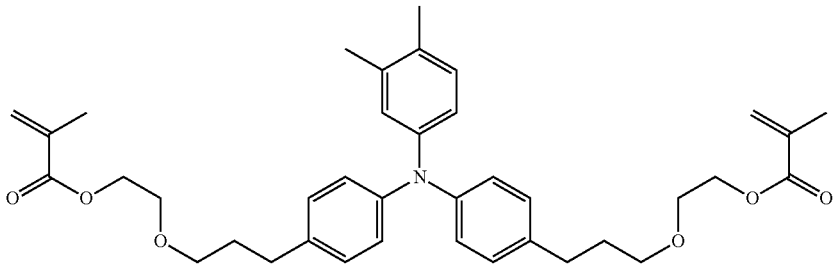 |
The following compounds are the specific examples of the compound represented by Formula (I) wherein n is 3 (compounds iii-1 to iii-11). However, the compound will not be limited to these examples.
| No. | |
|---|---|
| iii-1 | 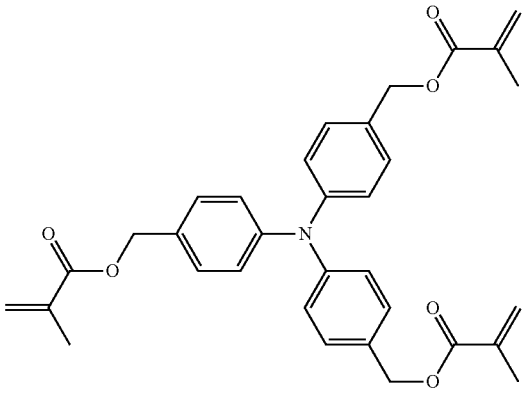 |

-continued
| No. |
| --- |
| iii-2 |
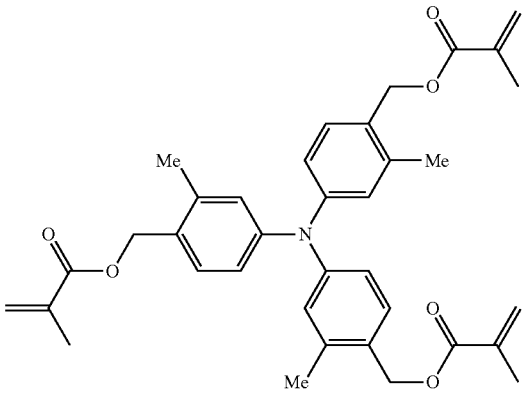
iii-3
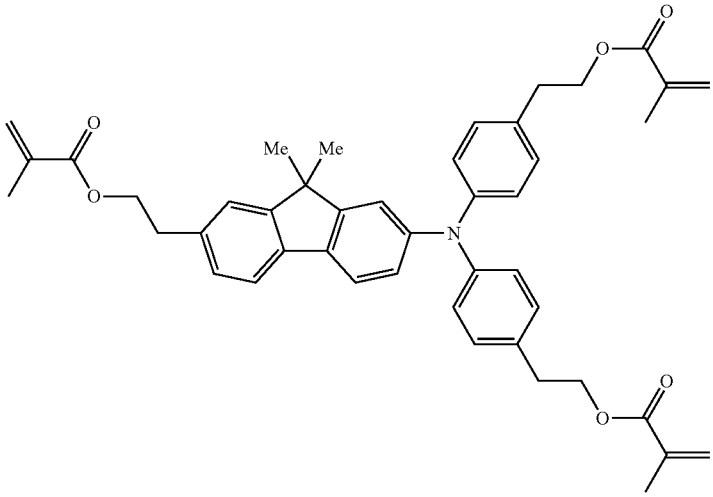
iii-4
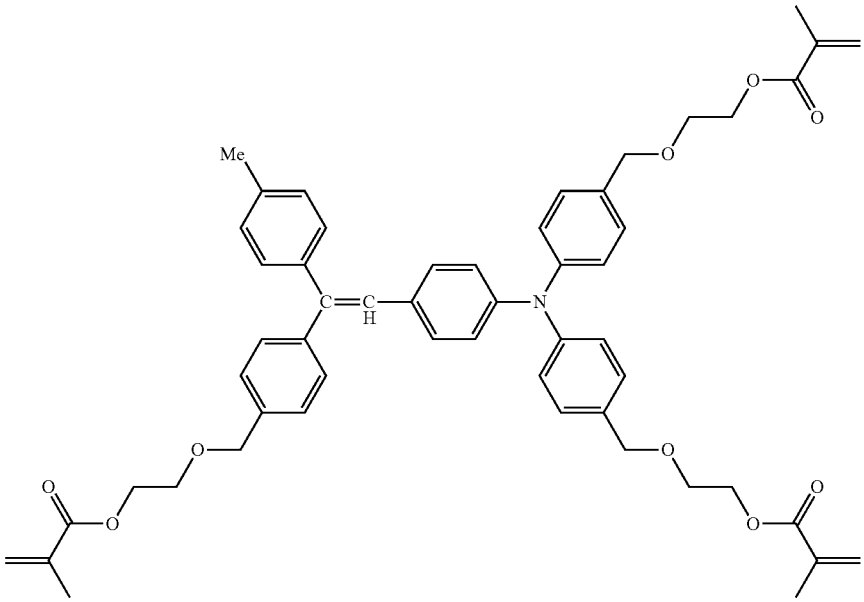

-continued
| No. |
| --- |
| iii-5 |
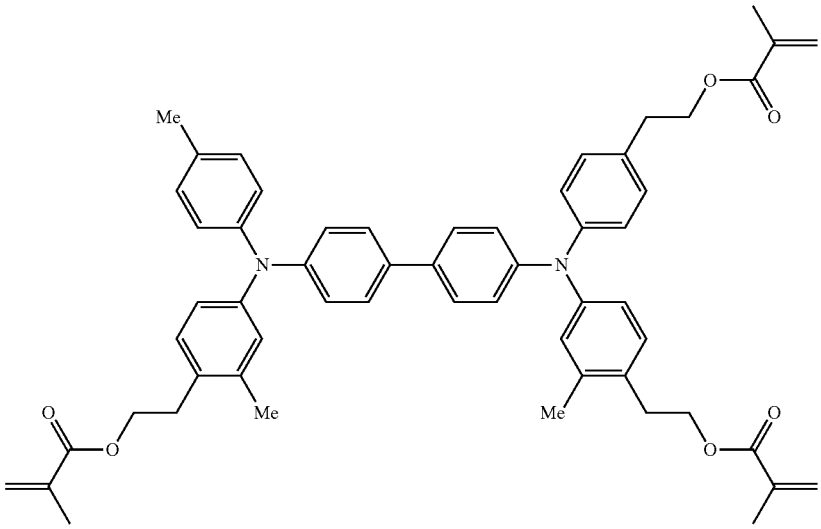
iii-6
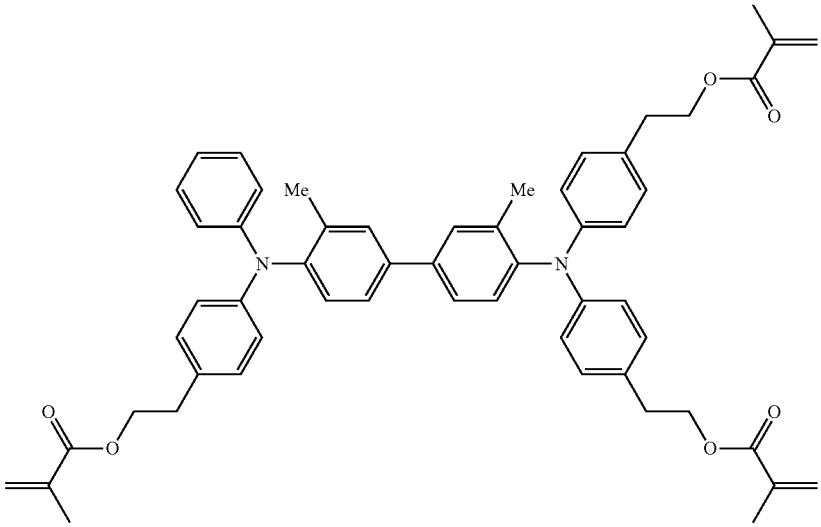
iii-7
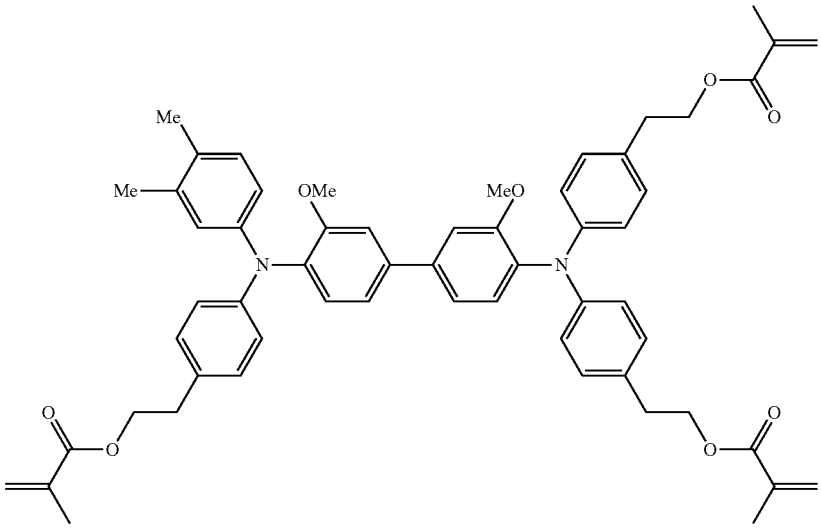

-continued
No.
iii-8
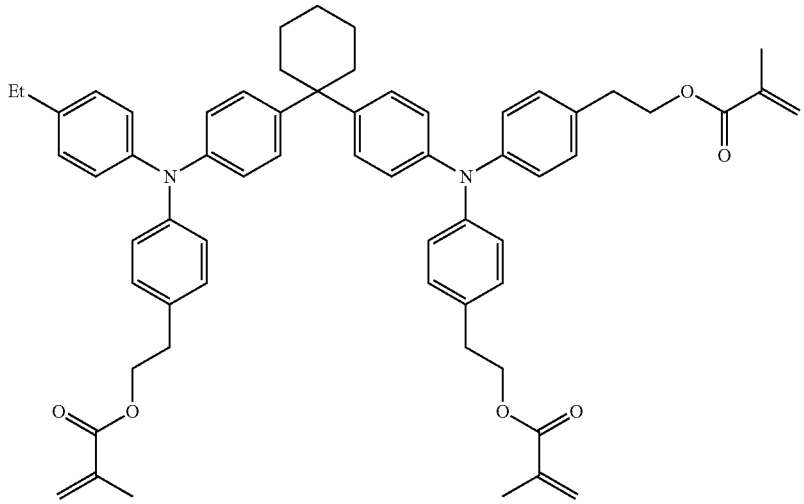
iii-9
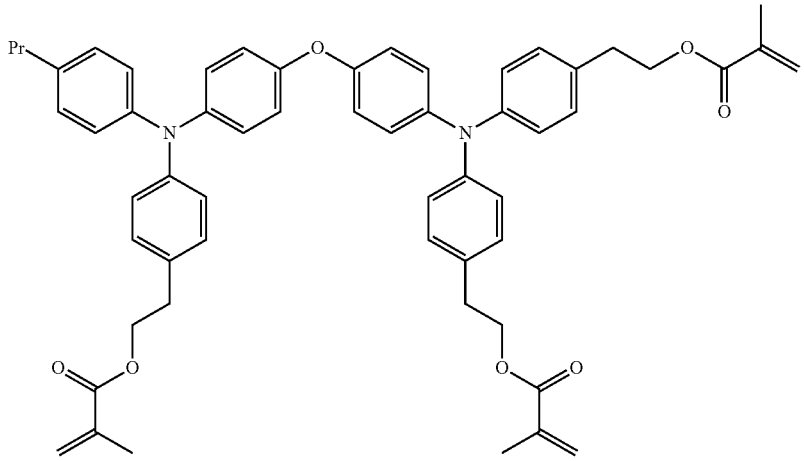
iii-10
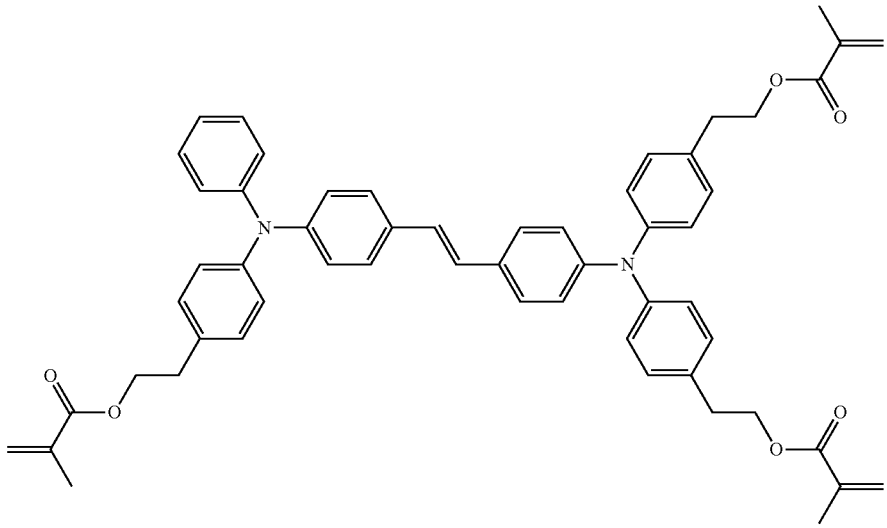

-continued
| No. |
| --- |
iii-11
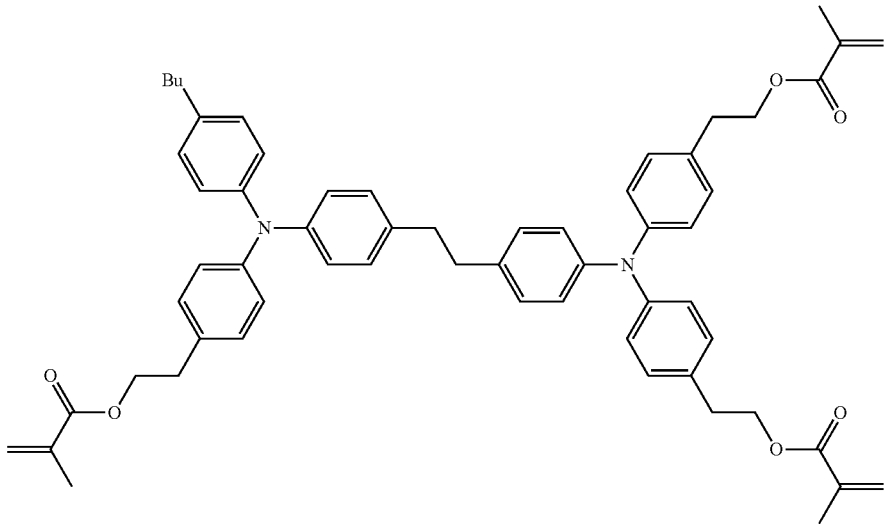
The following compounds are specific examples of the compound represented by Formula (I) wherein n is 4 (compounds iv-1 to iv-18), n is 5 (compound v-1), and n is 6 (compounds vi-1 to vi-2).
| No. |
| --- |
iv-1
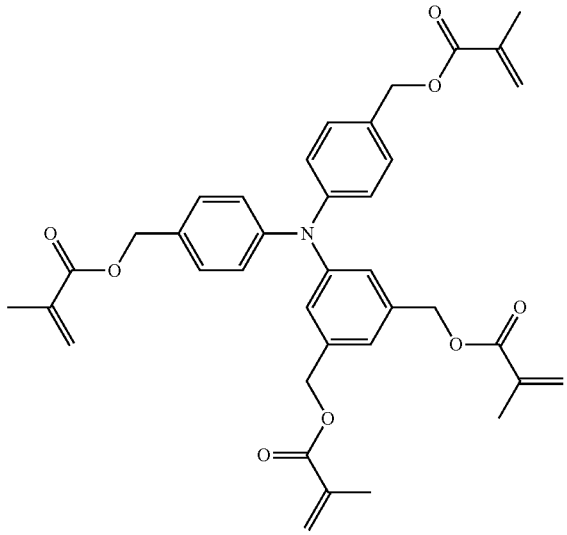

-continued
| No. | |
|---|---|
| iv-2 | 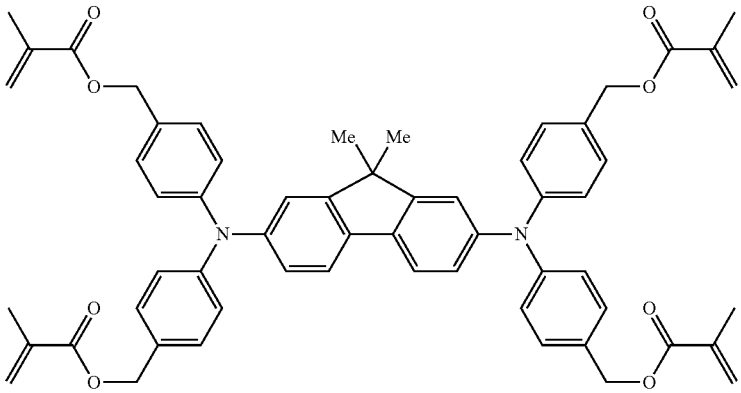 |
| iv-3 | 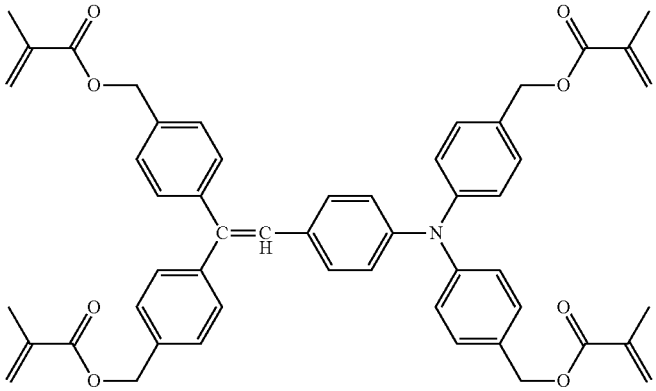 |
| iv-4 | 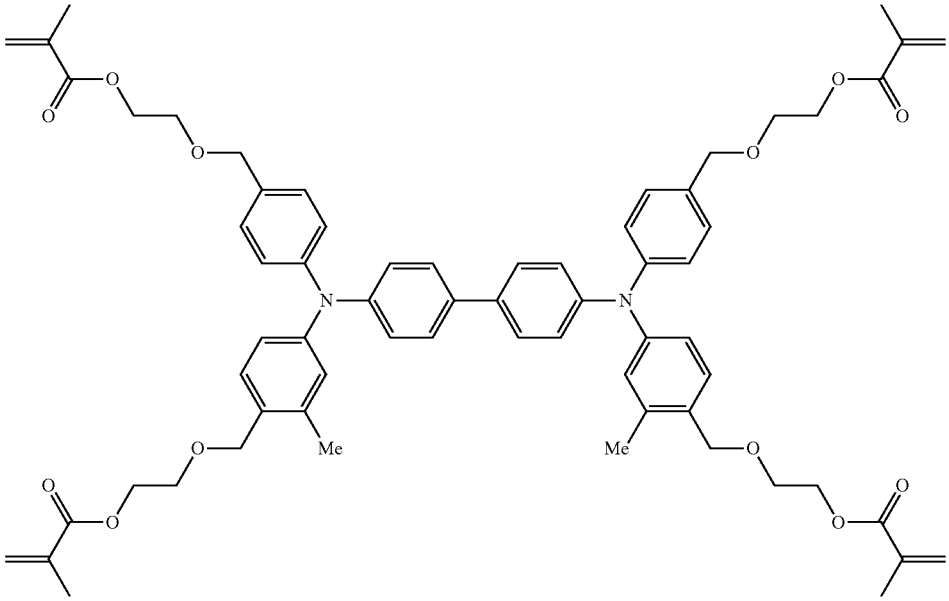 |

-continued
| No. | |
|---|---|
| iv-5 | 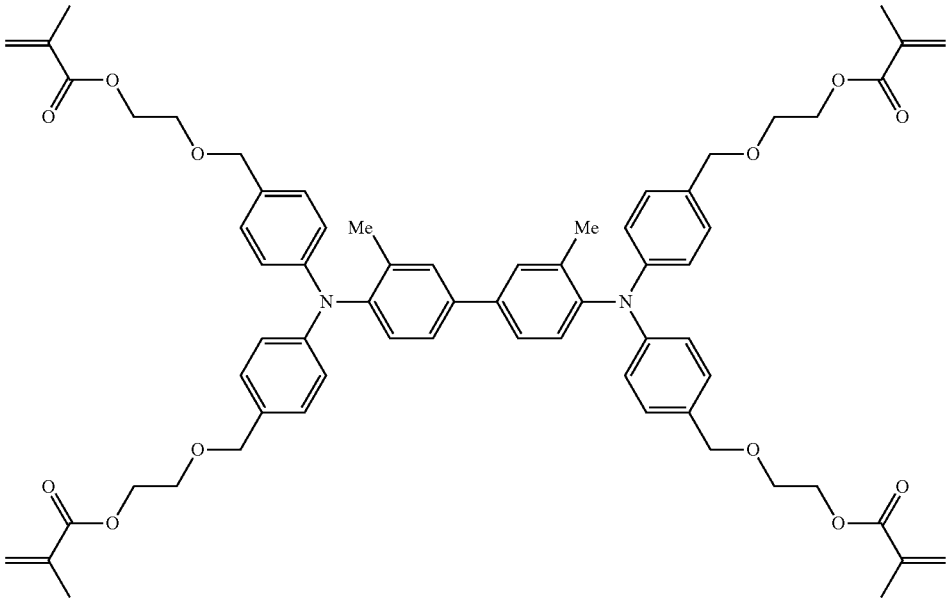 |
| iv-6 | 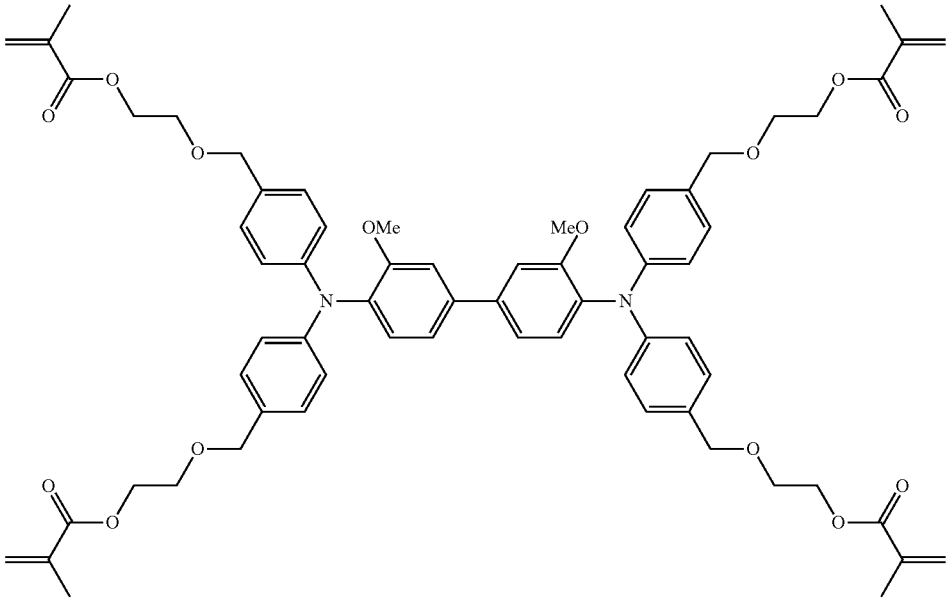 |

-continued
| No. | |
|---|---|
| iv-7 | 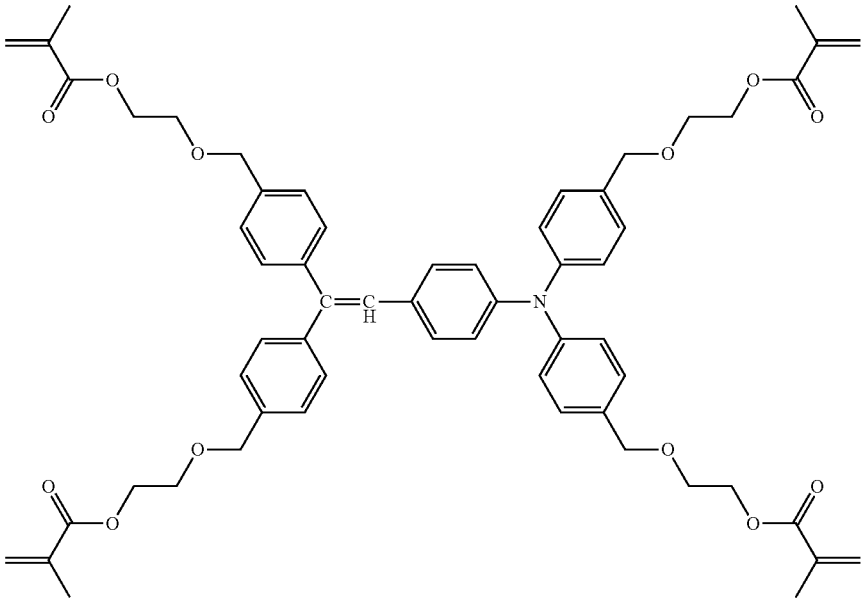 |
| iv-8 | 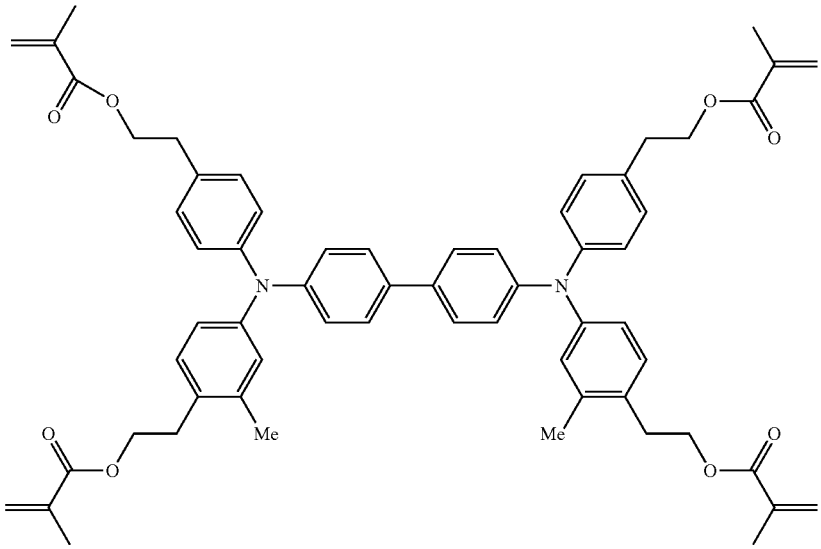 |

-continued
| No. |
| --- |
| iv-9 |
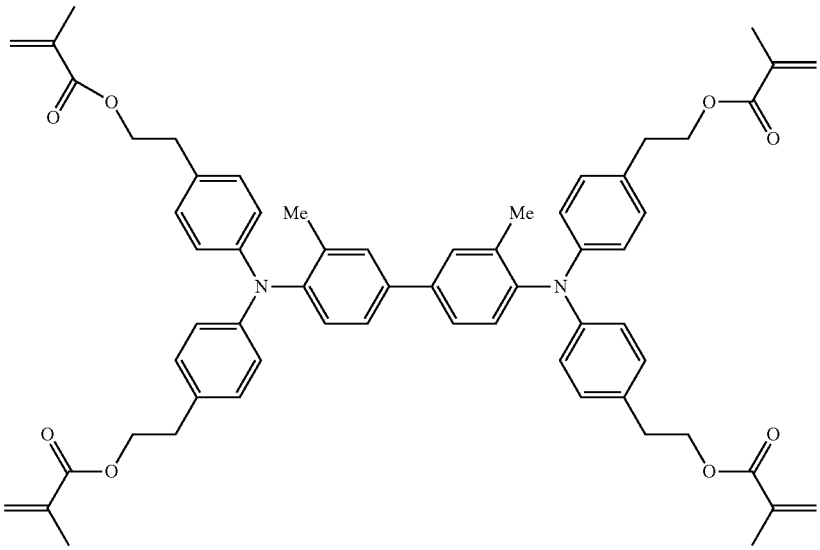
iv-10
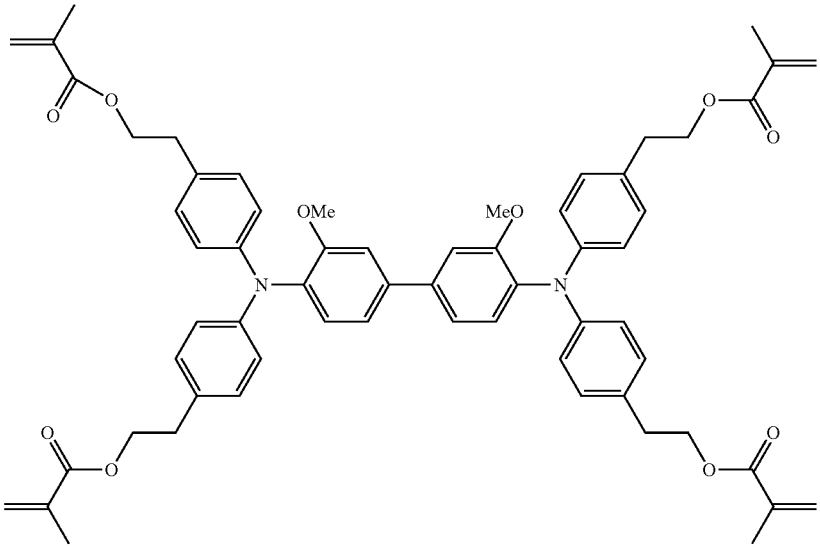
iv-11
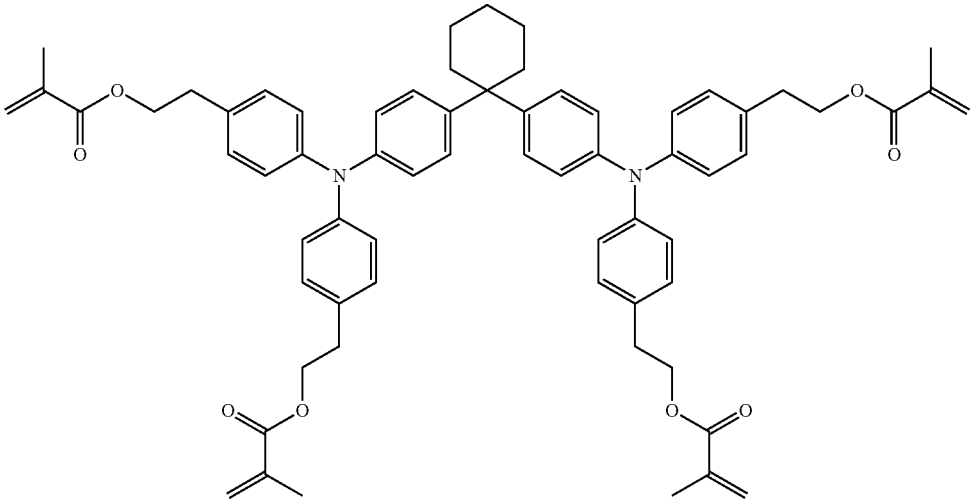

-continued
| No. | |
|---|---|
| iv-12 | 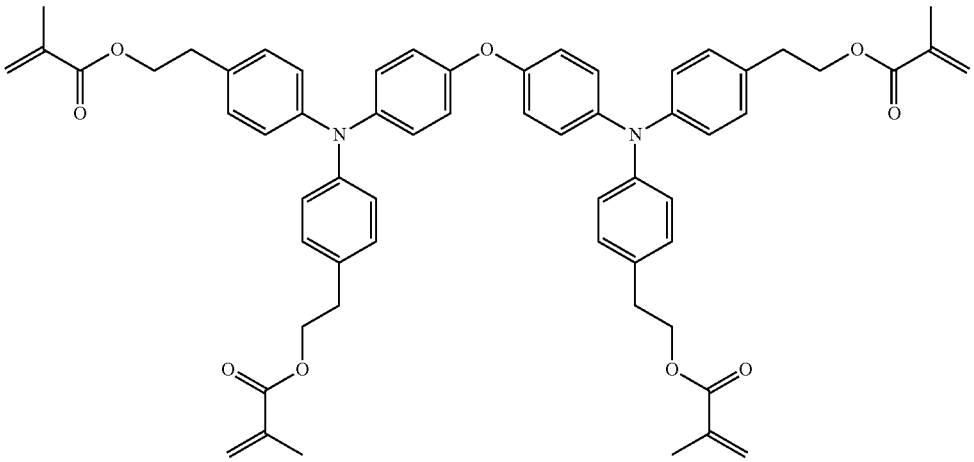 |
| iv-13 | 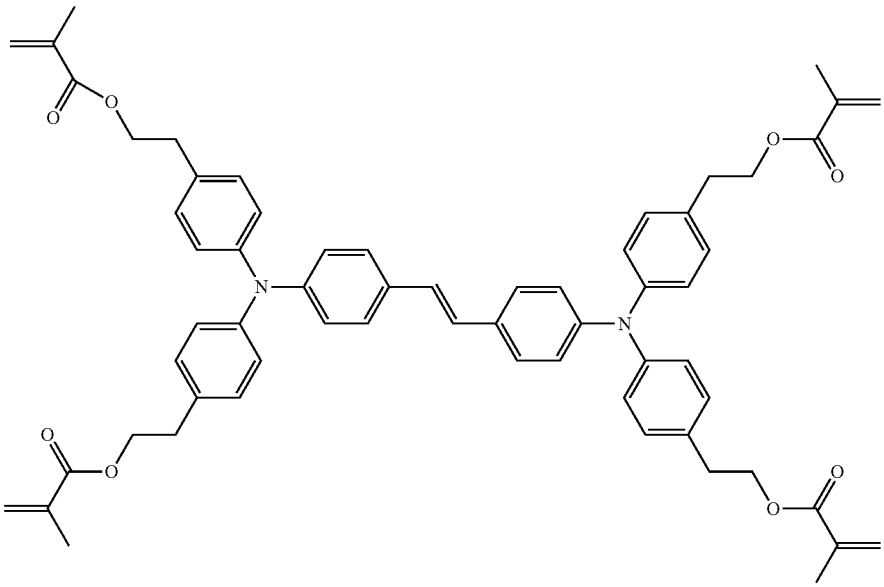 |

-continued
| No. |
| --- |
| iv-14 |
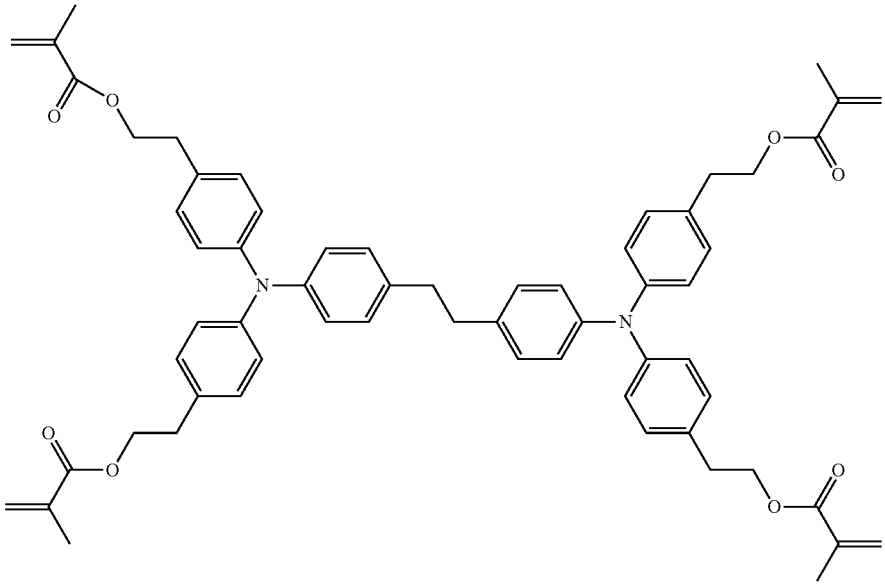
iv-15
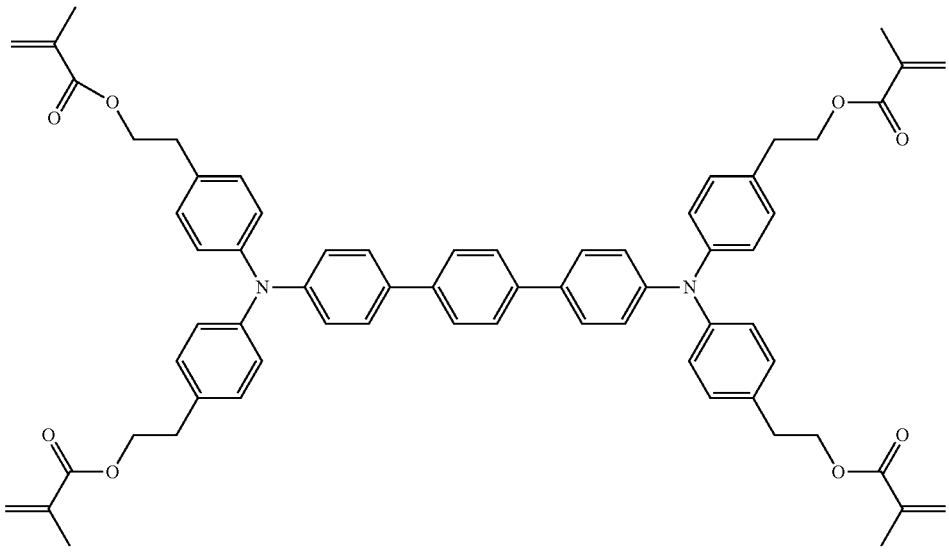

-continued
| No. | |
|---|---|
| iv-16 | 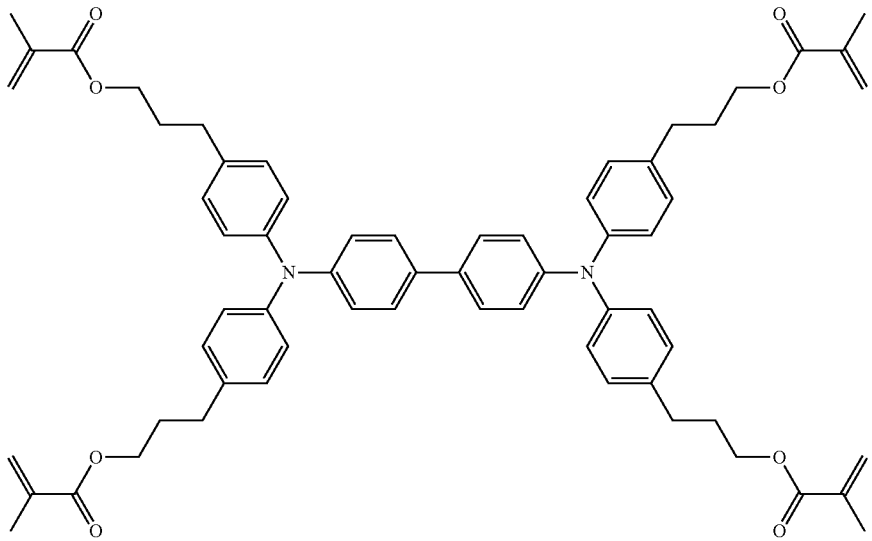 |
| iv-17 | 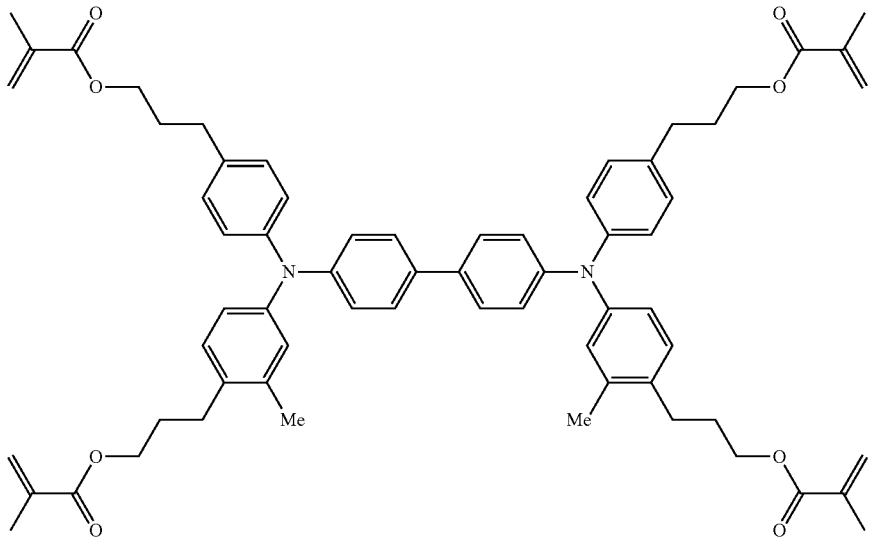 |
| iv-18 | 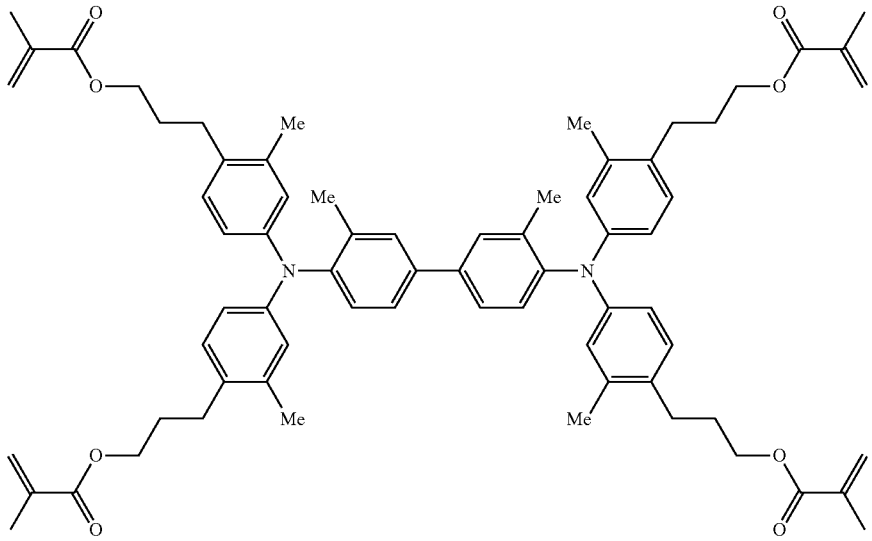 |

-continued
| No. |
| --- |
v-1
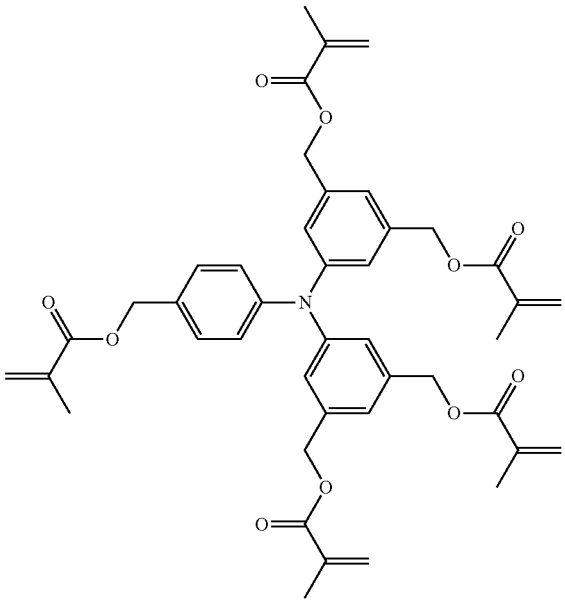
vi-1
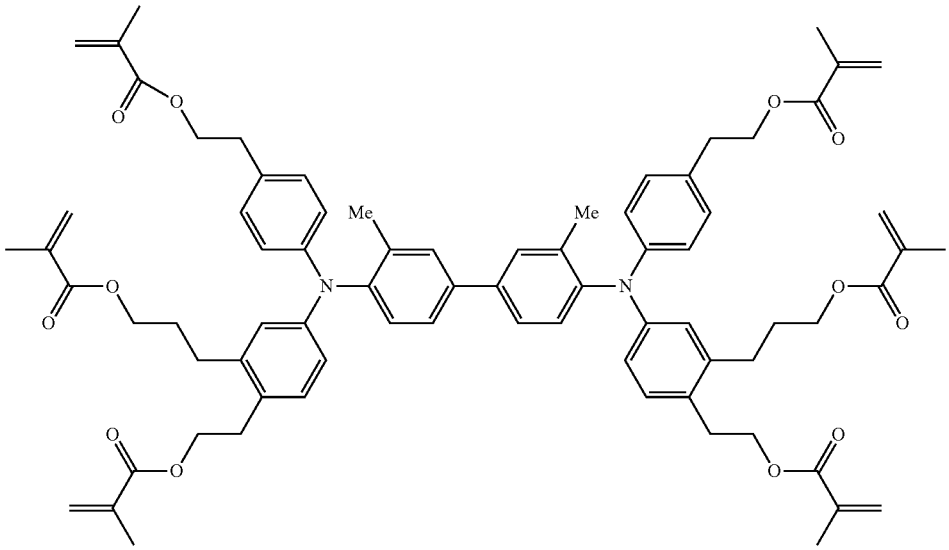

-continued
| No. |
| --- |
| vi-2 |
Examples of the synthetic pathways of the compounds iv-4 and iv-17 are shown below.
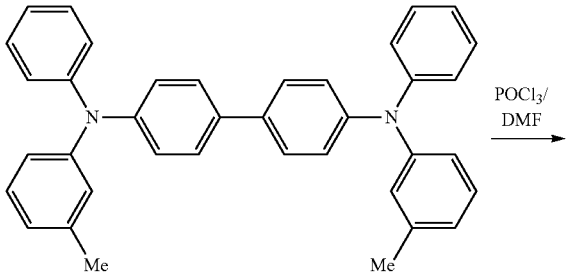
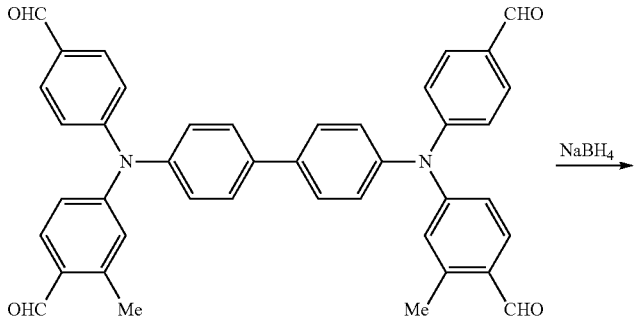

-continued
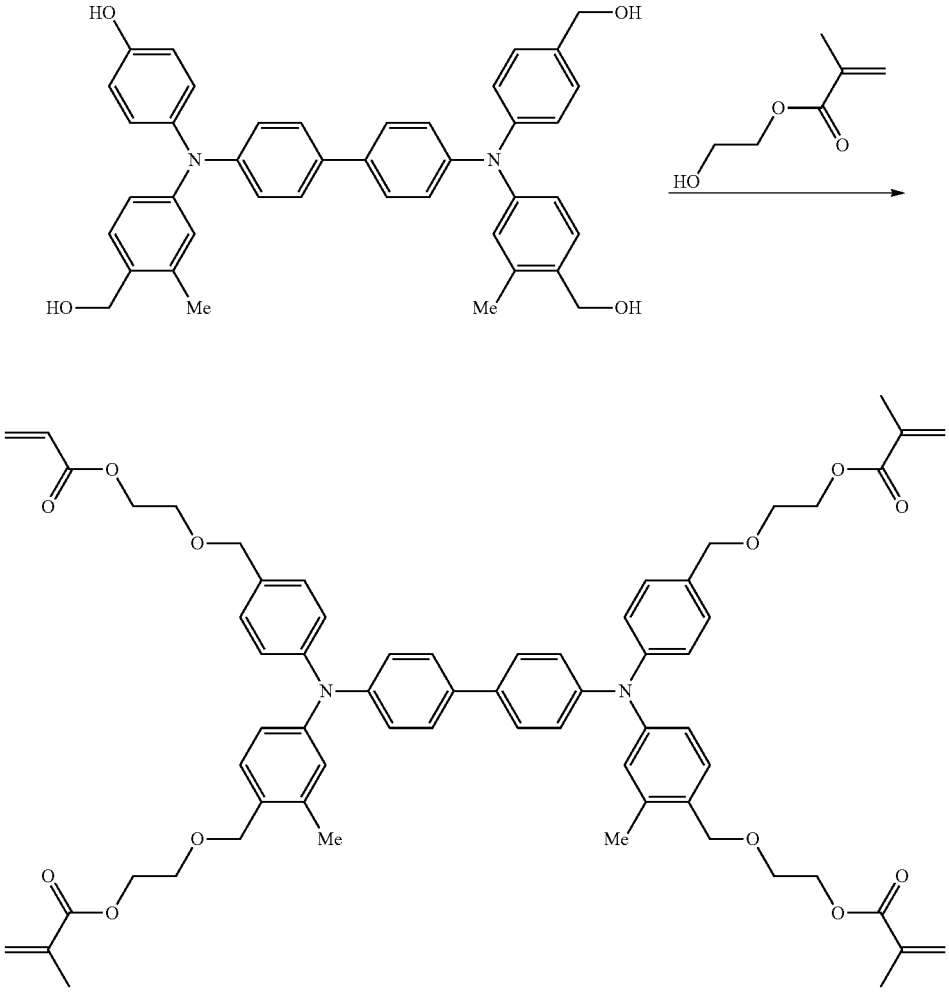
Compound iv-4
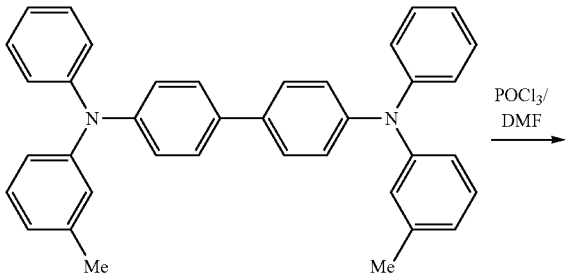
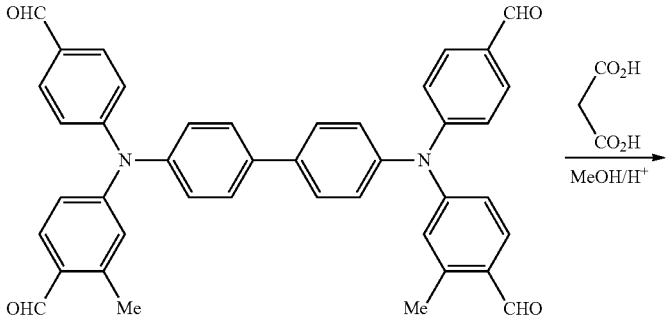

-continued
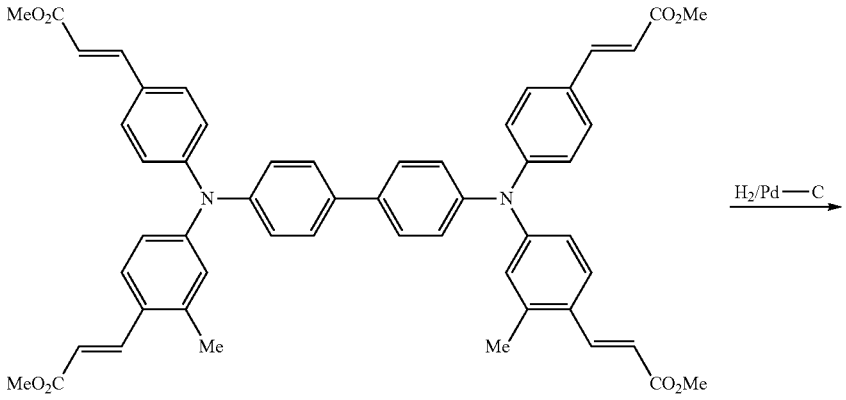
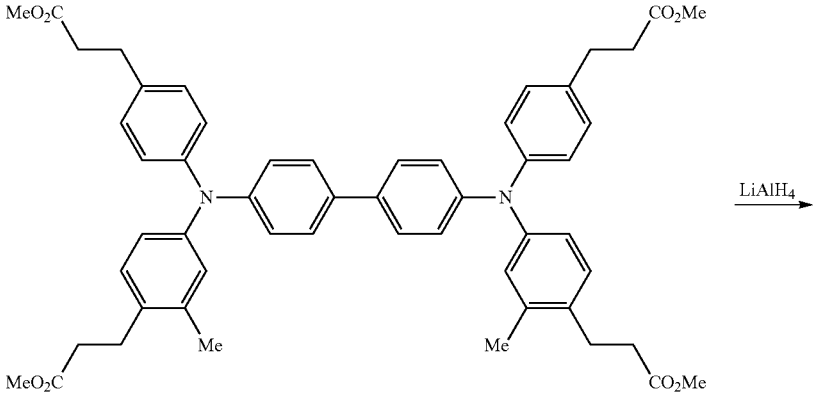
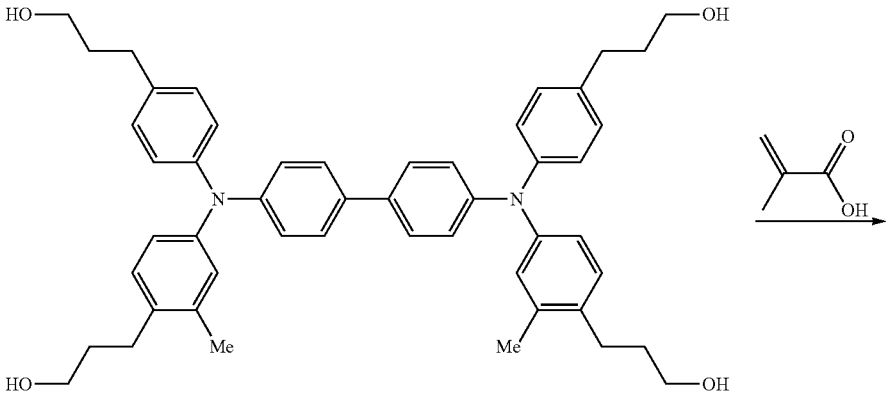

-continued

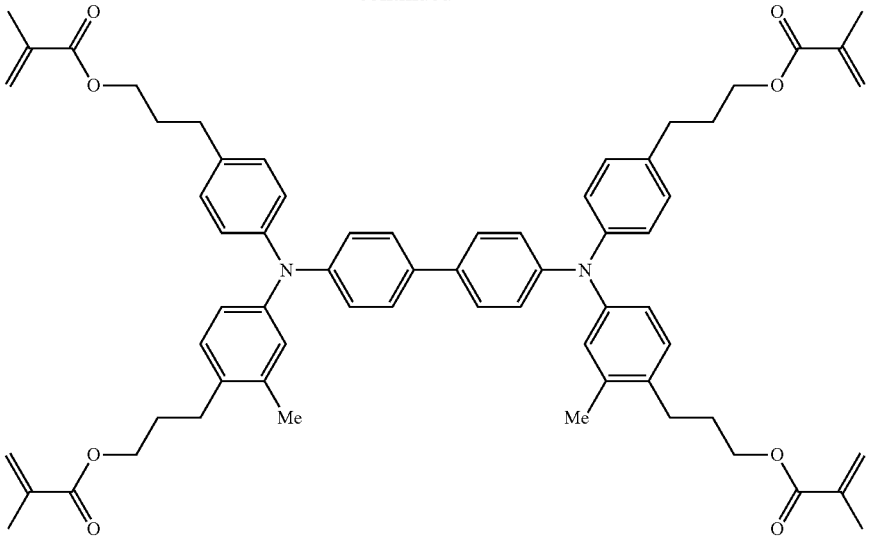

Compound iv-17

Other compounds represented by Formula (I) can be synthesized through, for example, the same synthetic pathway as the compounds iv-4 and iv-17.

In the present exemplary embodiment, as described above, the compound represented by Formula (I) preferably has an n value of 2 or more, and more preferably 4 or more.

The compound represented by Formula (I) may be a combination of a compound having an n value of 4 or more and a compound having an n value of 1 to 3. The combination enables to control strength of the cured film without deterioration of charge transport capability.

When the compound represented by Formula (I) is a combination of a compound having an n value of 4 or more and a compound having an n value of 1 to 3, the content of the compound having an n value of 4 or more is preferably 5% by weight or more, and more preferably 20% by weight or more with respect to the total content of the compound represented by Formula (I).

Specific examples of the charge transporting material having a chain polymerizable functional group other than the compound represented by Formula (I) are shown below. However, the material is not limited to these examples.

| No. | |
|---|---|
| i-15 | 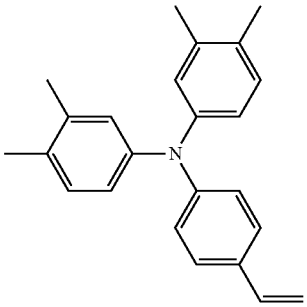 |
| i-16 | 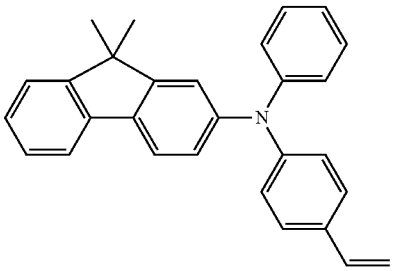 |

-continued
| No. | |
|---|---|
| i-17 | 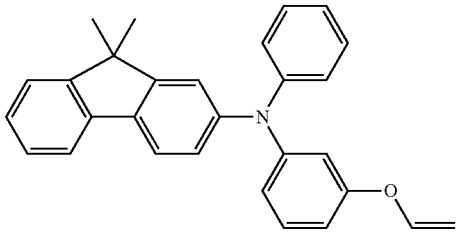 |
| i-18 | 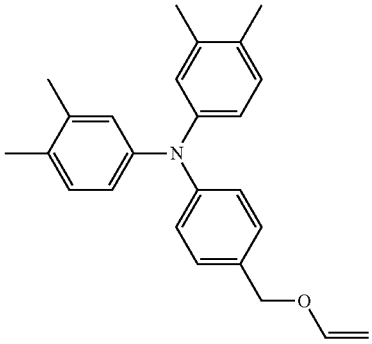 |
| i-19 | 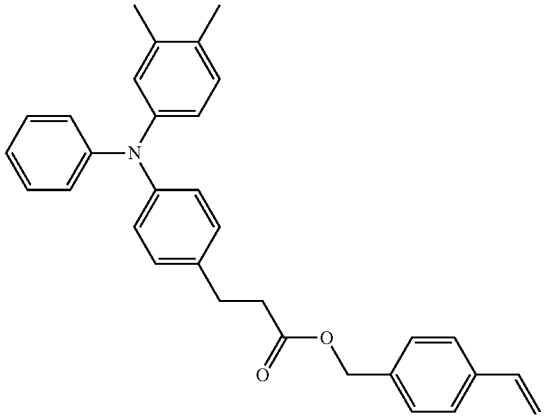 |
| i-20 | 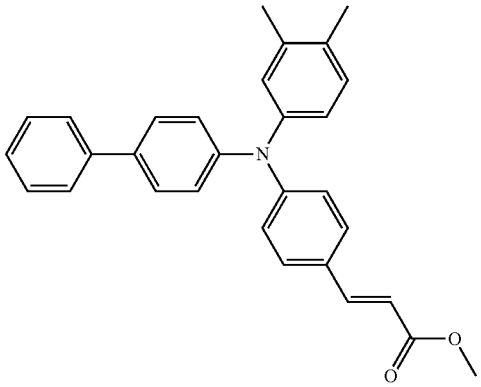 |

-continued
| No. | |
|---|---|
| i-21 | 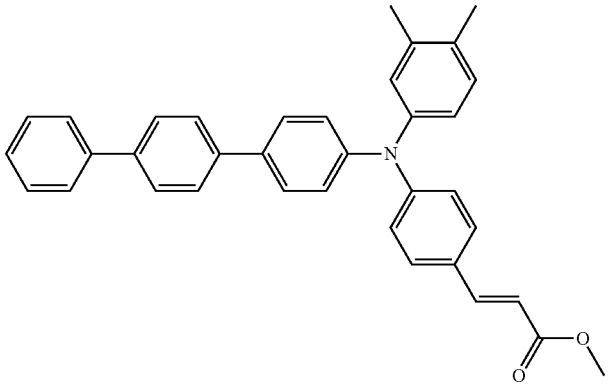 |
| i-22 | 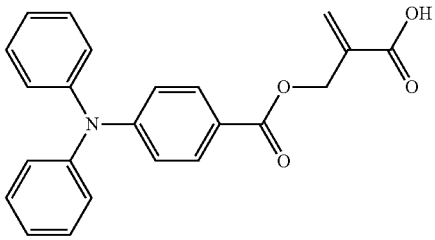 |
| i-23 | 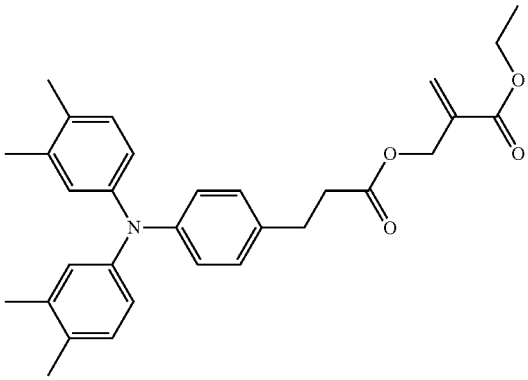 |
| i-24 | 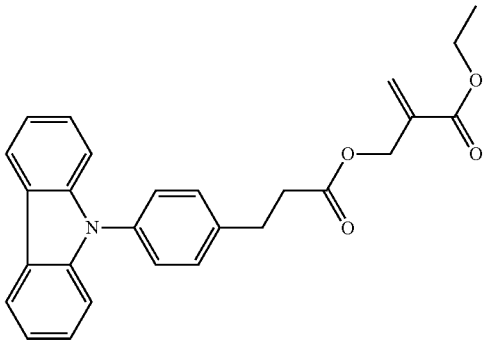 |

-continued
| No. | |
|---|---|
| i-25 | 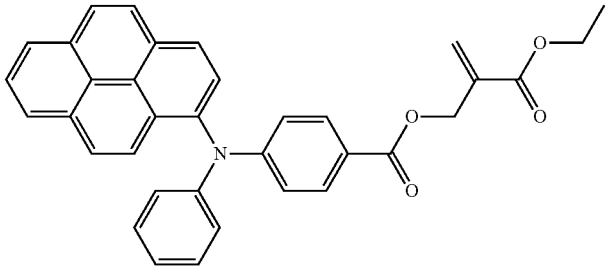 |
| ii-27 | 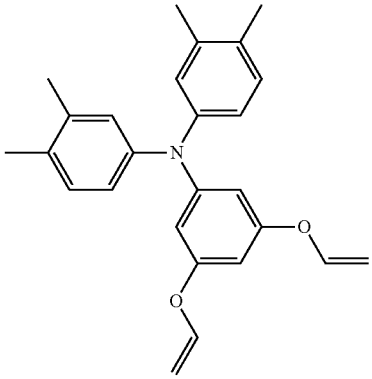 |
| ii-28 | 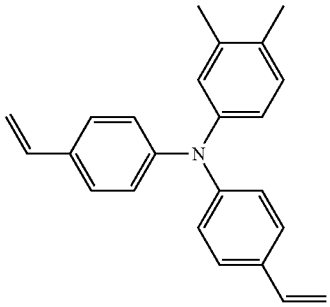 |
| ii-29 | 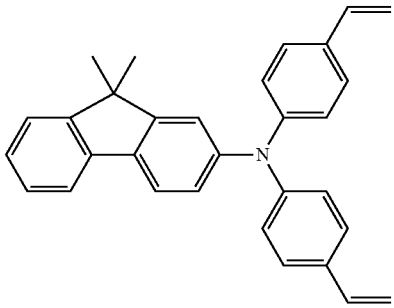 |
| ii-30 | 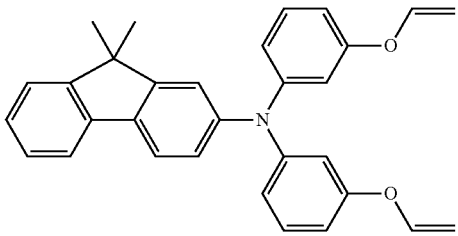 |

-continued
| No. |
| --- |
| ii-31 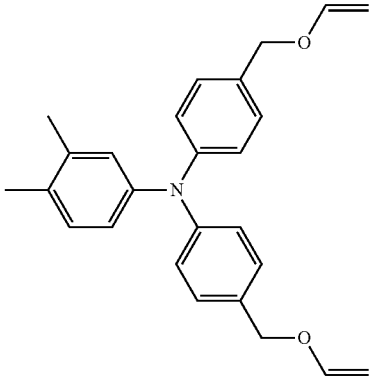 |
| ii-32 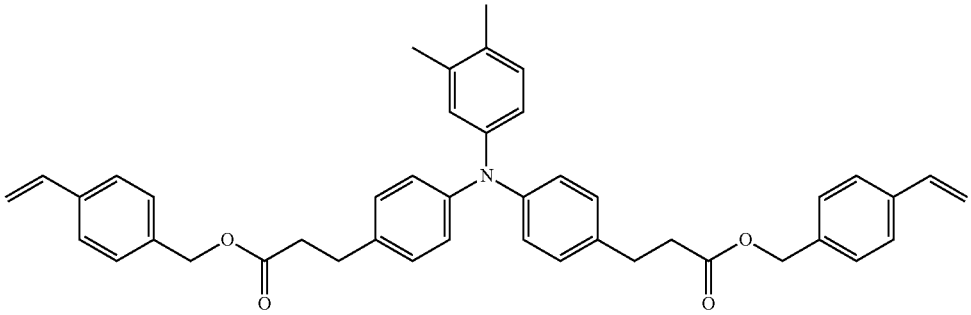 |
| ii-33 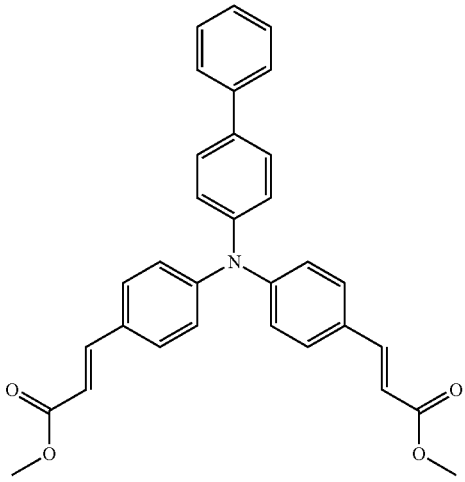 |

-continued
No.
ii-34
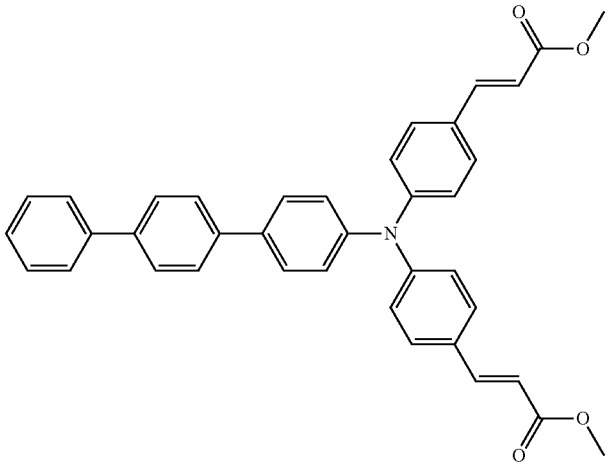
ii-35
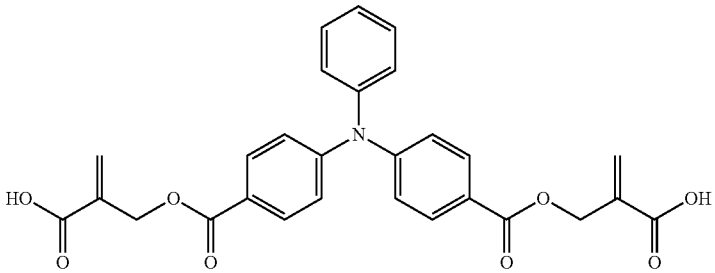
ii-36
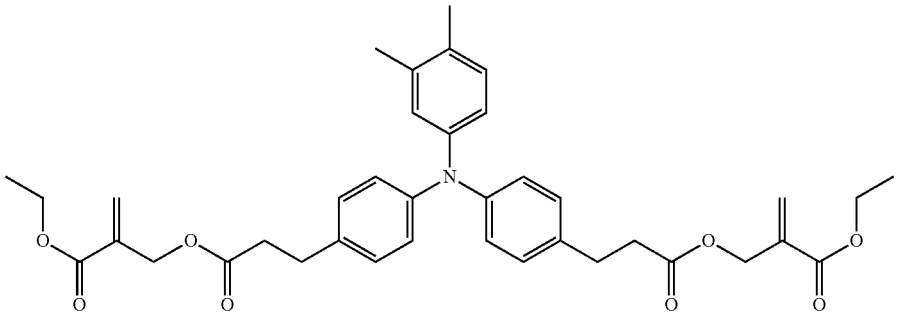
ii-37
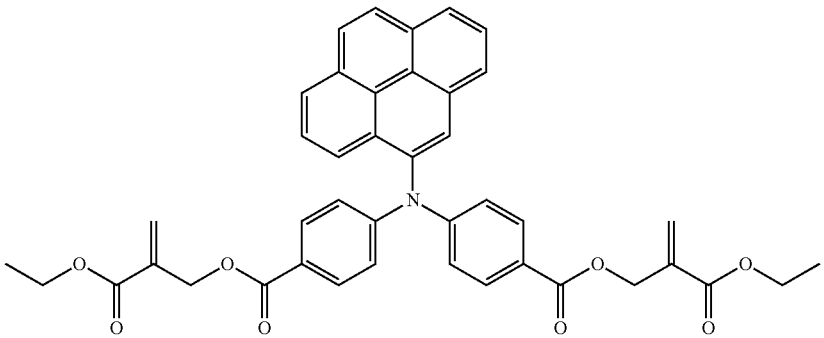

-continued

| No. |
| --- |
| ii-38 |
| ii-39 |
| ii-40 |
| ii-41 |

-continued
No.
ii-42
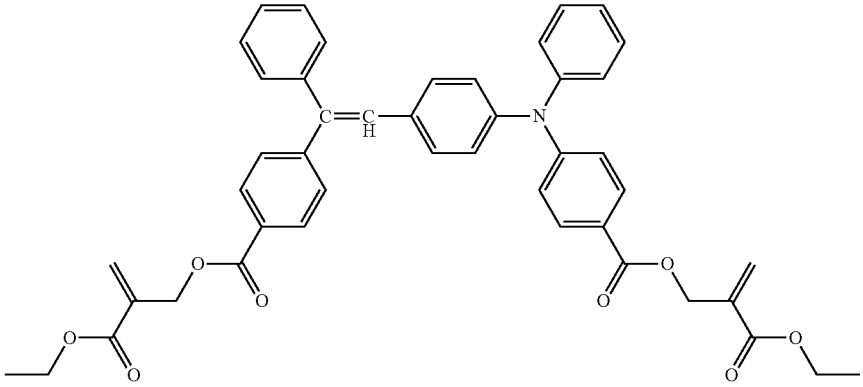
ii-43
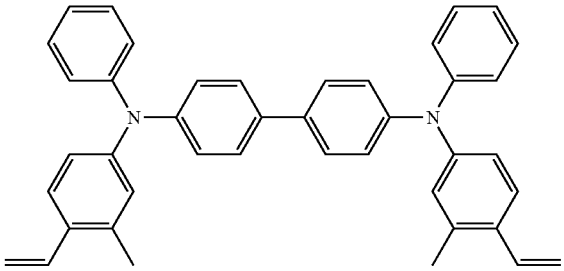
ii-44
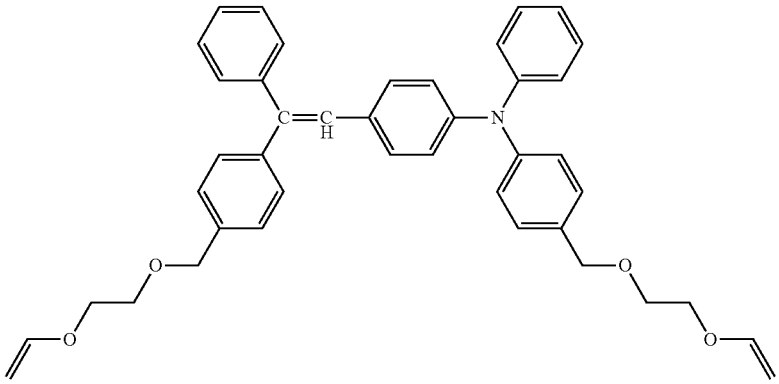
ii-45
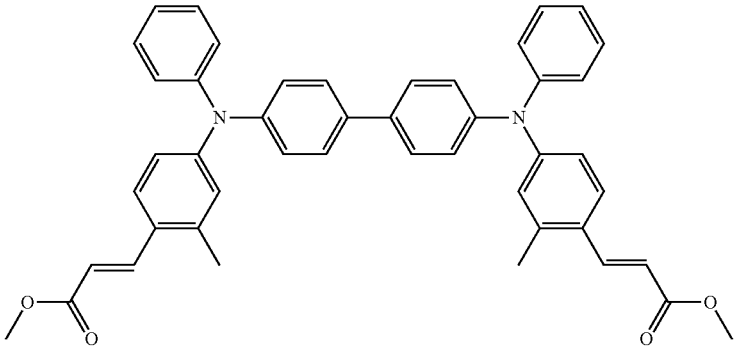

-continued
| No. | |
|---|---|
| ii-46 | 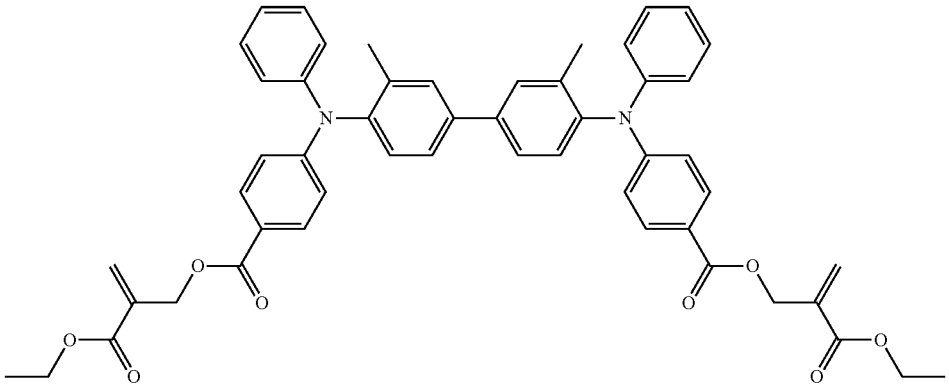 |
| ii-47 | 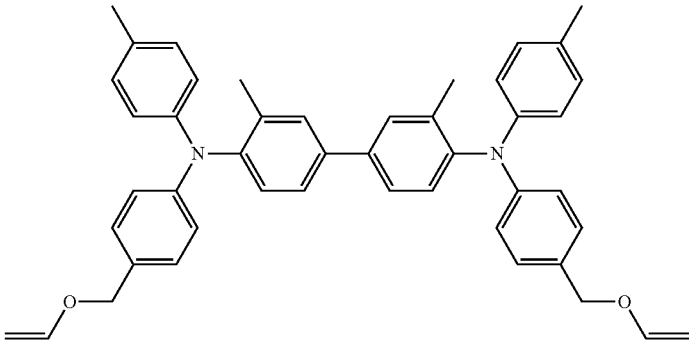 |
| ii-48 | 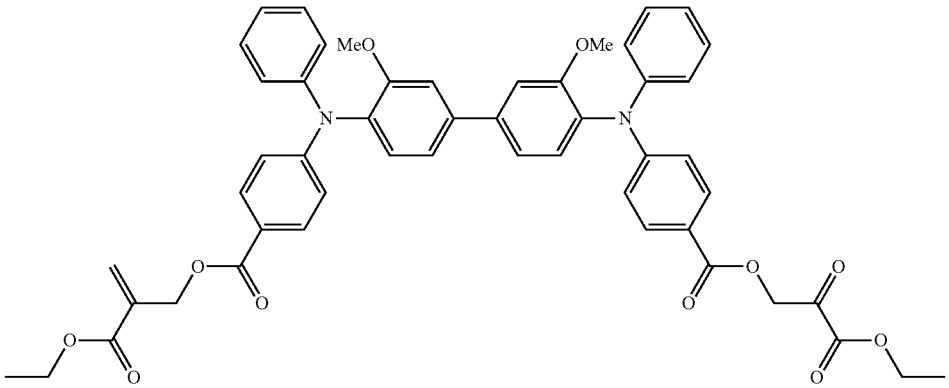 |
| ii-49 | 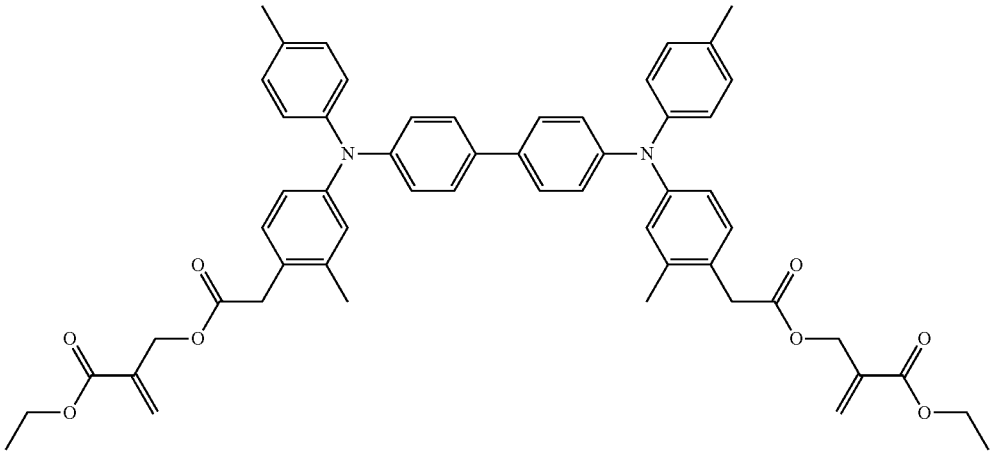 |

-continued
| No. | |
|---|---|
| ii-50 | 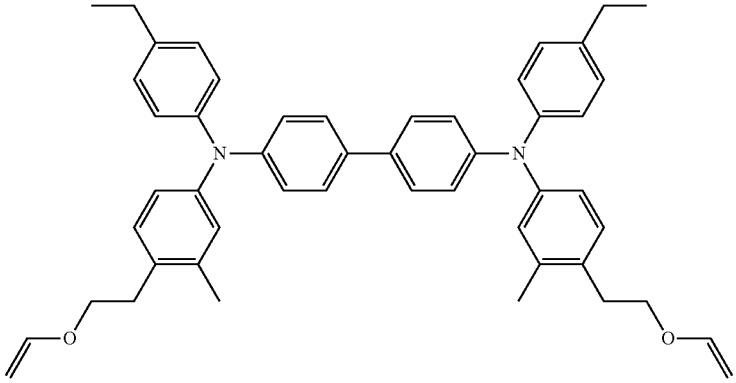 |
| ii-51 | 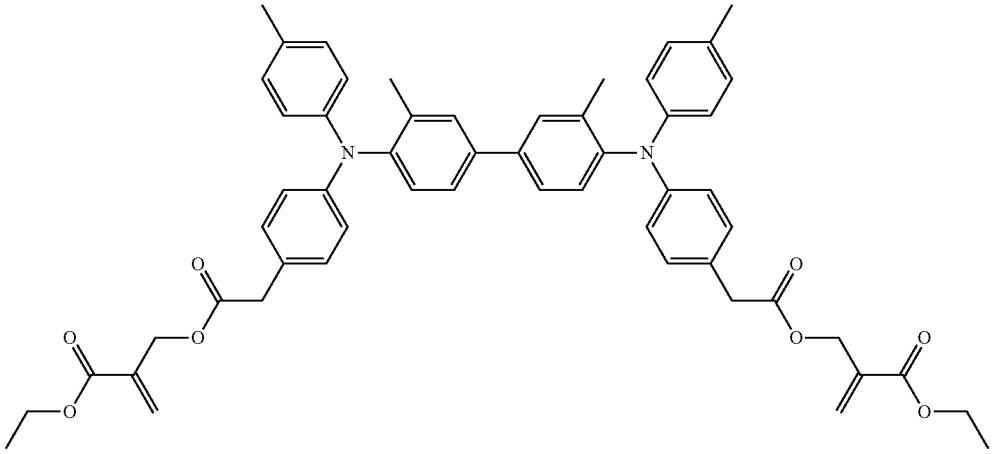 |
| ii-52 | 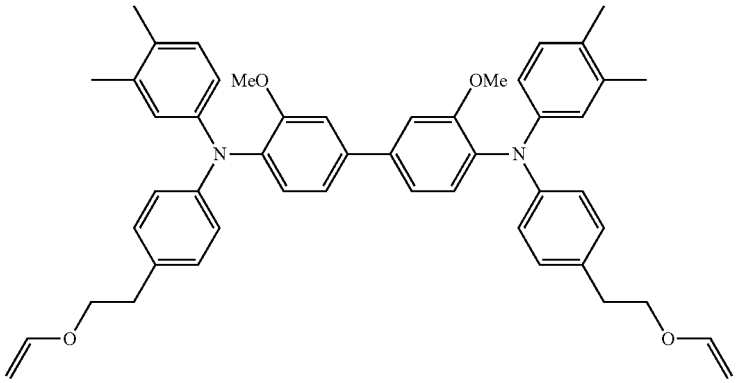 |

-continued
| No. | |
|---|---|
| ii-53 | 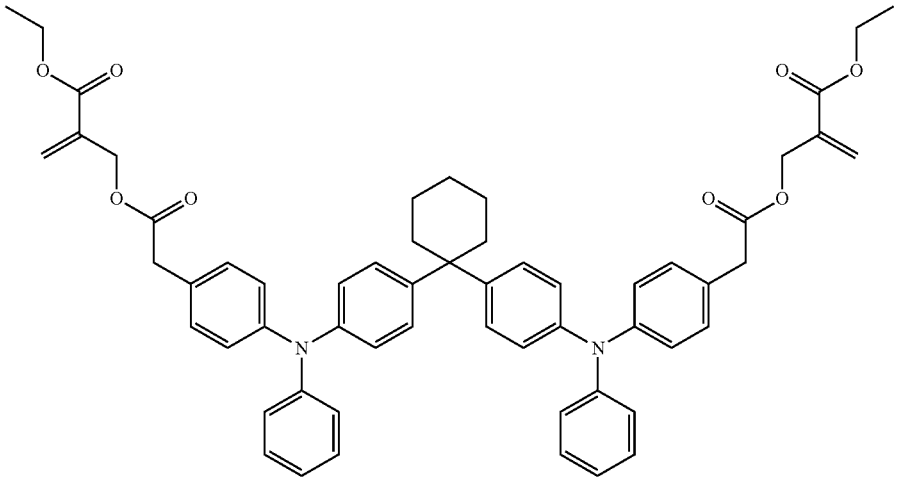 |
| ii-54 | 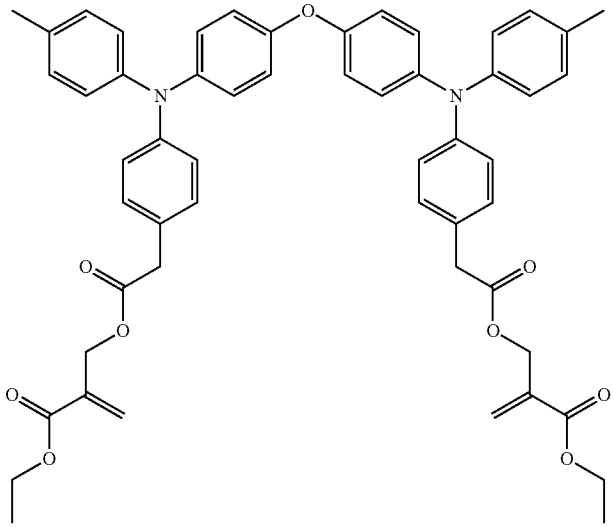 |
| ii-55 | 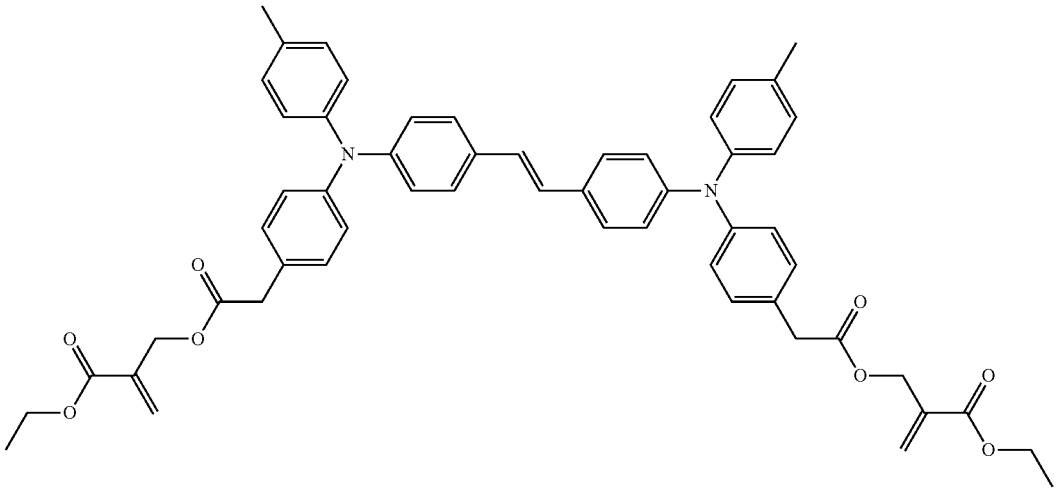 |

-continued
| No. | |
|---|---|
| ii-56 | 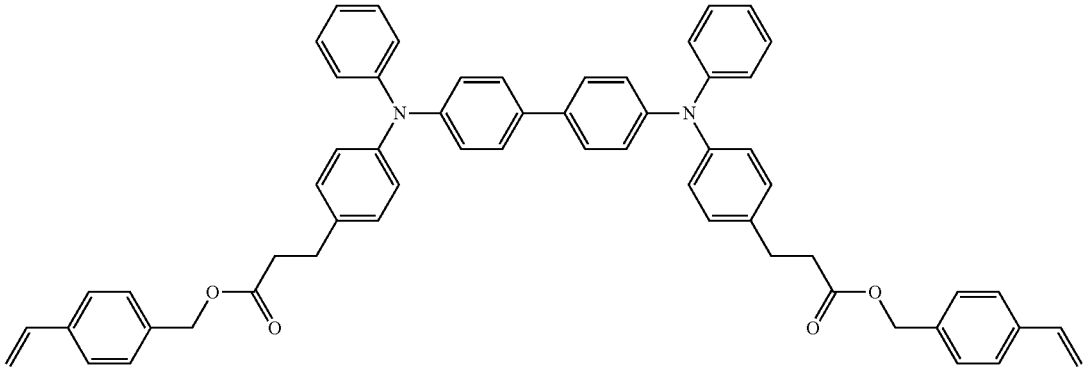 |
| iii-12 | 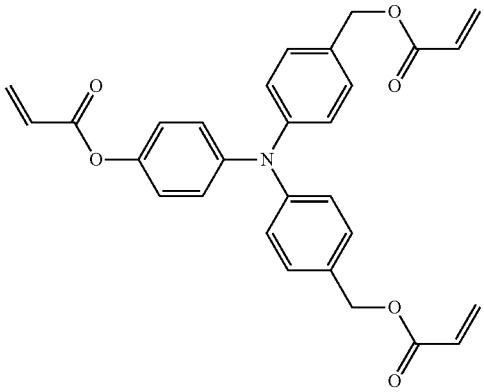 |
| iii-13 | 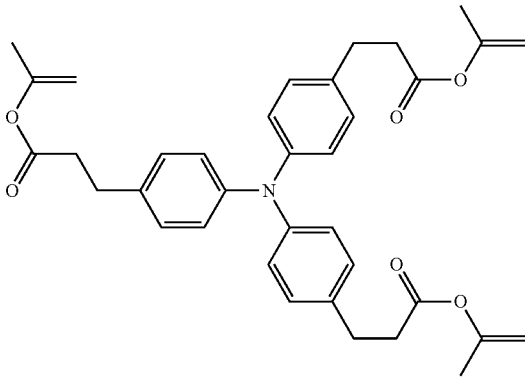 |
| iii-14 | 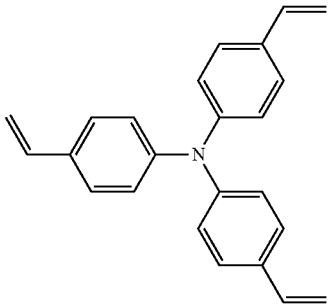 |

-continued
| No. | |
|---|---|
| iii-15 | 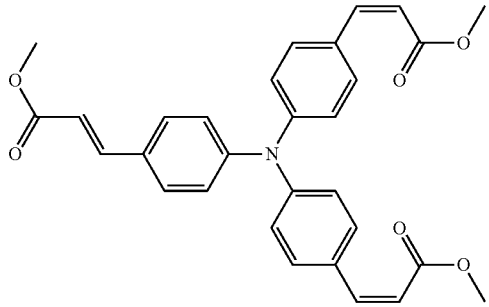 |
| iii-16 | 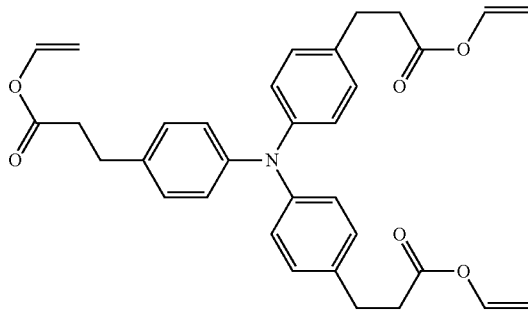 |
| iii-17 | 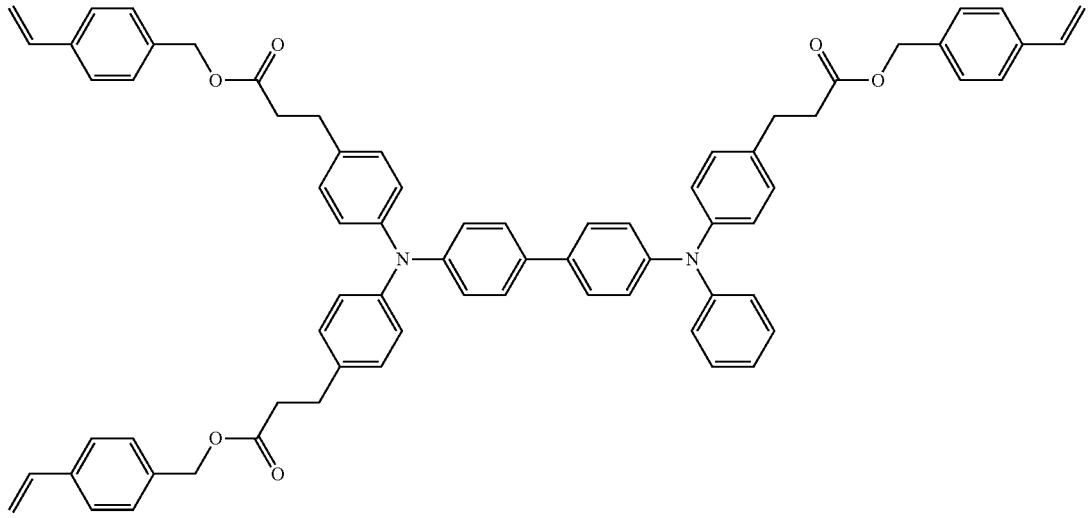 |

-continued
| No. |
| --- |
| iii-18 |
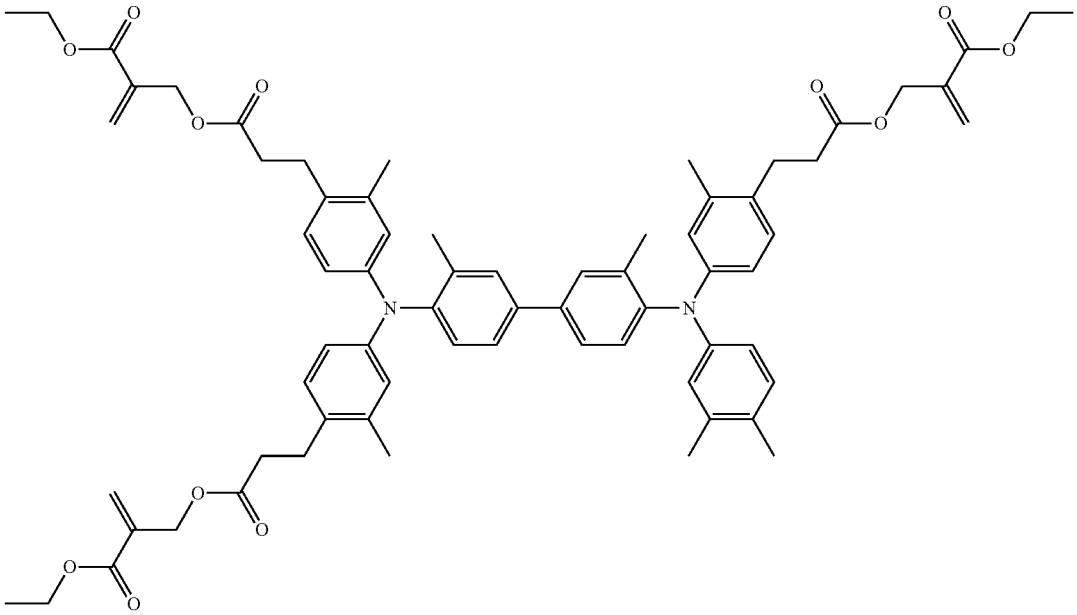
iii-19
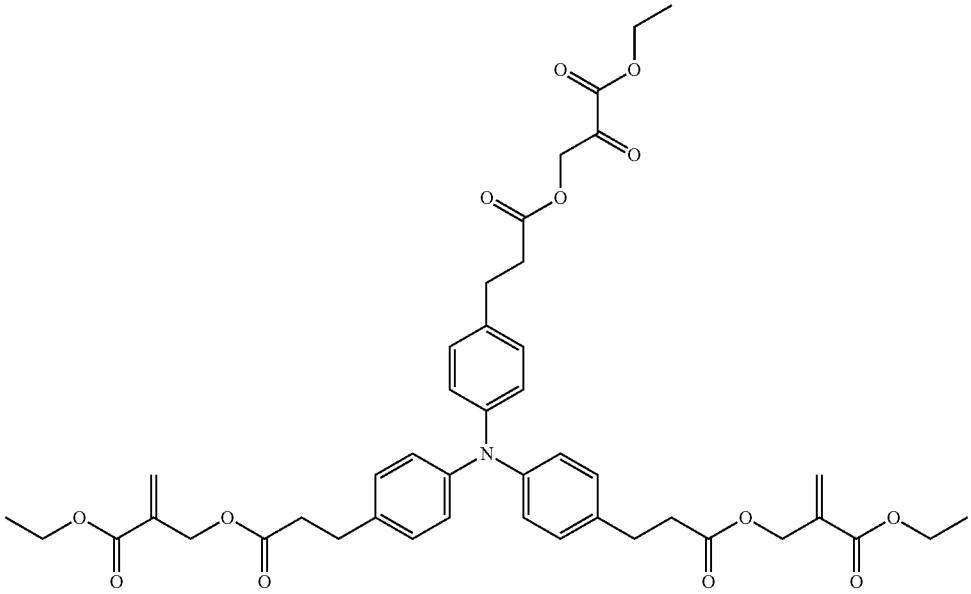
iv-19
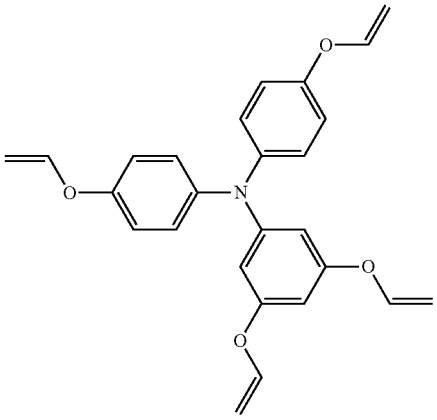

-continued
| No. |
|---|
iv-20
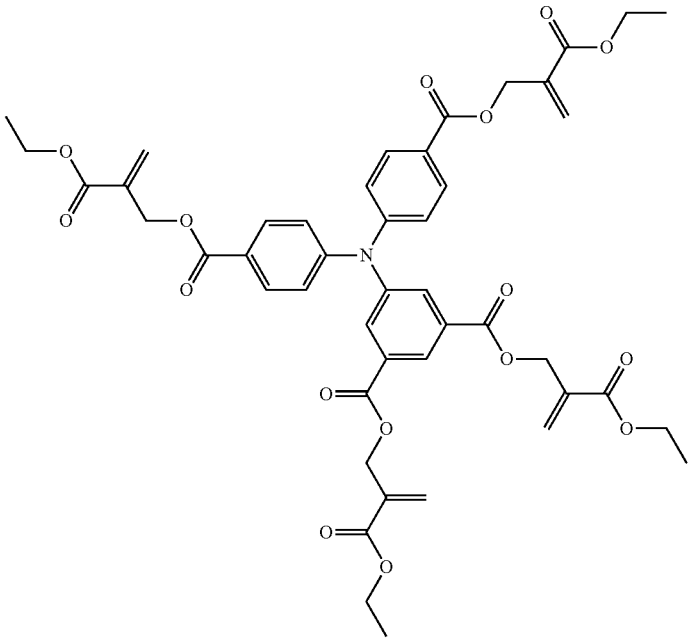
iv-21
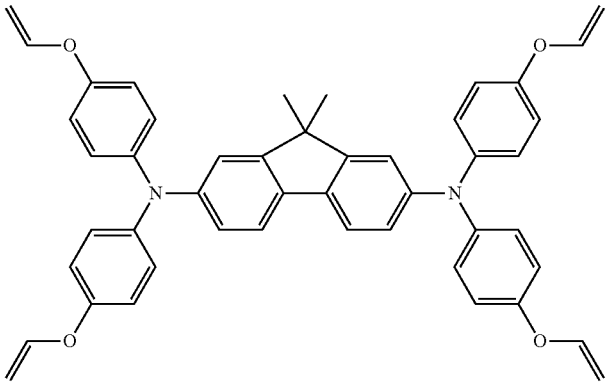

-continued
| No. | |
|---|---|
| iv-22 | 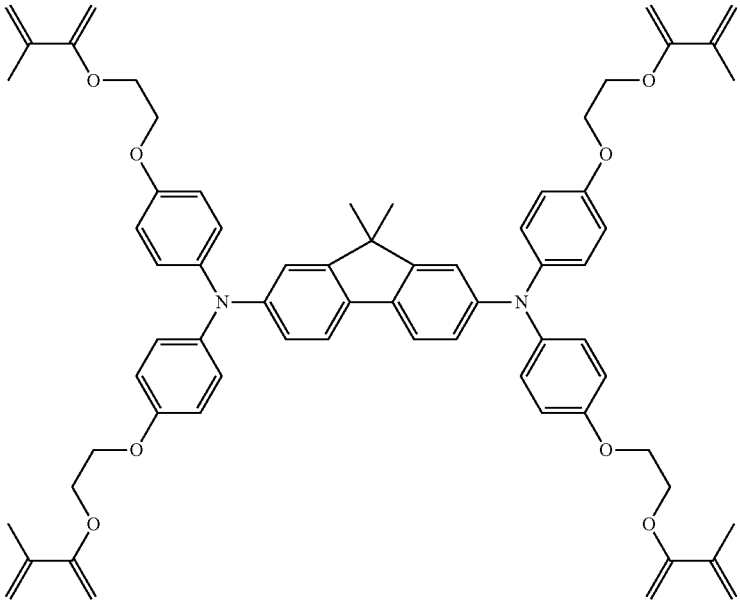 |
| iv-23 | 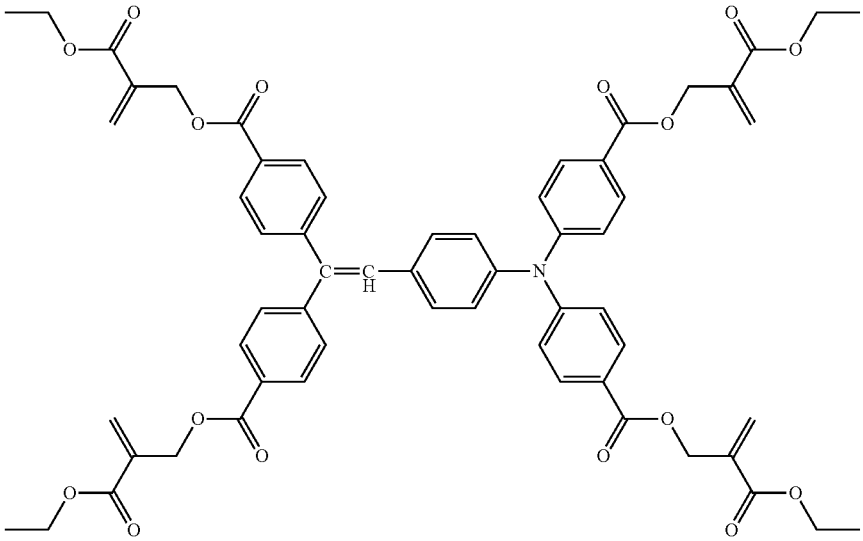 |

-continued
No.
iv-24
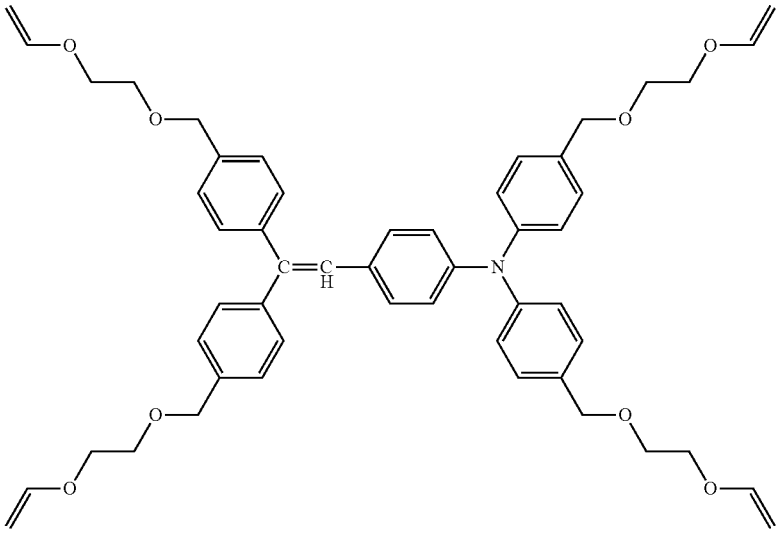
iv-25
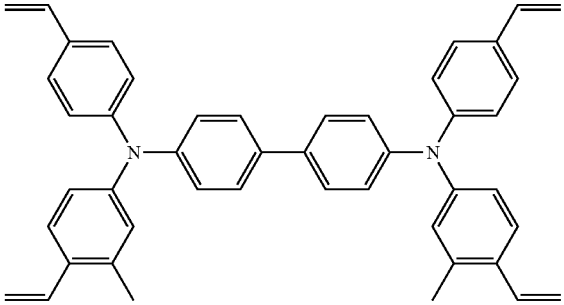
iv-26
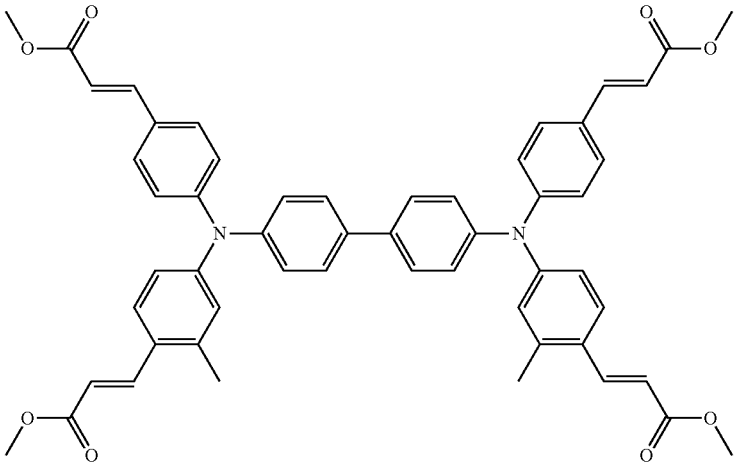

-continued
No.
iv-27
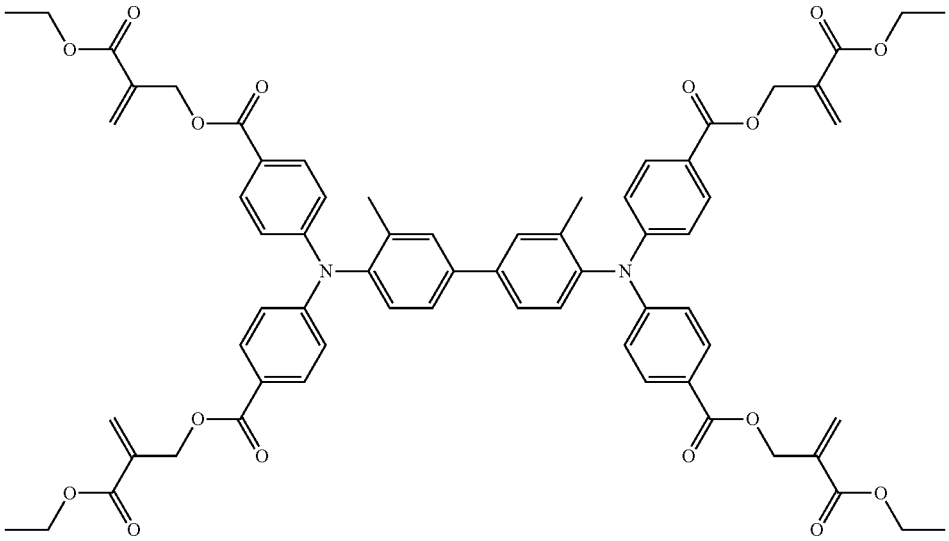
iv-28
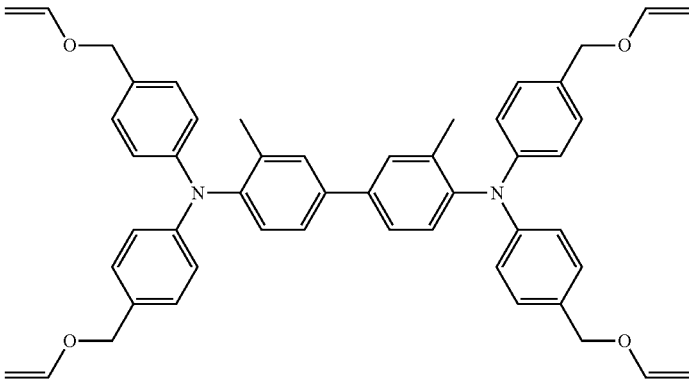
iv-29
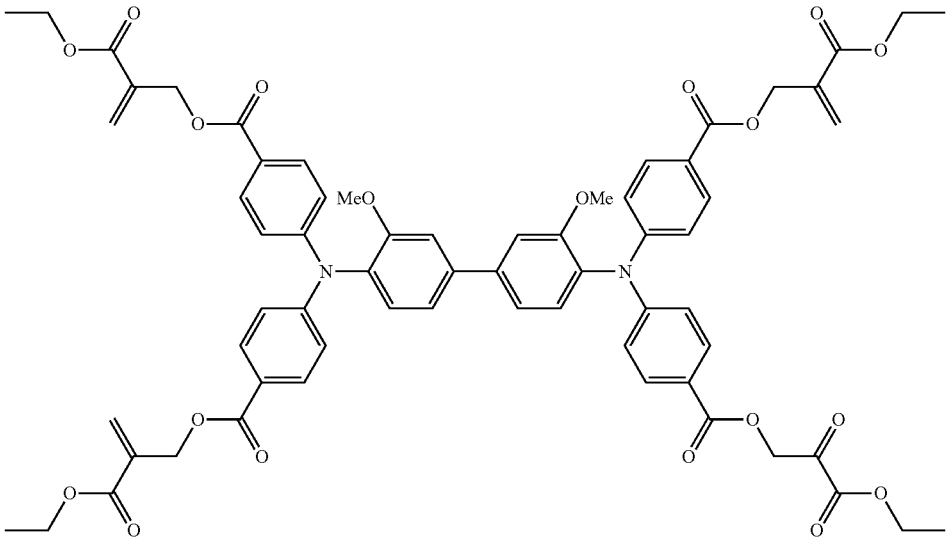

-continued
| No. | |
|---|---|
| iv-30 | 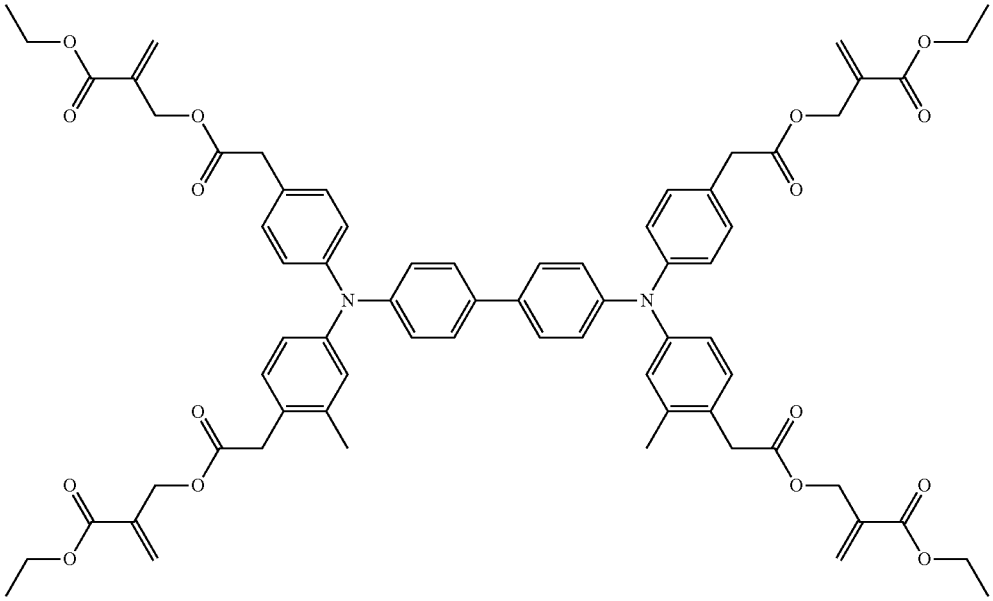 |
| iv-31 | 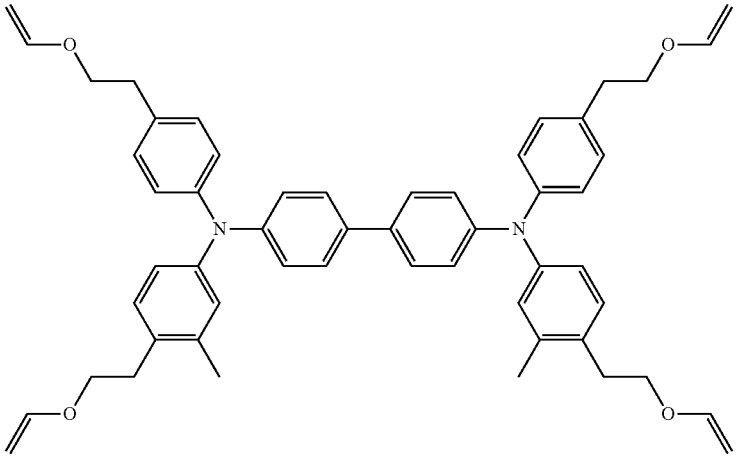 |

-continued
| No. | |
|---|---|
| iv-32 | 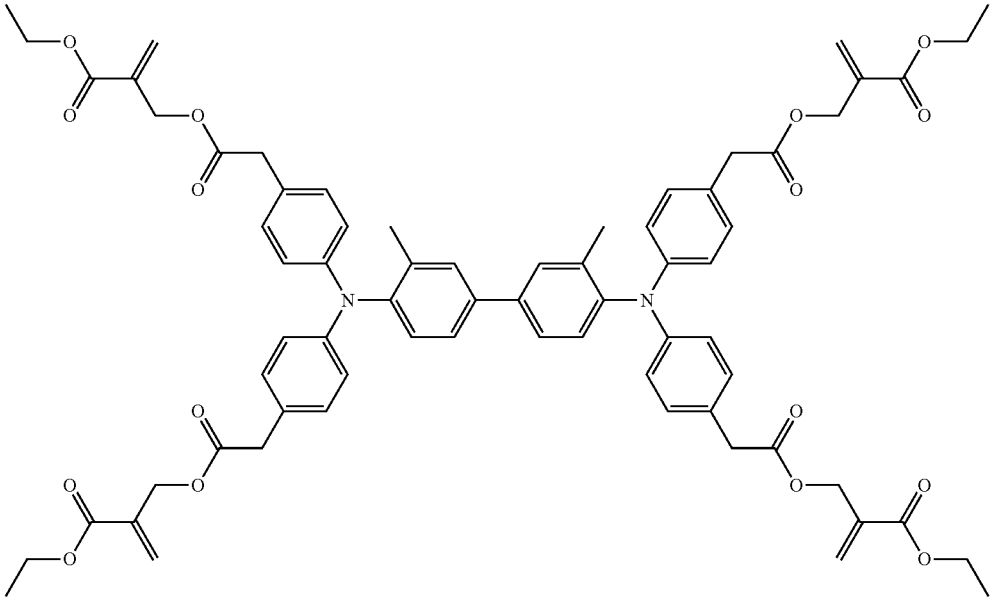 |
| iv-33 | 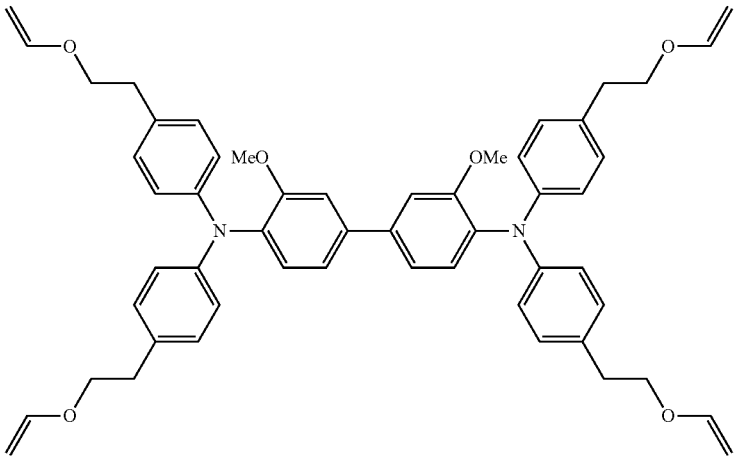 |

-continued
No.
iv-34
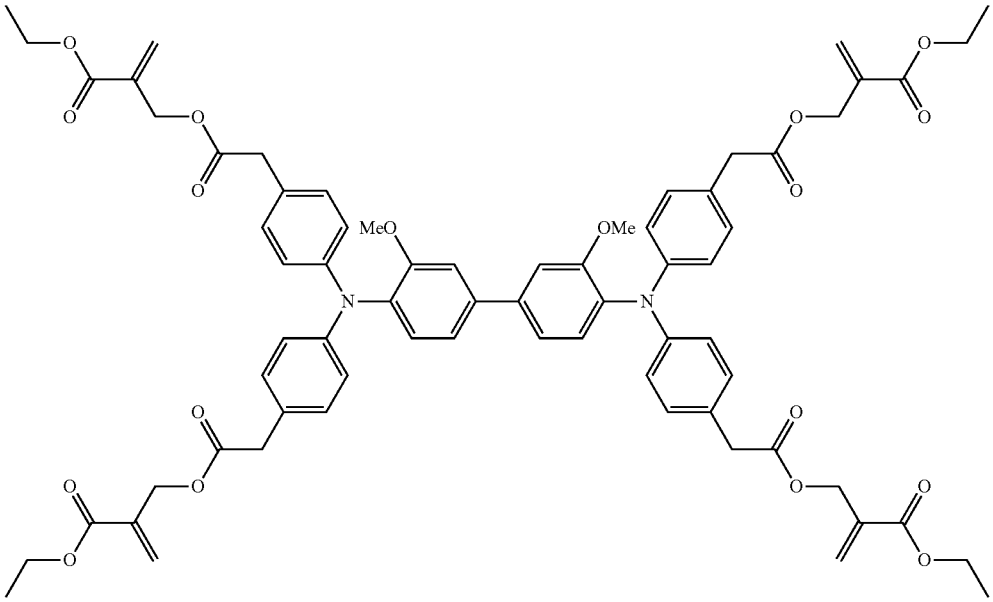
iv-35
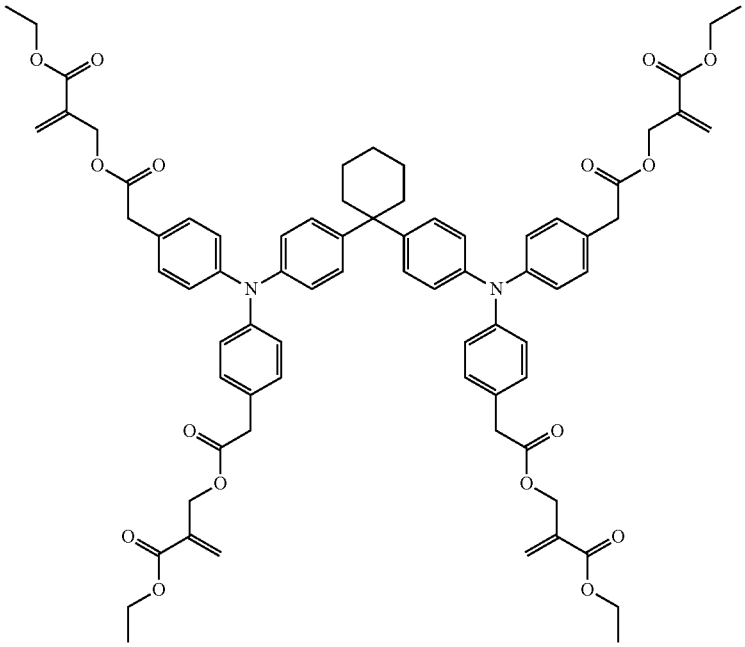

-continued
| No. | |
|---|---|
| iv-36 | 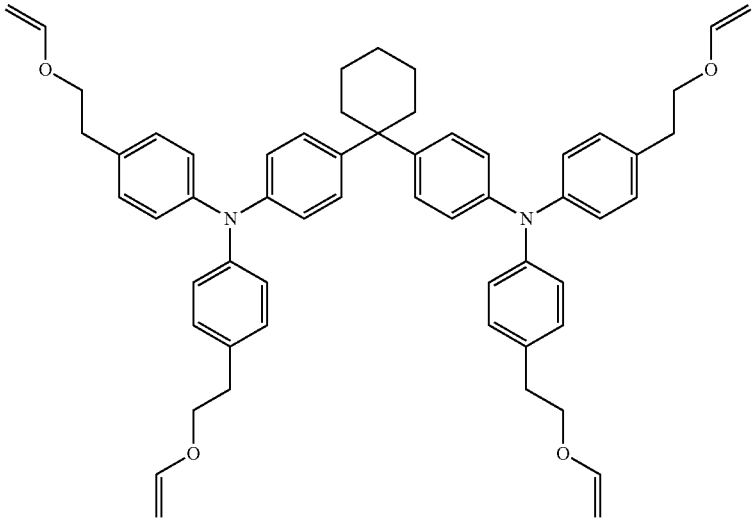 |
| iv-37 | 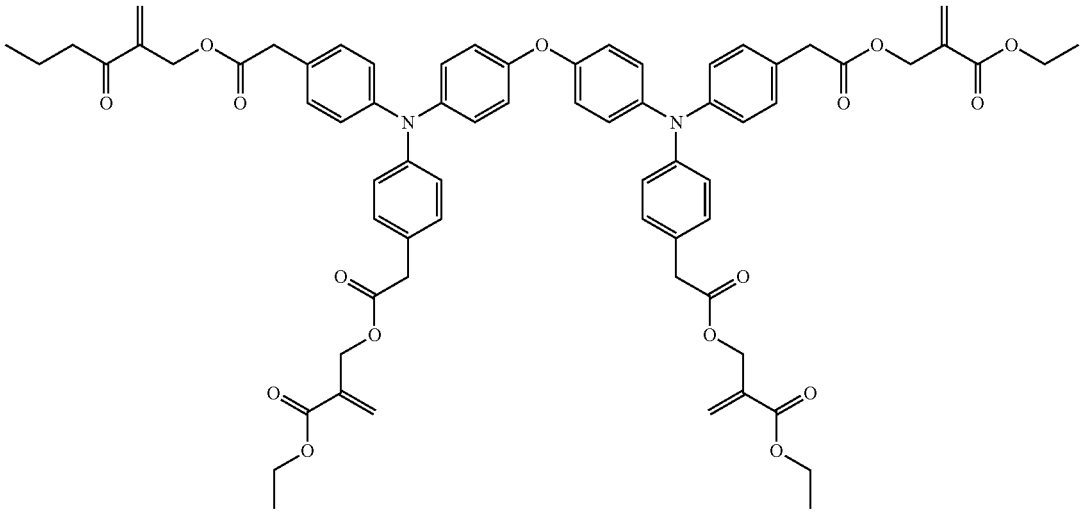 |

-continued
| No. | |
|---|---|
| iv-38 | 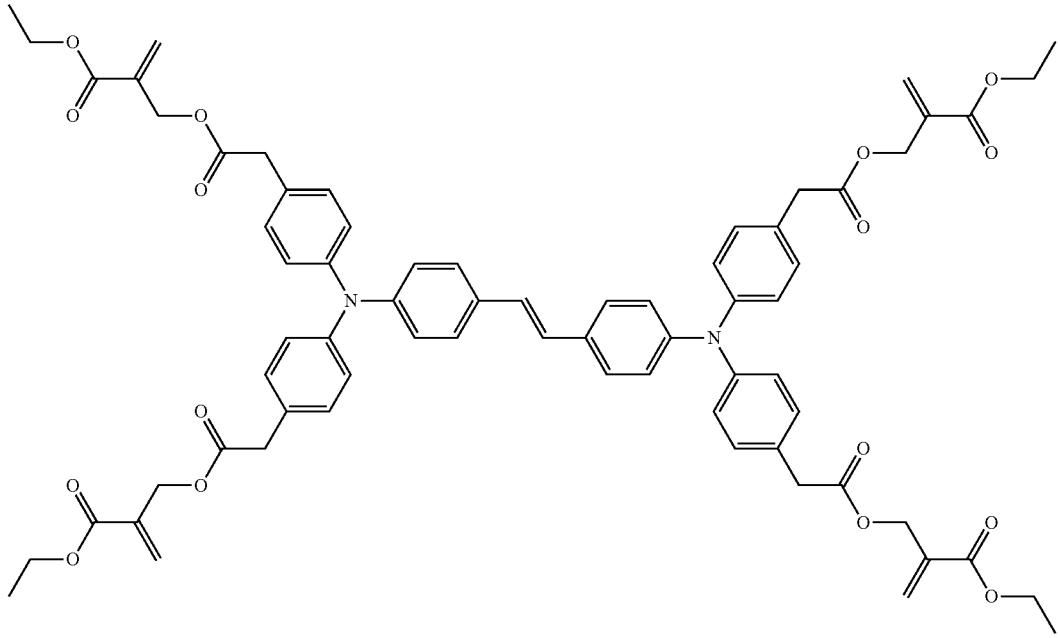 |
| iv-39 | 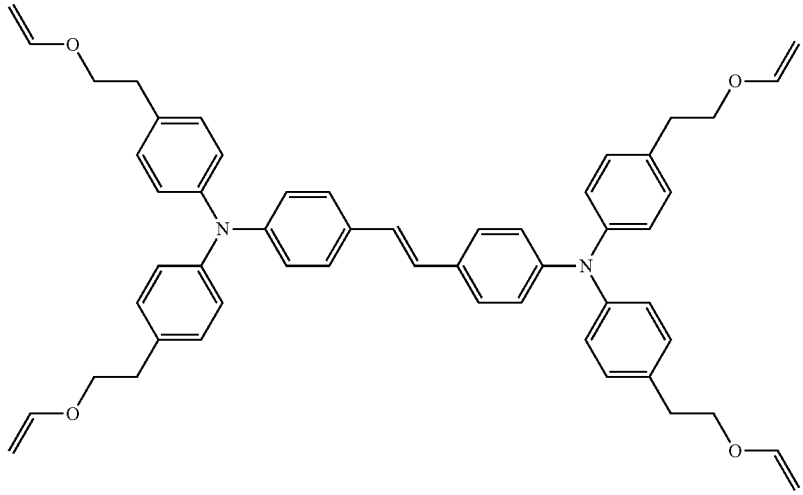 |

-continued
| No. | |
|---|---|
| iv-40 | 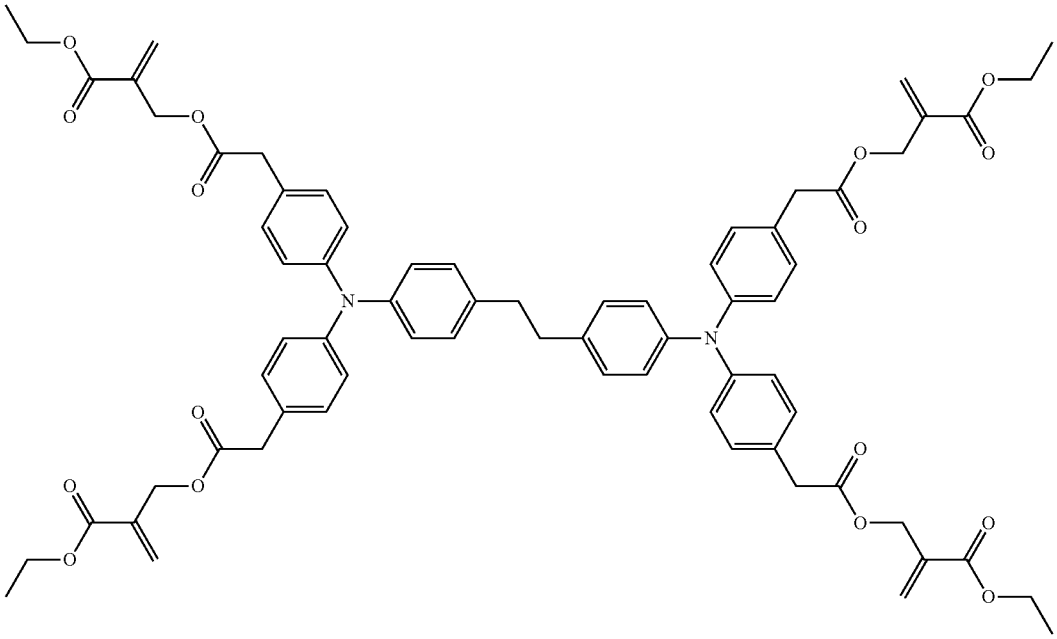 |
| iv-41 | 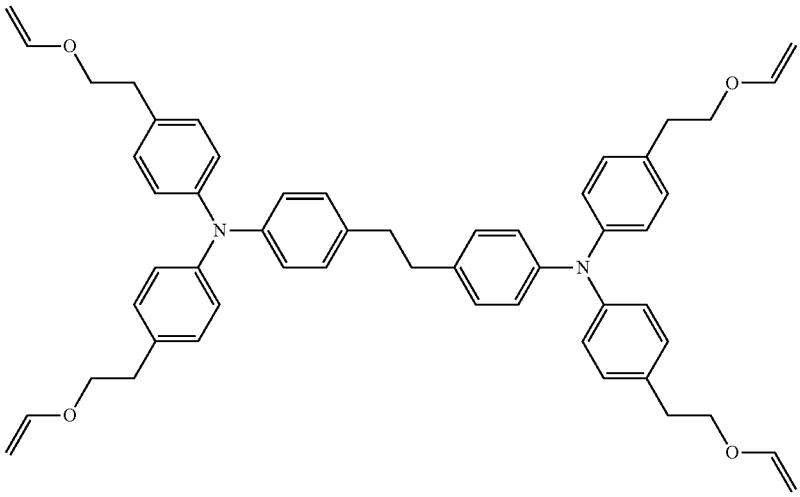 |

-continued
| No. | |
|---|---|
| iv-42 | 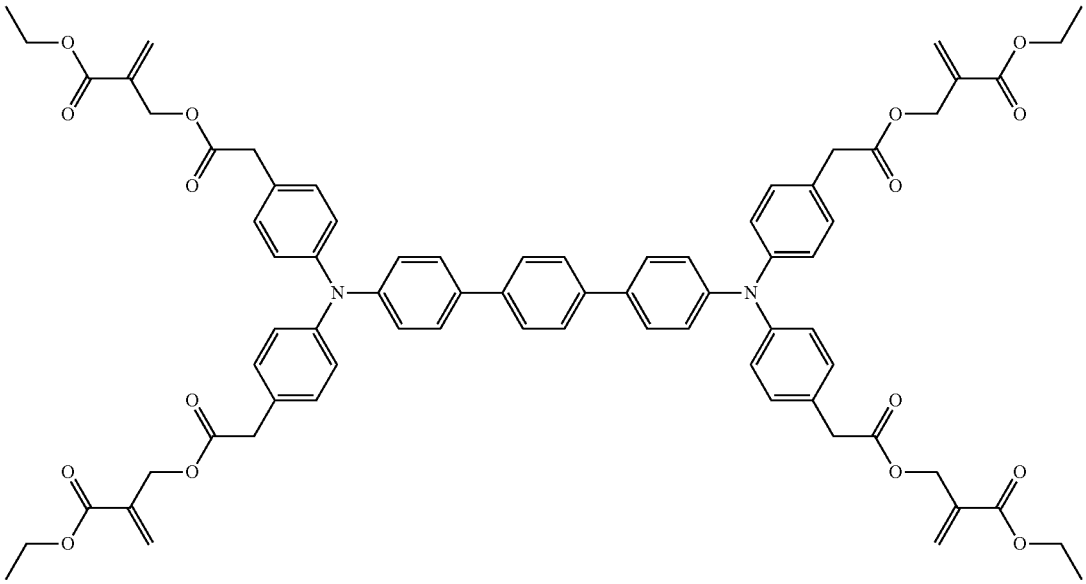 |
| iv-43 | 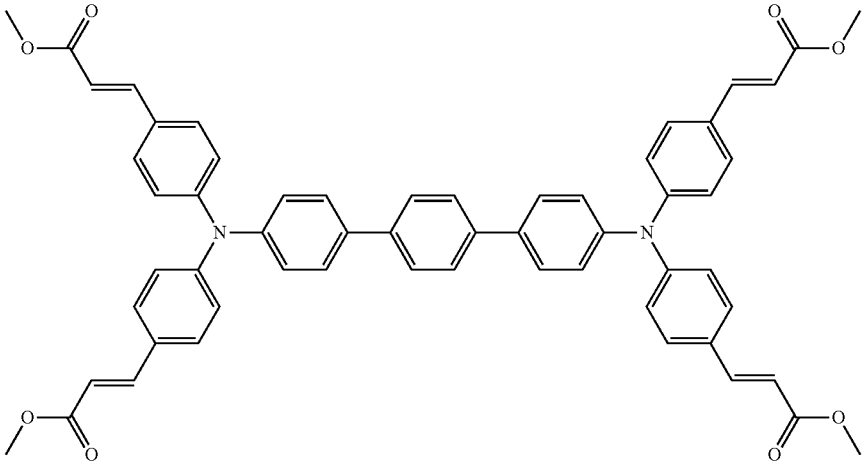 |
| iv-44 | 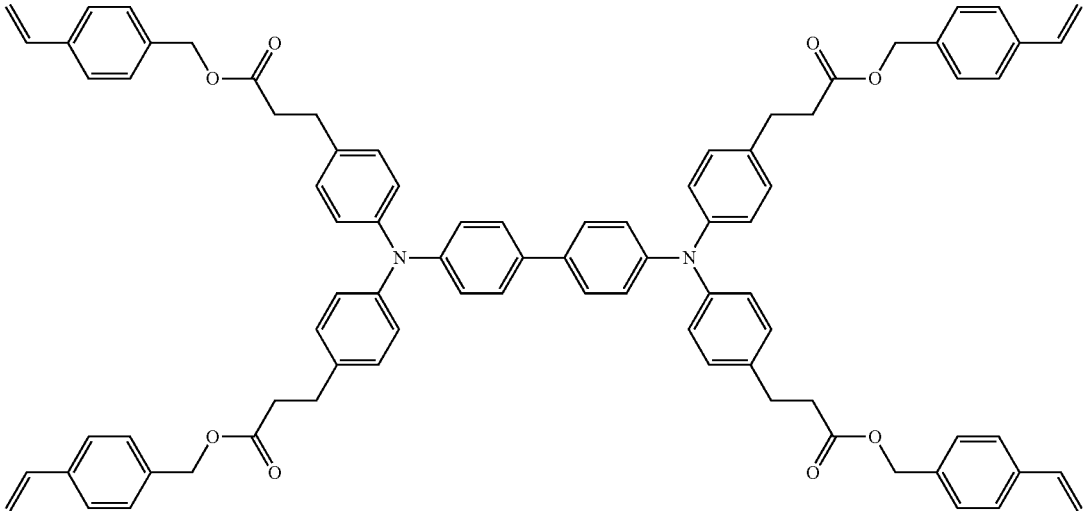 |

-continued
| No. | |
|---|---|
| iv-45 | 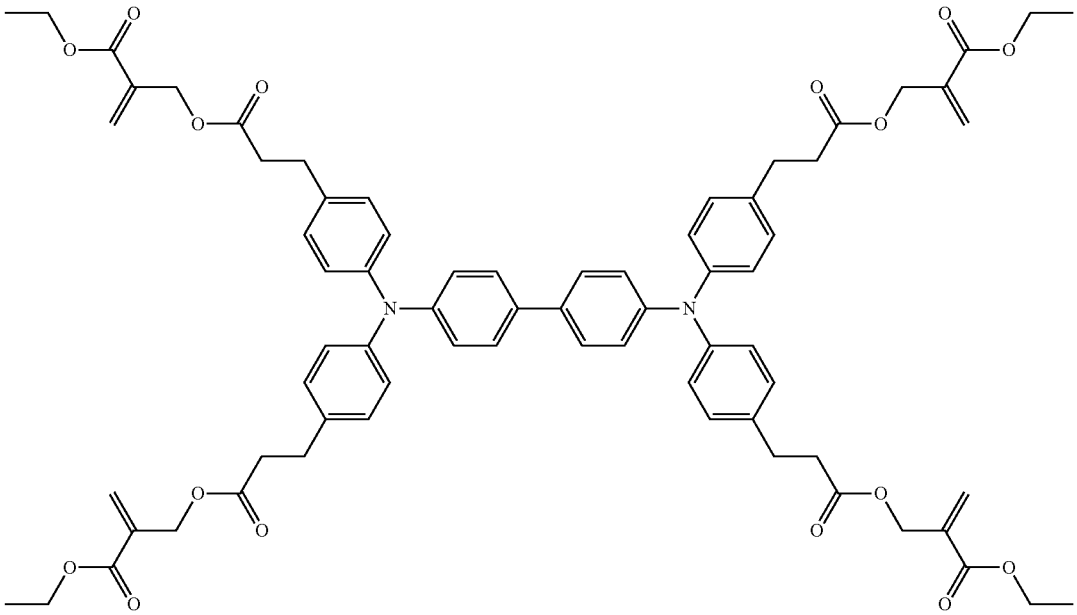 |
| iv-46 | 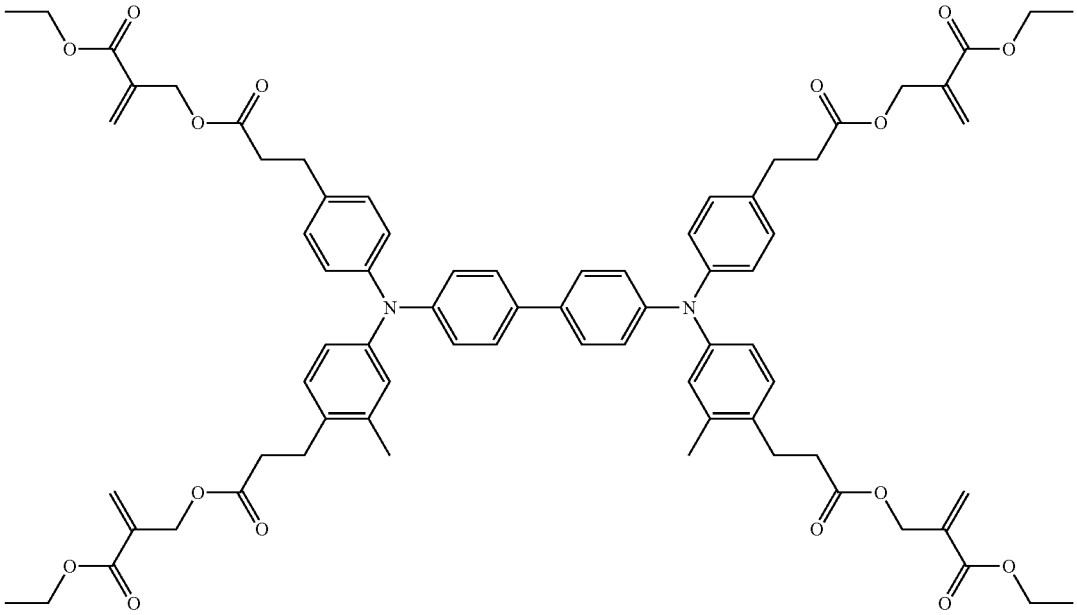 |

-continued
| No. | |
|---|---|
| iv-47 | 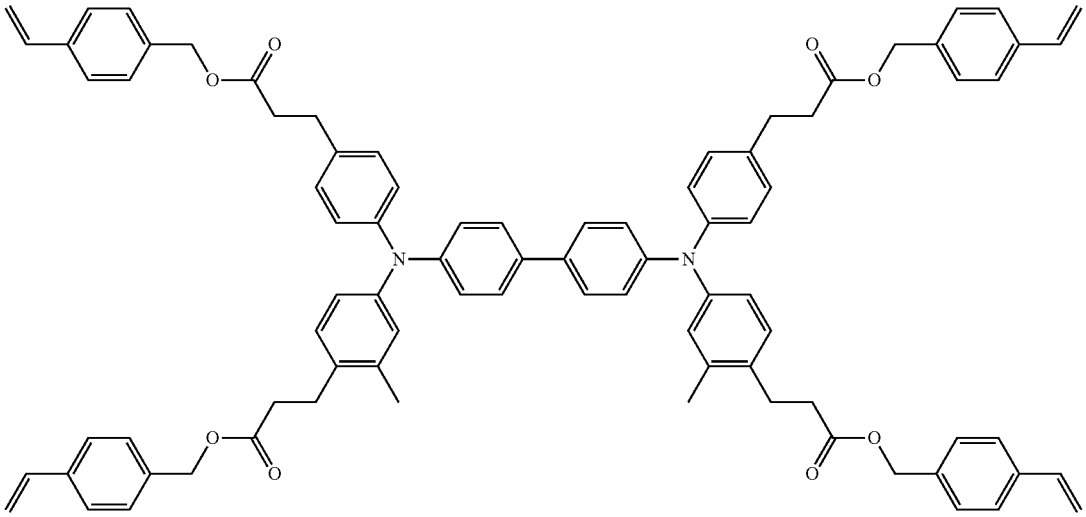 |
| iv-48 | 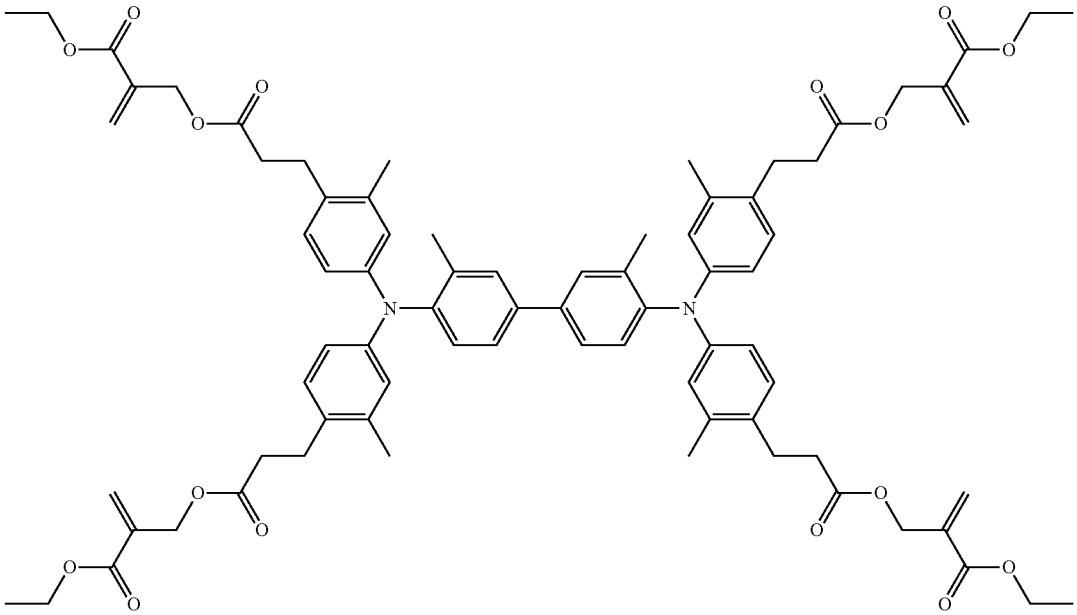 |

-continued
No.
iv-49
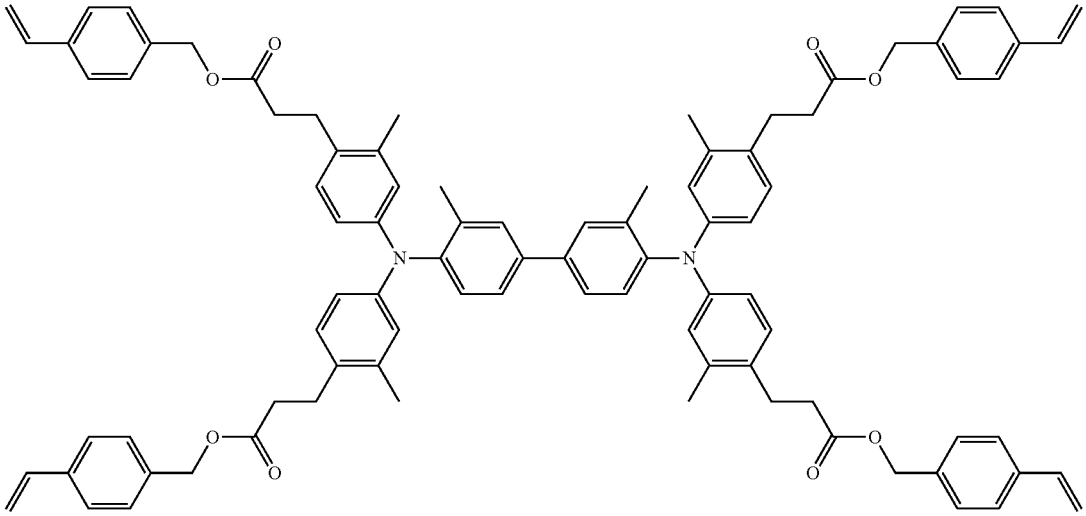
v-2
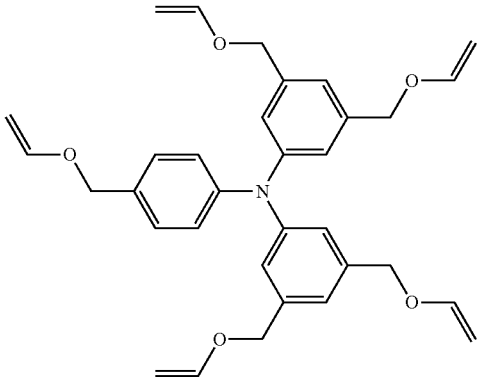
v-3
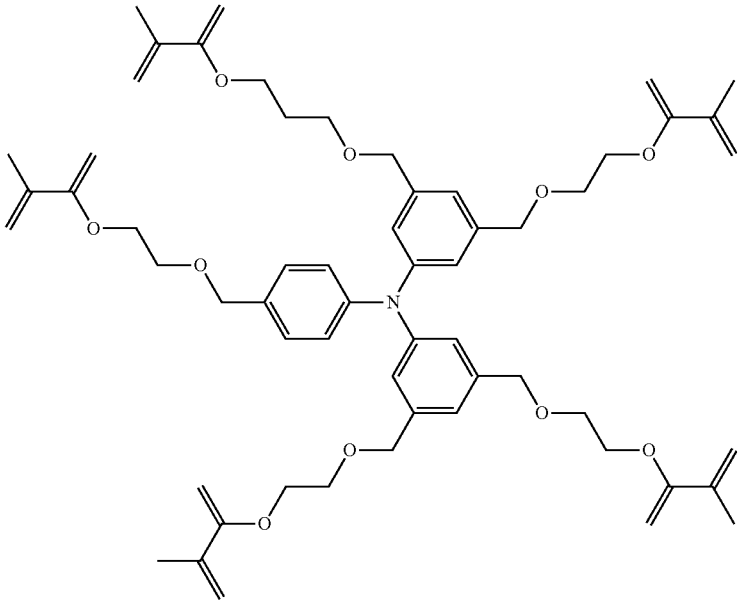

-continued
| No. | |
|---|---|
| vi-3 | 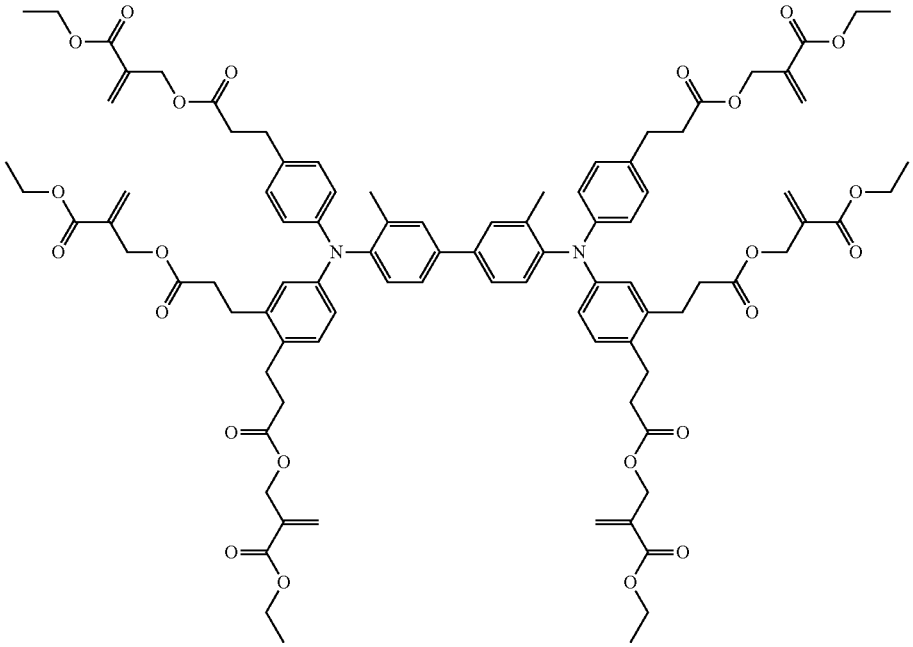 |
| vi-4 | 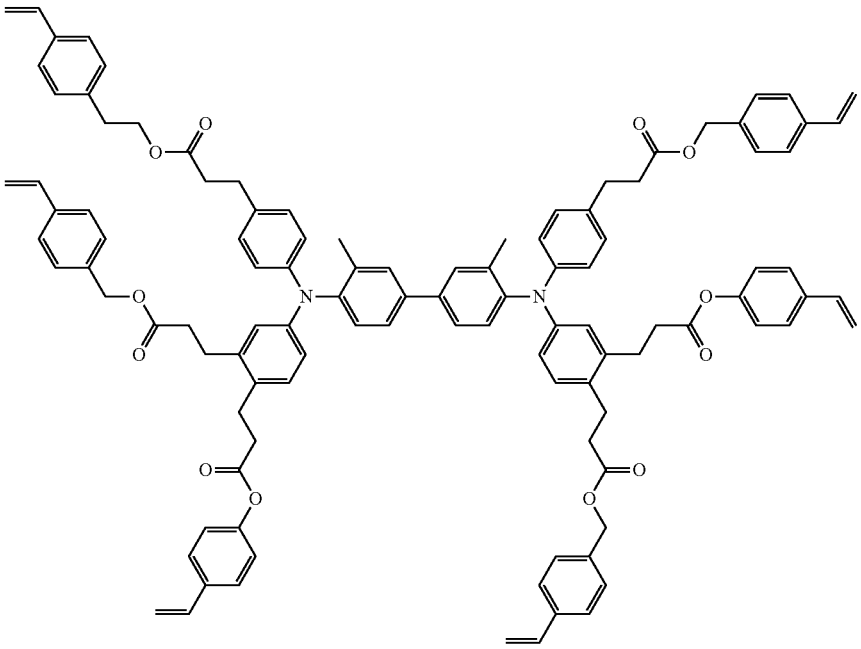 |

-continued

| No. | |
|---|---|
| vi-5 | 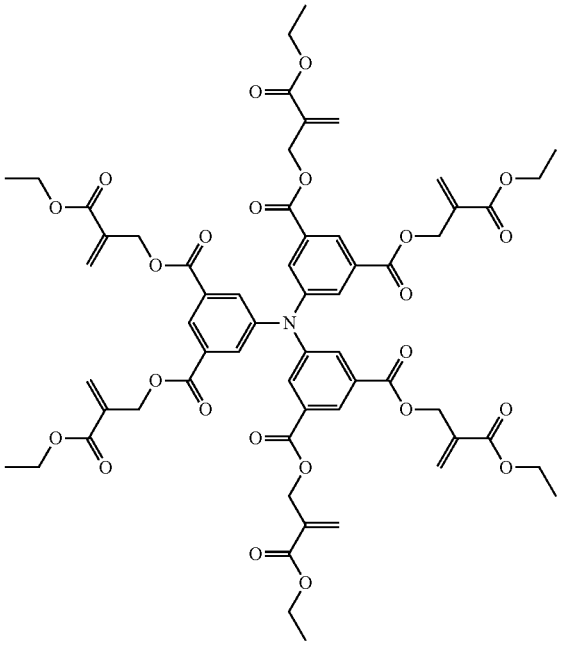 |
| vi-6 | 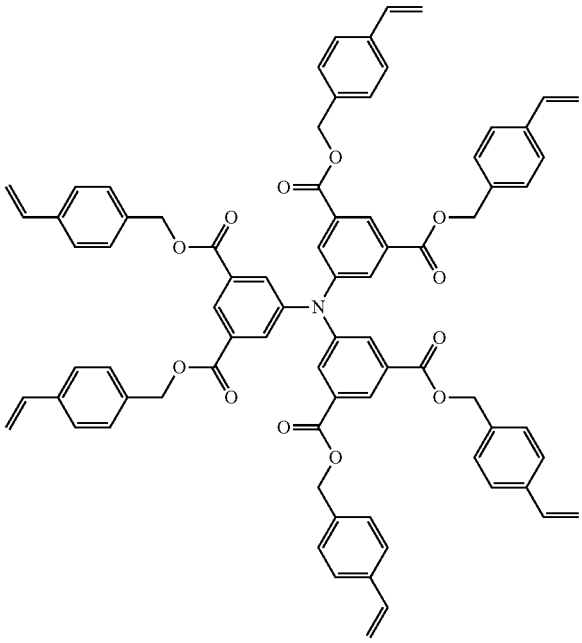 |

The total content of the charge transporting material having a chain polymerizable functional group is preferably 40% by weight or more, more preferably 50% by weight or more, and even more preferably 60% by weight or more, with respect to the composition used for the formation of the protective layer.

When the above range is satisfied, good electrical properties are achieved, and a cured film having a sufficient thickness can be made.

In the present exemplary embodiment, a charge transporting material having a chain polymerizable functional group may be used in combination with a known charge transporting material having no reactive group. The known charge transporting material having no reactive group has not any reactive group that does not play a role of charge transport, and therefore has an advantage in that a component concentration of the charge transporting material is increased and electric properties are further improved.

As the known charge transporting material, those materials recited as a charge transporting material that constitutes the aforementioned charge transport layer 3 may be used.

The other components of the composition used for the formation of the protective layer are described below.

The composition used for the formation of the protective layer may contain the following surfactant, thereby ensuring film-forming ability.

The surfactant contains in the molecule thereof, for example, at least one structure selected from the group consisting of (A) a structure formed by polymerization of an acryl monomer having a fluorine atom; (B) a structure having a carbon-carbon double bond and a fluorine atom; (C) an alkylene oxide structure; and (D) a structure having a carbon-carbon triple bond and a hydroxyl group.

The surfactant may contain at least one structure selected from (A) to (D) in the molecule thereof, and may contain a combination of two or more structures selected from (A) to (D) in the molecule thereof.

The structures (A) to (D) and the surfactants having the structure(s) are further described below.

(A) Structure Formed by Polymerization of an Acryl Monomer having a Fluorine atom The structure (A) formed by polymerization of an acryl monomer having a fluorine atom is not particularly limited, but is preferably a structure formed by polymerization of an acryl monomer having a fluoroalkyl group, and more preferably a structure formed by polymerization of an acryl monomer having a perfluoroalkyl group.

Specific examples of the surfactant having the structure (A) include POLYFLOW KL-600 (manufactured by Kyoeisha Chemical Co., Ltd.), EFTOP EF-351, EF-352, EF-801, EF-802, EF-601 (manufactured by JEMCO, Inc.).

(B) Structure having a Carbon-Carbon Double Bond and a Fluorine Atom

The structure (B) having a carbon-carbon double bond and a fluorine atom is not particularly limited, but is preferably a structure represented by at least one of the following Formula (B1) or Formula (B2).

(B1)

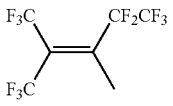

(B2)

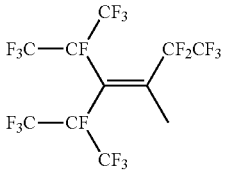

The surfactant having the structure (B) is preferably a compound having the group represented by at least one of Formula (B1) or (B2) in a side chain of the acryl polymer, or a compound represented by any of the following Formulae (B3) to (B5).

When the surfactant having the structure (B) is a compound having the group represented by at least one of Formula (B1) or (B2) in a side chain of the acryl polymer, the acryl structure is highly compatible with other components of the composition, which contributes to the formation of a uniform outermost surface layer.

Alternatively, when the surfactant having the structure (B) is a compound represented by any of Formulae (B3) to (B5), cissing during coating is prevented, so that coating film defects can be suppressed.

(B3)

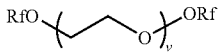

(B4)

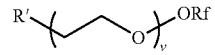

(B5)

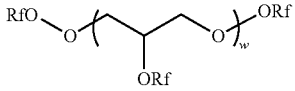

In Formulae (B3) to (B5), v and w each independently represent an integer of 1 or more, R' represents a hydrogen atom or a monovalent organic group, and Rfs each independently represent a group represented by Formula (B1) or (B2).

In Formulae (B3) to (B5), examples of the monovalent organic group represented by R' include an alkyl group having 1 to 30 carbon atoms, and a hydroxyalkyl group having 1 to 30 carbon atoms.

Examples of commercial products of the surfactant having the structure (B) are listed below.

Examples of the compound represented by any of Formulae (B3) to (B5) include FTERGENT 100, 100C, 110, 140A, 150, 150CH, A-K, 501, 250, 251, 222F, FTX-218, 300, 310, 400SW, 212M, 245M, 290M, FTX-207S, FTX-211S, FTX-220S, FTX-230S, FTX-209F, FTX-213F, FTX-222F, FTX-233F, FTX-245F, FTX-208G, FTX-218G, FTX-230G, FTX-240G, FTX-204D, FTX-280D, FTX-212D, FTX-216D, FTX-218D, FTX-220D, and FTX-222D (manufactured by Neos Company Limited).

Examples of the compound having the structure represented by at least one of Formula (B1) or (B2) in a side chain of the acryl polymer include KB-L82, KB-L85, KB-L97, KB-L109, KB-L110, KB-F2L, KB-F2M, KB-F2S, KB-F3M, and KB-FaM (manufactured by Neos Company Limited).

(C) Alkylene Oxide Structure

The alkylene oxide structure (C) may be alkylene oxide or polyalkylene oxide. Specific examples of the alkylene oxide include ethylene oxide and propylene oxide. In the polyalkylene oxide, the repeated number of the alkylene oxide may be from 2 to 10000.

Examples of the surfactant having the alkylene oxide structure (C) include polyethylene glycol, polyether anti-foaming agents, and polyether-modified silicone oil.

The polyethylene glycol preferably has an average molecular weight of 2000 or less. Examples of the polyethylene glycol having an average molecular weight of 2000 or less include polyethylene glycol 2000 (average molecular weight: 2000), polyethylene glycol 600 (average molecular weight: 600), polyethylene glycol 400 (average molecular weight: 400), and polyethylene glycol 200 (average molecular weight: 200).

Other preferred examples include polyether anti-foaming agents such as PE-M, PE-L (manufactured by Wako Pure Chemical Industries, Ltd.), Anti-Foaming Agent No, 1, and Anti-Foaming Agent No. 5 (manufactured by Kao Corporation).

Examples of the surfactant having in the molecule thereof the alkylene oxide structure (C) and a fluorine atom include those having alkylene oxide or polyalkylene oxide in a side chain of the polymer having a fluorine atom, and alkylene oxide or polyalkylene oxide having its terminal substituted with a group containing a fluorine atom.

Specific examples of the surfactant having in the molecule thereof the alkylene oxide structure (C) and a fluorine atom include MEGAFAC F-443, F-444, F-445, F-446 (manufactured by Dainippon Ink And Chemicals, Incorporated), FTERGENT 250, 251, 222F (manufactured by Neos Company Limited), POLY FOX PF636, PF6320, PF6520, and PF656 (manufactured by Kitamura Chemicals Co., Ltd.).

Specific examples of the surfactant having in the molecule thereof the alkylene oxide structure (C) and a silicone structure include KF351(A), KF352(A), KF353(A), KF354(A), KF355(A), KF615(A), KF618, KF945(A), KF6004 (manufactured by Shin-Etsu Chemical Co., Ltd.), TSF4440, TSF4445, TSF4450, TSF4446, TSF4452, TSF4453, TSF4460 (manufactured by GE Toshiba Silicones Co., Ltd.), BYK-300, 302, 306, 307, 310, 315, 320, 322, 323, 325, 330, 331, 333, 337, 341, 344, 345, 346, 347, 348, 370, 375, 377, 378, UV3500, UV3510, and UV3570 (manufactured by BYK-Chemie-Japan).

(D) Structure having a Carbon-Carbon Triple Bond and a Hydroxyl Group

The structure (D) having a carbon-carbon triple bond and a hydroxyl group is not particularly limited. Examples of the surfactant having the structure include the following compounds.

The surfactant having the structure (D) containing a carbon-carbon triple bond and a hydroxyl group may be a compound having in the molecule thereof a triple bond and a hydroxyl group, and specific examples thereof include 2-propyne-1-ol, 1-butyne-3-ol, 2-butyne-1-ol, 3-butyne-1-ol, 1-pentyne-3-ol, 2-pentyne-1-ol, 3-pentyne-1-ol, 4-pentyne-1-ol, 4-pentyne-2-ol, 1-hexyne-3-ol, 2-hexyne-1-ol, 3-hexyne-1-ol, 5-hexyne-1-ol, 5-hexyne-3-ol, 1-heptyne-3-ol, 2-heptyne-1-ol, 3-heptyne-1-ol, 4-heptyne-2-ol, 5-heptyne-3-ol, 1-octyne-3-ol, 1-octyne-3-ol, 3-octyne-1-ol, 3-nonyne-1-ol, 2-decyne-1-ol, 3-decyne-1-ol, 10-undecyne-1-ol, 3-methyl-1-butyne-3-ol, 3-methyl-1-pentene-4-yne-3-ol, 3-methyl-1-pentyne-3-ol, 5-methyl-1-hexyne-3-ol, 3-ethyl-1-pentyne-3-ol, 3-ethyl-1-heptyne-3-ol, 4-ethyl-1-octyne-3-ol, 3,4-dimethyl-1-pentyne-3-ol, 3,5-dimethyl-1-hexyne-3-ol, 3,6-dimethyl-1-heptyne-3-ol, 2,2,8,8-tetramethyl-3,6-nonadiyne-5-ol, 4,6-nonadecadiyne-1-ol, 10,12-pentacosadiyn-1-ol, 2-butyne-1,4-diol, 3-hexyne-2,5-diol, 2,4-hexadiyne-1,6-diol, 2,5-dimethyl-3-hexyne-2,5-diol, 3,6-dimethyl-4-octyne-3,6-diol, 2,4,7,9-tetramethyl-5-decyne-4,7-diol, (+)-1,6-bis(2-chlorophenyl)-1,6-diphenyl-2,4-hexadiyne-1,6-diol, (+1,6-bis(2-chlorophenyl)-1,6-diphenyl-2,4-hexadiyne-1,6-diol, 2-butyne-1,4-diol bis(2-hydroxyethyl), 1,4-diacetoxy-2-butyne, 4-diethylamino-2-butyne-1-ol, 1,1-diphenyl-2-propyne-1-ol, 1-ethynyl-1-cyclohexanol, 9-ethynyl-9-fluorenol, 2,4-hexadiynediyl-1,6-bis(4-phenylazobenzene sulfonate), 2-hydroxy-3-butynoic acid, 2-hydroxy-3-butynoic acid ethyl ester, 2-methyl-4-phenyl-3-butyne-2-ol, methylpropargyl ether, 5-phenyl-4-pentyne-1-ol, 1-phenyl-1-propyne-3-ol, 1-phenyl-2-propyne-1-ol, 4-trimethylsilyl-3-butyne-2-ol, and 3-trimethylsilyl-2-propyne-1-ol.

Other examples include the above compounds in which a part or entire of hydroxyl groups are combined with alkylene oxide such as ethylene oxide (for example, trade name: SURFYNOL 400 Series, manufactured by Shin-Etsu Chemical Co., Ltd.).

The surfactant having the structure (D) having a carbon-carbon triple bond and a hydroxyl group is preferably a compound represented by the following Formula (D1) or (D2).

(D1)

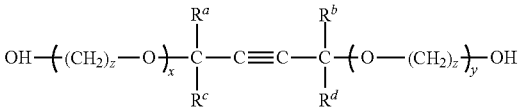

(D2)

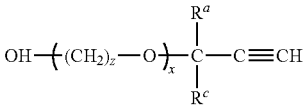

In Formulae (D1) and (D2), $R^a$, $R^b$, $R^c$ and $R^d$ each independently represent a monovalent organic group, x, y, and z each independently represent an integer of 1 or more.

In the compound represented by Formula (D1) or (D2), it is preferred that $R^a$, $R^b$, $R^c$, and $R^d$ be alkyl groups, it is more preferred that at least one of $R^a$ or $R^b$, or at least one of $R^c$ or $R^d$ be branched alkyl groups, and it is even more preferred that z be from 1 to 10, and x and y be from 1 to 500.

Examples of the commercial product of the compound represented by Formula (D1) or (D2) include SURFYNOL 400 Series (manufactured by Shin-Etsu Chemical Co., Ltd.).

The surfactant having any of the structures (A) to (D) may be used alone, or in combination of two or more thereof. When two or more surfactants are used in combination, other surfactant having a structure different from the structures (A) to (D) may be added in an amount of not impairing the surfactant effect.

Examples of the other surfactant include the following surfactants having a fluorine atom or a silicone structure.

Preferred examples of the surfactant having a fluorine atom which may be used in combination with the surfactant having any of the structures (A) to (D) include perfluoroalkyl sulfonic acids (for example, perfluorobutanesulfonic acid and perfluorooctanesulfonic acid), perfluoroalkylcarboxylic acids (for example, perfluorobutanecarboxylic acid and perfluorooctanecarboxylic acid), and perfluoroalkyl group-containing phosphates. The perfluoroalkylsulfonic acids and perfluoroalkylcarboxylic acids may be salts thereof or amide-modified derivatives thereof.

Examples of the commercial product of the perfluoroalkylsulfonic acids include MEGAFAC F-114 (manufactured by Dainippon Ink And Chemicals, Incorporated), EFTOP EF-101, EF102, EF-103, EF-104, EF-105, EF-112, EF-121, EF-122A, EF-122B, EF-122C, EF-123A (manufactured by JEMCO Inc.), FTERGENT 100, 100C, 110, 140A, 150, 150CH, A-K, and 501 (manufactured by Neos Company Limited).

Examples of the commercial product of the perfluoroalkylcarboxylic acids include MEGAFAC F-410 (manufactured by Dainippon Ink And Chemicals, Incorporated), EFTOP EF-201, and EF-204 (manufactured by JEMCO Inc.).

Examples of the commercial product of the perfluoroalkyl group-containing phosphates include MEGAFAC F-493, F-494 (manufactured by Dainippon Ink And Chemicals, Incorporated), EFTOP EF-123A, EF-123B, EF-125M, EF-132, and (manufactured by JEMCO, Inc.).

Examples of the surfactant having a fluorine atom which may be used in combination with the surfactant having any of the structures (A) to (D) are not limited to the above examples, and other preferred examples thereof include fluorine atom-containing betaine compounds (for example, FTERGENT 400SW, manufactured by Neos Company Limited), and surfactants having an amphoteric ion group (for example, FTERGENT SW, manufactured by Neos Company Limited).

Examples of the surfactant having a silicone structure which may be used in combination with the surfactant having any of the structures (A) to (D) include common silicone oils such as dimethyl silicone, methylphenyl silicone, diphenyl silicone, and derivatives thereof.

The surfactant content is preferably from 0.01% by weight to 1% by weight, more preferably from 0.02% by weight to 0.5% by weight with respect to the total solid content of the protective layer (outermost surface layer) 5. If the surfactant content is less than 0.01% by weight, the effect of preventing coating film defects may be insufficient. On the other hand, if the surfactant content is more than 1% by weight, the cured film may have an insufficient strength due to the separation between the surfactant and the curing components (the compound represented by Formula (I), and other monomer and oligomer).

In the whole surfactant, the content of the surfactant having any of the structures (A) to (D) is preferably 1% by weight or more, and more preferably 10% by weight or more.

A radical polymerizable monomer or oligomer, which does not have charge transportability, may be added to the composition used to form the protective layer, for the purpose of controlling viscosity of the composition, mechanical strength of a film, flexibility, smoothness and cleaning property.

Examples of the monofunctional radical polymerizable monomer include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyethyl acrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl o-phenylphenol acrylate, and o-phenylphenolglycidylether acrylate.

Examples of bifunctional radical polymerizable monomer include 1,4-butanediol diacrylate, 1,6-hexanediol diacrylate, 1,9-nonanediol diacrylate, 2-n-butyl-2-ethyl-1,3-propanediol diacrylate, tripropylene glycol diacrylate, tetraethylene glycol diacrylate, dioxane glycol diacrylate, polytetramethylene glycol diacrylate, ethoxylated bisphenol A diacrylate, ethoxylated bisphenol A dimethacrylate, tricyclodecanemethanol diacrylate and tricyclodecanemethanol dimethacrylate.

Examples of tri- or higher functional radical polymerizable monomer include trimethylolpropane triacrylate, trimethylolpropane trimethacrylate, pentaerythritol acrylate, trimethylolpropane EO-added triacrylate, glycerin PO-added triacrylate, trisacryloyloxyethyl phosphate, pentaerythritol tetraacrylate and ethoxylated isocyanuric acid triacrylate.

Examples of radical polymerizable oligomer include epoxy acrylate oligomers, urethane acrylate oligomers and polyester acrylate oligomers.

The radical polymerizable monomer or oligomer that does not have charge transportability is preferably contained in an amount of from 0% by weight to 50% by weight, more preferably from 0% by weight to 40% by weight and still more preferably from 0% by weight to 30% by weight, relative to the total solid content in the composition.

The composition used for the formation of the protective layer preferably contains a thermal radical initiator.

The cured film (crosslinked film) forming the protective layer (outermost surface layer) is obtained by curing a composition containing the above components by any method of using heat, light, electron beams or the like. In order to obtain a cured film having balanced properties such as electrical properties and a mechanical strength, the film is preferably cured by heat. For curing of a common acryl paint, electron beams which allows noncatalytic curing, and photopolymerization which allows quick curing are preferred. However, in the electrophotographic photoreceptor, the photosensitive layer to form the outermost surface layer contains a photosensitive material. Therefore, in order to minimize the damage to the photosensitive material, and to improve the surface properties of the cured film to be formed, thermal curing which proceeds moderate reaction is preferred.

Accordingly, thermal curing may be achieved with no catalyst, but preferably catalyzed by a thermal radical initiator.

The thermal radical initiator is not particularly limited, but it is preferred to use those having a 10 hour half-life temperature of from 40° C. to 110° C. so that damage to the photosensitive material in the photosensitive layer during formation of the protective layer can be suppressed.

Examples of the commercial product of the thermal radical initiator include the following products. The temperature provided in parentheses refers to 10 hour half-life temperature. Azo initiators such as V-30 (104° C.), V-40 (88° C.), V-59 (67° C.), V-601 (66° C.), V-65 (51° C.), V-70 (30° C.), VF-096 (96° C.), Vam-110 (111° C.), Vam-111 (111° C.) (each manufactured by Wako Pure Chemical Industries, Ltd.); $OT_{AZO}$-15 (61° C.), $OT_{AZO}$-30, AIBM (65° C.), AMBN (67° C.), ADVN (52° C.), or ACVA (68° C.) (each manufactured by Otsuka Chemical Co., Ltd.); PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, PERBUTYL Z (each manufactured by NOF Corporation); KAYAketal AM-055, TRIGONOX 36-C75, LAUROX, PERKADOX L-W75, PERKADOX CH-50L, TRIGONOX TMBH, KAYACUMENE H, KAYAbutyl H-70, PERKADOX BC-FF, KAYAHEXA AD, PERKADOX 14, KAYABUTYL C, KAYABUTYL D, KAYAHEXA YD-E85, PERKADOX 12-XL25, PERKADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-C50, KAYABUTYL B, KAYACARBON EH-C70, KAYACARBON EH-W60, KAYACARBON I-20, KAYACARBON BIC-75, TRIGONOX 117, KAYALENE 6-70 (each manufactured by Kayaku Akzo Corporation); LUPEROX LP (64° C.), LUPEROX 610 (37° C.), LUPEROX 188 (38° C.), LUPEROX 844 (44° C.), LUPEROX 259 (46° C.), LUPEROX 10 (48° C.), LUPEROX 701 (53° C.), LUPEROX 11 (58° C.), LUPEROX 26 (77° C.), LUPEROX 80 (82° C.), LUPEROX 7 (102° C.), LUPEROX 270 (102° C.), LUPEROX P (104° C.), LUPEROX 546 (46° C.), LUPEROX 554 (55° C.), LUPEROX 575 (75° C.), LUPEROX TANPO (96° C.), LUPEROX 555 (100° C.), LUPEROX 570 (96° C.), LUPEROX TAP (100° C.), LUPEROX TBIC (99° C.), LUPEROX TBEC (100° C.), LUPEROX JW (100° C.), LUPEROX TAIL (96° C.), LUPEROX TAEC (99° C.), LUPEROX DC (117° C.), LUPEROX 101 (120° C.), LUPEROX F (116° C.), LUPEROX DI (129° C.), LUPEROX 130 (131° C.), LUPEROX 220 (107° C.), LUPEROX 230 (109° C.), LUPEROX 233 (114° C.), and LUPEROX 531 (93° C.) (each manufactured by Arkema Yoshitomi, Ltd.).

The content of the thermal radical initiator is preferably from 0.001% by weight to 10% by weight, more preferably from 0.01% by weight to 5% by weight, and even more preferably from 0.1 weight to 3% by weight, with respect to the reactive compound in the composition.

In the composition used to form the protective layer, another thermosetting resin such as a phenol resin, a melamine resin or a benzoguanamine resin may be added for the purpose of inhibiting excessive absorption of gas generated by discharge and thereby effectively suppressing oxidation caused by the generated gas.

Furthermore, in the composition used to form the protective layer, a coupling agent, a hardcoat agent or a fluorine-containing compound may be further added to adjust a film-forming property of a film, flexibility, lubricity, or adhesive property. Specific examples of the additive include various silane coupling agents and commercially available silicone hardcoat agents.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane.

Examples of the commercially available hardcoat agent include KP-85, X-40-9740 and X-8239 (trade name, all manufactured by Shin-Etsu Silicone Co., Ltd.) and AY42-440, AY42-441 and AY49-208 (trade name, all manufactured by Dow Corning Toray Co., Ltd.).

Furthermore, in order to impart water repelling property, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H, 1H, 2H, 2H-perfluoroalkyltriethoxysilane, 1H, 1H, 2H, 2H-perfluorodecyltriethoxysilane, or 1H, 1H, 2H, 2H-perfluorooctyltriethoxysilane may be added.

A silane coupling agent may be used at any amount. However, the amount by weight of a fluorine-containing compound is preferably set at 0.25 times or less as much as a compound that does not contain fluorine. Excessive amount may cause disadvantage in the film-forming property of a crosslinked film.

Furthermore, in the composition used to form the protective layer, a thermoplastic resin may be added in order to improve discharge gas resistance, mechanical strength and scratch resistance, and further in order to reduce torque, to control a wear amount, to extend a pot-life and to control dispersibility of particles and viscosity in the protective layer respectively.

Examples of the thermoplastic resin include a polyvinyl acetal resin such as a polyvinyl butyral resin, a polyvinyl formal resin, or a partially acetalized polyvinyl acetal resin in which butyral is partially modified with formal or acetoacetal (for example, S-LEC B, K (trade name, manufactured by Sekisui Chemical Co., Ltd.)), a polyamide resin, a cellulose resin, and a polyvinyl phenol resin. A polyvinyl acetal resin and a polyvinyl phenol resin are preferred in view of electric characteristics. A weight average molecular weight of the resin is preferably from 2000 to 100,000 and more preferably from 5,000 to 50,000. When the molecular weight of the resin is less than 2,000, an addition effect of the resin tends to be insufficient. On the other hand, when the molecular weight of the resin exceeds 100,000, the solubility is lowered to tend to result in limiting an addition amount and causing film-forming defect during coating. An addition amount of the resin is preferably from 1% by weight to 40% by weight, more preferably from 1% by weight to 30% by weight and still more preferably from 5% by weight to 20% by weight. When the addition amount of the resin is less than 1% by weight, an addition effect of the resin tends to be insufficient. On the other hand, when the addition amount thereof exceeds 40% by weight, image blurring tends to occur under a high temperature and high humidity (for example, 28° C., 85% RH) environment.

In the composition used to form the protective layer, an antioxidant is preferably added in order to inhibit the protective layer from being deteriorated by an oxidizing gas such as ozone generated by a charging unit. If a mechanical strength of the photoreceptor surface is enhanced and thereby a photoreceptor is extended in the lifetime, a photoreceptor becomes to contact the oxidizing gas over a longer period of time than ever. As a result, oxidation resistance stronger than ever is demanded.

The anti-oxidant is preferably a hindered phenol antioxidant or a hindered amine antioxidant, and a known antioxidant such as an organic sulfur antioxidant, a phosphite antioxidant, a dithiocarbamic acid salt antioxidant, a thiourea antioxidant or a benzimidazole antioxidant may be used. An addition amount of the antioxidant is preferably 20% by weight or less and more preferably 10% by weight or less.

Examples of the hindered phenol antioxidant include 2,6-di-t-butyl-4-methylphenol, 2,5-di-t-butylhydroquinone, N,N'-hexamethylene bis(3,5-di-t-butyl-4-hydroxy)hydrocinnamide, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylene bis(4-methyl-6-t-butylphenol), 2,2-methylene bis(4-ethyl-6-t-butylphenol), 4,4'-butylidene bis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis (3-methyl-6-t-butyl phenol).

Furthermore, in the composition used to form the protective layer, various particles may be added in order to reduce a residual potential or to improve mechanical strength of the protective layer.

Examples of the particles include silicon-containing particles. The silicon-containing particles are those containing silicon as a constituent element, and, specifically, colloidal silica and silicone particles are exemplified. Colloidal silica used as a silicon-containing particle is selected from acidic or alkaline aqueous dispersion, and organic solvent (such as alcohol, ketone or ester) dispersions containing colloidal silica having an average particle diameter of from 1 nm to 100 nm and preferably from 10 nm to 30 nm. Commercially available colloidal silica may be used. A solid content of colloidal silica in the protective layer is not particularly restricted. However, the solid content of colloidal silica relative to the total solid content in the protective layer is used in the range of from 0.1% by weight to 50% by weight and preferably in the range of from 0.1% by weight to 30% by weight, from the viewpoints of film-forming property, electric characteristics and mechanical strength.

A silicone particle that is used as a silicon-containing particle is selected from a silicone resin particle, a silicone rubber particle and a silica particle surface treated with silicone, and commercially available silicone particles are generally used. The silicone particle is spherically formed and an average particle diameter thereof is preferably from 1 nm to 500 nm and more preferably from 10 nm to 100 nm. The silicone particle is a fine particle that is chemically inactive, excellent in the dispersibility in a resin and low in content necessary to obtain sufficient characteristics; accordingly, a surface property of an electrophotographic photoreceptor is improved without disturbing a crosslinking reaction. That is, in a state where silicone particles are introduced in a rigid crosslinking structure without causing fluctuation, lubricity and water repellency of a surface of an electrophotographic photoreceptor are improved and thereby excellent wear resistance and contamination attachment resistance are maintained over a long period of time.

The content of silicone particles in the protective layer is preferably from 0.1% by weight to 30% by weight and more preferably from 0.5% by weight to 10% by weight, relative to the total solid content in the protective layer.

Examples of other particle include fluorine-based particles of tetrafluoroethylene, trifluoroethylene, hexafluoropropylene, vinyl fluoride, or vinylidene fluoride; particles made of resins obtained by copolymerizing a fluororesin and a monomer having a hydroxy group as described in "Preprints of the 8th Polymer Material Forum, p. 89"; and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO or MgO. Furthermore, oil such as silicone oil may be added for the same purpose. Examples of silicone oil include silicone oil such as dimethylpolysiloxane, diphenylpolysiloxane, or phenylmethylsiloxane; reactive silicone oil such as amino-modified polysiloxane, epoxy-modified polysiloxane, carboxyl-modified polysiloxane, carbinol-modified polysiloxane, methacryl-modified polysiloxane, mercapto-modified polysiloxane, or phenol-modified polysiloxane; cyclic dimethylcyclosiloxanes such as hexamethylcyclotrisiloxane, octamethylcyclotetrasiloxane, decamethylcyclopentasiloxane or dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane or 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane or phenylhydrocyclosiloxane; and vinyl group-containing cyclosiloxanes such as pentavinylpentamethylcyclopentasiloxane.

In the composition used to form the protective layer, metal, metal oxide, carbon black or the like may be added. Examples of the metal include aluminum, zinc, copper, chromium, nickel, silver and stainless steel are cited, and plastic particles on a surface of which any of these metals is deposited. Examples of the metal oxide include zinc oxide, titanium oxide, tin oxide, antimony oxide, indium oxide, bismuth oxide, tin-doped indium oxide, antimony or tantalum-doped tin oxide and antimony-doped zirconium oxide. These may be used alone or in a combination of at least two of them. When at least two of them are used in combination, any one of a simple mixture, a solid solution thereof and a fused metal oxide may be used. An average particle diameter of conductive particles is preferably 0.3 μm or less and particularly preferably 0.1 μm or less from the viewpoint of transparency of a protective layer.

The composition used to form the protective layer is preferably prepared as a coating solution for forming the protective layer. The coating solution for forming the protective layer may be free from a solvent or may contain, as required, a solvent such as alcohols such as methanol, ethanol, propanol, butanol, cyclopentanol or cyclohexanol; ketones such as acetone or methyl ethyl ketone; or ethers such as tetrahydrofuran, diethyl ether or dioxane.

These solvents may be used alone or in a mixture of at least two of them and preferably have a boiling temperature of 100° C. or less. As the solvent, at least one of solvents having a hydroxyl group (for example, alcohols) is preferably used.

The coating solution for forming the protective layer including the composition used to form the protective layer is coated on the charge transport layer according to an ordinary coating method such as a blade coating method, a wire bar coating method, a spray coating method, a dip coating method, a bead coating method, an air-knife coating method or a curtain coating method. Then, the coating is cured by, if required, heating at a temperature of from 100° C. to 170° C., thereby obtaining a cured material. As a result, the protective layer (outermost surface layer) made of the cured material is obtained.

An oxygen concentration during curing of the coating solution for forming the protective layer is preferably 1% or less, more preferably 1000 ppm or less and still more preferably 500 ppm or less.

In addition to application to a photoreceptor, the coating solution for forming the protective layer may be used, for example, in a fluorescent photochromic coating material, or an antistatic film on a glass surface or a plastic surface. When the coating solution is used, a film showing excellent adhesion to a lower layer is formed, and thereby performance deterioration caused by repeating usage over a long period of time is suppressed.

As an electrophotographic photoreceptor, an example of a function separation type has been described above. The content of the charge generating material in a single layer photosensitive layer 6 (charge generating/charge transport layer) is from 10% by weight to 85% by weight, or from about 10% by weight to about 85% by weight, and preferably from 20% by weight to 50% by weight. Content of a charge transporting material is preferably from 5% by weight to 50% by weight. A method for forming the monolayer type photosensitive layer 6 (charge generating/charge transport layer) is conducted in the same manner as in the method for forming the charge generating layer 2 and the charge transport layer 3. A film thickness of the monolayer type photosensitive layer (charge generating/charge transport layer) 6 is set at preferably substantially from 5 μm to 50 μm, or from about 5 μm to about 50 μm, and more preferably from 10 μm to 40 μm.

In the foregoing exemplary embodiment, a form where the outermost surface layer made of a cured material of the specific composition is a protective layer has been described. However, in the case of a layer structure where a protective layer is not formed, a charge transport layer locating at the outermost surface in the layer structure is the outermost surface layer.

Image Forming Apparatus/Process Cartridge

Figure 4:
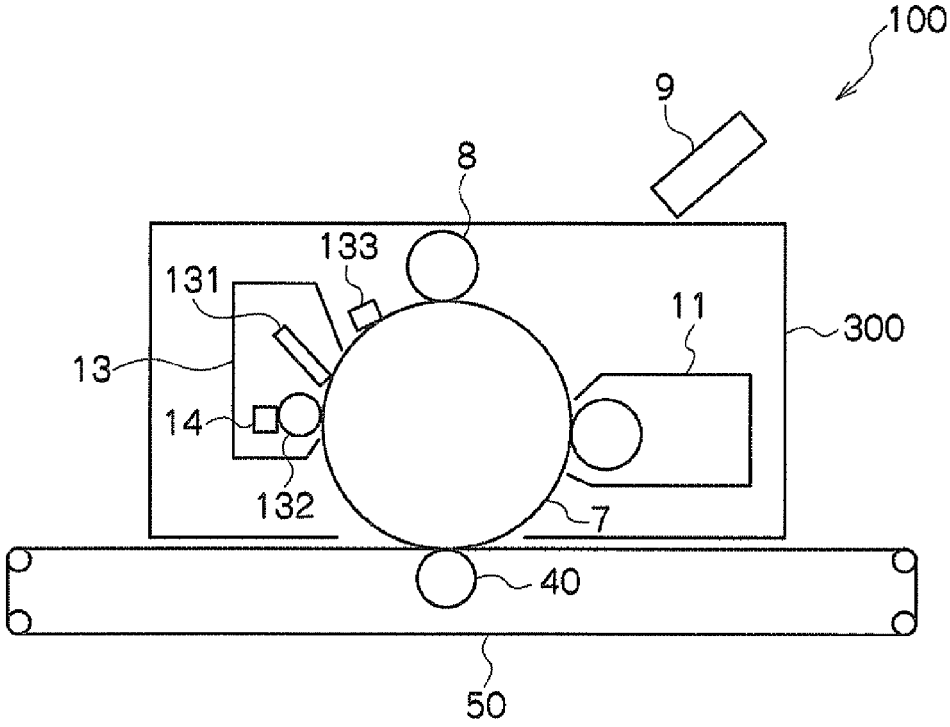
FIG. 4 is a schematic view showing an image forming apparatus according to an exemplary embodiment of the invention.

FIG. 4 is a schematic configuration diagram showing an image forming apparatus 100 involved in the exemplary embodiment of the invention.

The image forming apparatus 100 shown in FIG. 4 includes: a process cartridge 300 provided with an electrophotographic photoreceptor 7; an exposing apparatus (electrostatic latent image forming unit) 9; a transfer apparatus (transfer unit) 40; and an intermediate transfer medium 50. In the image forming apparatus 100, the exposing apparatus 9 is disposed at a position capable of exposing the electrophotographic photoreceptor 7 from an opening of the process cartridge 300, the transfer apparatus 40 is disposed at a position facing the electrophotographic photoreceptor 7 via the intermediate transfer medium 50, and the intermediate transfer medium 50 is disposed partially in contact with the electrophotographic photoreceptor 7.

The process cartridge 300 in FIG. 4 integrally supports the electrophotographic photoreceptor 7, a charging apparatus (charging unit) 8, a developing apparatus (developing unit) 11 and a cleaning apparatus 13 in a housing. The cleaning apparatus 13 includes a cleaning blade (cleaning member), and the cleaning blade 131 is disposed so as to come into contact with a surface of the electrophotographic photoreceptor 7.

In FIG. 4, an example where, as the cleaning apparatus 13, a fibrous member 132 (roll) for supplying a lubricant 14 on a surface of the photoreceptor 7 is provided and a fibrous member 133 (planar brush) for assisting cleaning is used is shown. However, these may be used as required.

As the charging apparatus 8, a contact charging device that uses, for example, a conductive or semiconductive charging roller, charging brush, charging film, charging rubber blade or charging tube is used. A known charging device such as a non-contact roller charging device. Scorotron corona charger or Corotron corona charger that makes use of corona discharge may be used as well.

Though not shown in the drawing, a photoreceptor heating member for elevating a temperature of the electrophotographic photoreceptor 7 to reduce a relative temperature may be disposed around the electrophotographic photoreceptor 7 to enhance stability of an image.

As the exposing apparatus 9, an optical device for desirably image-wise exposing light of semiconductor laser beam, LED light or liquid crystal shutter light on a surface of the photoreceptor 7 is exemplified. A wavelength of a light source, which is in a spectral sensitivity range of a photoreceptor, is used. As a wavelength of a semiconductor laser, near-infrared having an oscillation wavelength in the proximity of 780 nm is mainly used. However, without restricting to the wavelength, a laser having an oscillation wavelength of 600 something nm or a laser having an oscillation wavelength in the vicinity of from 400 nm to 450 nm as a blue laser may be used. Furthermore, when a color image is formed, a surface-emitting laser light source capable of outputting multi-beams as well is effective.

As the developing apparatus 11, a general developing apparatus where, for example, a magnetic or nonmagnetic single component developing agent or two-component developing agent is used in contact or without contact to develop may be used. The developing apparatus is selected in accordance with the object as long as the foregoing functions are possessed. For example, a known developing device where the single component or two-component developing agent is attached to a photoreceptor 7 by use of a brush or a roller is cited. Among these, a developing roller retaining a developing agent on a surface thereof is preferably used.

Hereinafter, a toner that is used in the developing apparatus 11 is described.

The developing agent may be a single component developing agent composed of a toner, or two-component developing agent including a toner and a carrier.

The toner is composed of, for example, toner particles containing a binder resin, a coloring agent, and other optional additives such as a release agent, and external additives as necessary.

The average shape factor of the toner particles (number average shape factor, the shape factor being expressed by $(ML^2/A)\times(\pi/4)\times100$, wherein ML represents the maximum particle length, and A represents the projected area of a particle) is preferably from 100 to 150, more preferably from 105 to 145, and even more preferably from 110 to 140. The volume average particle size of the toner is preferably from 3 μm to 12 μm, more preferably from 3.5 μm to 10 μm, and even more preferably from 4 μm to 9 μm.

A toner is not particularly restricted by the production method thereof. A toner that is produced according to, for example, a kneading and crashing method in which a binder resin, a colorant, a release agent and, as required, a charge controlling agent are added, followed by kneading, crashing and classifying; a method in which particles obtained according to the kneading and crashing method are changed in shape by mechanical impact or thermal energy; an emulsion-polymerization-condensation method in which a polymerizable monomer for obtaining a binder resin is emulsion-polymerized, and the resulting dispersion liquid, a colorant and a release agent and, as required, a dispersion liquid of a charge controlling agent are mixed, followed by condensation, heating and fusing to obtain a toner; a suspension polymerization method in which a polymerizable monomer for obtaining a binder resin, a colorant and a release agent, and as required, a solution of a charge controlling agent are suspended in an aqueous solvent to polymerize; or a dissolution suspension method in which a binder resin, a colorant and a release agent and, as required, a solution of a charge controlling agent are suspended in an aqueous solvent to granulate, is used.

Furthermore, a known production method such as a method in which the toner obtained by the foregoing method is used as a core, and flocculating particles are further attached thereto, followed by heating and fusing to form a core-shell structure may be used. As a method for producing a toner, a suspension polymerization method, an emulsion-polymerization-condensation method and a dissolution suspension method, in all of which an aqueous solvent is used to produce, are preferable from the viewpoints of shape control and particle size distribution control, and an emulsion-polymerization-condensation method is particularly preferred.

The toner is produced by mixing the toner particles with the external additives using, for example, a Henschel mixer or a V blender. When the toner particles are produced in a wet process, the external additives may be added in a wet process.

When the toner is used as a 2-component developer, the mixing ratio of the toner to the carrier is set at a well-known ratio. The carrier is not particularly limited, but preferred examples thereof include magnetic particles the surface of which is coated with a resin.

As the transfer apparatus 40, a known charging device such as a contact transfer charging device that uses, for example, a belt, a roller, a film or a rubber blade; or a Scorotron corona charger or Corotron corona charger using corona discharge may be used as well.

As the intermediate transfer medium 50, a belt (intermediate transfer belt) made of semiconductive polyimide, polyamideimide, polycarbonate, polyarylate, polyester, rubber or the like may be used. As a form of the intermediate transfer medium 50, a drum may be used in addition to a belt.

The image forming apparatus 100 may have, in addition to the above respective apparatuses, for example, an optical eraser that optically erases the photoreceptor 7.

Figure 5:
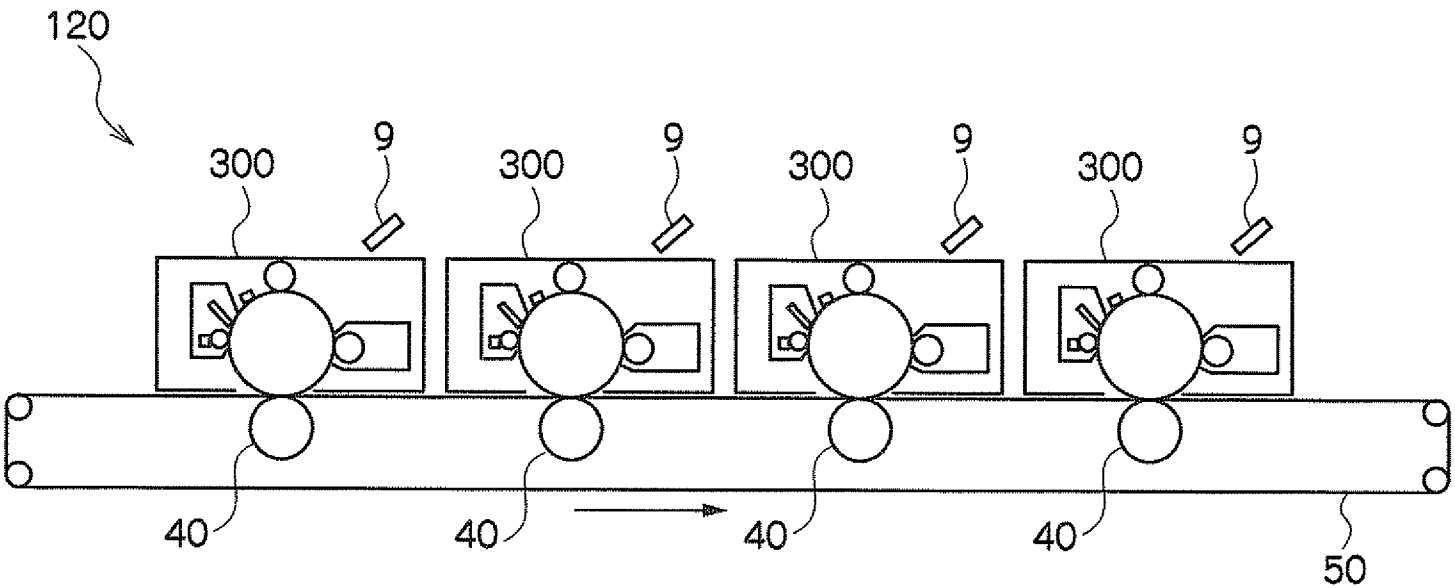
FIG. 5 is a schematic view showing an image forming apparatus according to another exemplary embodiment of the invention.

FIG. 5 is a schematic sectional view showing an image forming apparatus 120 involved in another exemplary embodiment of the invention.

The image forming apparatus 120 shown in FIG. 5 is a tandem full-color image forming apparatus including four process cartridges 300.

The image forming apparatus 120 has four process cartridges 300 each disposed side by side on an intermediate transfer medium 50 and has a configuration in which one electrophotographic photoreceptor is used for one color. The image forming apparatus 120 has the same configuration as the image forming apparatus 100 except that the image forming apparatus 120 is formed into a tandem system.

The image forming apparatus involved in the present exemplary embodiment is not limited to the above structure, and other image forming apparatus of a well-known system may be used.

In the exemplary embodiment described above, the outermost surface layer of the electrophotographic photoreceptor is made of a cured film of a composition containing the compound represented by Formula (M1) and a charge transporting material having a chain polymerizable functional group. However, the cured film is not limited to the above one. The cured film may be applied to, for example, an organic electroluminescence (electroluminescence, EL) device, a memory device, or a wavelength conversion device.

As described above, when the cured film contains the compound represented by Formula (M1), cations, anions, or radicals generated from the initiator and stimulation (for example, heat, electron beams, or light) selectively attack the chain polymerizable functional group to start chain polymerization, thereby preventing the attack to the charge transporting portion (charge transporting skeleton) in the charge transporting material. For this reason, it is considered that a cured film is formed without impairing charge transporting properties. Accordingly, the film exhibits good film formability when multilayered, without causing morphological change due to Joule heat, which is often seen in common films. In other words, good charge transporting properties in addition to durability such as solvent resistance and heat resistance are imparted to the cured film.

As a result, the cured film is useful for the above applications.

EXAMPLES

Exemplary embodiments of the invention are further described below with reference to examples, but the invention is not limited to these examples.

Example 1

Production of Electrophotographic Photoreceptor

Preparation of Undercoat Layer

In the beginning, 100 parts by weight of zinc oxide (average particle diameter: 70 nm, specific surface area: 15 $m^2/g$, manufactured by TAYCA Corporation) and 500 parts by weight of toluene are mixed and stirred, 1.3 parts by weight of a silane coupling agent (trade name: KBM503, manufactured by Shin-Etsu Chemical Co., Ltd.) are added thereto, followed by stirring for 2 hr. Thereafter, toluene is distilled away under reduced pressure, followed by baking at 120° C. for 3 hr, thereby obtaining a zinc oxide surface-treated with a silane coupling agent.

In the next place, 110 parts by weight of surface-treated zinc oxide and 500 parts by weight of tetrahydrofuran are mixed while stirring. To the mixture, a solution obtained by dissolving 0.6 parts by weight of alizarin in 50 parts by weight of tetrahydrofuran is added, followed by stirring at 50° C. for 5 hr. Thereafter, alizarin-added zinc oxide is filtered under reduced pressure, followed by drying at 60° C. under reduced pressure, thereby obtaining alizarin-added zinc oxide.

Then, 38 parts by weight of a solution obtained by mixing 60 parts by weight of the alizarin-added zinc oxide, 13.5 parts by weight of a hardener (blocked isocyanate, trade name: SUMIDULE 3175, manufactured by Sumitomo-Bayer Urethane Co., Ltd.) and 15 parts by weight of a butyral resin (trade name: S-LEC BM-1, manufactured by Sekisui Chemical Co., Ltd.) in 85 parts by weight of methyl ethyl ketone and 25 parts by weight of methyl ethyl ketone are mixed, followed by dispersing for 2 hr by use of a sand mill with glass beads having a diameter of 1 mm, thereby obtaining a dispersion liquid.

To the resulting dispersion liquid, 0.005 parts by weight of dioctyltin dilaurate as a catalyst and 40 parts by weight of silicone resin particles (trade name: TOSPEARL 145, manufactured by GE-Toshiba Silicone Co., Ltd.) are added, thereby obtaining a coating liquid for forming an undercoat layer. The coating liquid is coated by dipping on an aluminum substrate, followed by drying and curing at 170° C. for 40 min, thereby obtaining an undercoat layer having a thickness of 20 μm.

Preparation of Charge Generating Layer

In the beginning, a mixture containing 15 parts by weight of hydroxygallium phthalocyanine having diffraction peaks at least at 7.3°, 16.0°, 24.9° and 28.0° by Bragg angle (2θ±0.2°) in an X-ray diffraction spectrum obtained with CuKα characteristic X-ray as a charge generating material, 10 parts by weight of a vinyl chloride/vinyl acetate copolymer resin (trade name: VMCH, manufactured by Nippon Unicar Co., Ltd.) and 200 parts by weight of n-butyl acetate is dispersed for 4 hr by use of a sand mill with glass beads having a diameter of 1 mm. To the resulting dispersion liquid, 175 parts by weight of n-butyl acetate and 180 parts by weight of methyl ethyl ketone are added, followed by stirring, thereby obtaining a coating liquid for forming a charge generating layer. The coating liquid for forming a charge generating layer is coated on the undercoat layer by dipping, followed by drying at room temperature (25° C.), thereby forming a charge generating layer having a film thickness of 0.2 μm.

Preparation of Charge Transport Layer

Firstly, 45 parts by weight of N,N'-diphenyl-N,N'-bis(3-methylphenyl) [1,1']biphenyl-4,4'-diamine (hereinafter, referred to as "TPD") and 55 parts by weight of a bisphenol Z polycarbonate resin (hereinafter, referred to as "PCZ 500", viscosity average molecular weight: 50000) are dissolved in 800 parts by weight of chlorobenzene, thereby obtaining a coating liquid for forming a charge transpot layer. The coating liquid is coated on the charge generating layer, followed by heating at 130° C. for 45 min, thereby forming a charge transport layer having a thickness of 20 μm.

Preparation of Protective Layer 120 parts by weight of the compound represented by Formula (I) (compound ii-22) and 40 parts by weight of a monomer having no charge transport capability (trade name: A-DCP, manufactured by Shin-Nakamura Chemical Co., Ltd.) are dissolved in 100 parts by weight of tetrahydrofuran (THF). Subsequently, 3 parts by weight of an initiator (trade name: VE-73, manufactured by Wako Pure Chemical Industries, Ltd.) and 5 parts by weight of the compound represented by the formula (M1) (compound M-1, trade name: triphenyl methane, manufactured by Tokyo Chemical Industry Co., Ltd.) are dissolved in the solution, thereby obtaining a protective layer forming coating liquid. The coating liquid is coated on the charge transporting layer, and heated in an atmosphere having an oxygen concentration of about 100 ppm at 145° C. for 40 minutes, thereby forming a protective layer having a thickness of 8 μm.

An electrophotographic photoreceptor is obtained in this manner. The photoreceptor is referred to as a photoreceptor 1.

Evaluation

The electrophotographic photoreceptor thus produced is mounted on 700 Digital Color Press (manufactured by Fuji Xerox Co., Ltd.), and a 10% halftone image is continuously printed on 10,000 sheets at environment at 10° C. and 15% RH.

After printing 10,000 sheets, the image evaluation test (1) is carried out in the same environment. After the image evaluation test (1), the image fowling apparatus is kept at 28° C. and 80% RH for 24 hours, and then printing is resumed. The image quality of the image on the first sheet is subjected to the image quality evaluation test (2) in the same environment.

In the image evaluation tests (1) and (2), the below-described density unevenness, streaks, image degradation, and afterimage phenomenon (hereinafter referred to as "ghosting") due to residual preceding images are evaluated.

P paper (A4 size, fed in the direction of the shorter side thereof, manufactured by Fuji Xerox Co., Ltd.) is used in the image formation tests.

The evaluation results are listed in Tables 3 and 4.

Evaluation of Density Unevenness

The density unevenness is visually evaluated using the 5% halftone sample.

A: Excellent.

B: Partial density unevenness is seen.

C: Density unevenness problematic from image quality point of view is seen.

Evaluation of Streaks

Streaks are visually evaluated using the 10% halftone sample.

A: Excellent.

B: Partial streaks.

C: Streaks problematic from image quality point of view are seen.

Evaluation of Image Degradation

Together with the above tests, the image degradation as well is evaluated as shown below.

The image degradation is visually evaluated using the 10% halftone sample.

A: Excellent.

B: There is found no problem of image degradation during a continuous print test but found a problem after leaving for 24 hr.

C: There is found a problem even during a continuous print test.

Evaluation of Ghosting

Figure 6A:
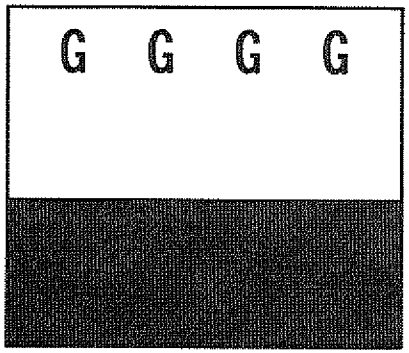
FIGS. 6A to 6C are explanatory drawings showing the criteria for evaluating ghosting.

The ghosting is evaluated by visually observing a degree of appearance of a figure G in a black region after a chart of a pattern having G and a black region, which are shown in FIG. 6A, is printed.

A: Excellent or very slight as shown in FIG. 6A.

Figure 6B:
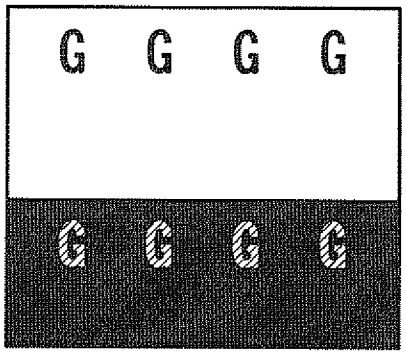

B: Slightly conspicuous as shown in FIG. 6B.

Figure 6C:
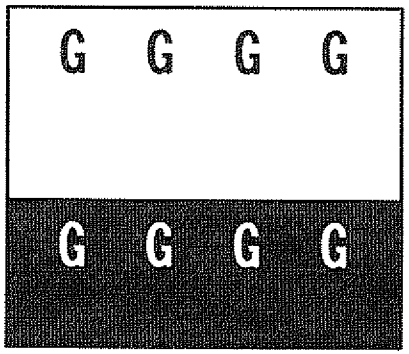

C: Clearly confirmed as shown in FIG. 6C.

Surface Observation

A surface of the electrophotographic photoreceptor after individual observations in the image quality evaluation tests (1) and (2) is observed and evaluated as shown below.

A: Excellent, That is, there is found neither scratch nor attachment even under 20 times magnification.

B: Under 20 times magnification, slight scratch or attachment is found.

C: Scratch or attachment is observed by naked eye.

Examples 2 to 11, Comparative Example 1

Production of Electrophotographic Photoreceptor

The steps up to the formation of the charge transporting layer are conducted in the same manner as those in Example 1. The ingredients of the protective layer are changed to those shown in Tables 1 and 2, and thus a protective layer forming coating liquid is obtained. The coating liquid is coated on the charge transport layer, and heated at 145° C. for 40 minutes in an atmosphere having an oxygen concentration of about 100 ppm, thereby forming a protective layer having a thickness of 8 μm.

Electrophotographic photoreceptors are obtained by the above-described method. These photoreceptors are referred to as photoreceptors 2 to 11, and comparative photoreceptor 1 respectively.

Evaluation

The photoreceptors thus obtained are evaluated in the same manner as in Example 1. The results are shown in Tables 3 and 4.

Example 12

Production of Electrophotographic Photoreceptor

The steps up to the formation of the charge transporting layer are conducted in the same manner as those in Example 1. The ingredients of the protective layer are changed to those shown in Table 2, and thus a protective layer forming coating liquid is obtained. The coating liquid is coated on the charge transport layer, and exposed to UV irradiation at an illumination of 700 mW/cm$^2$ (at 365 nm) for 60 seconds using a metal halide lamp (manufactured by Ushio Inc.) in an atmosphere having an oxygen concentration of about 100 ppm. The coating is heated at 145° C. for 40 minutes, thereby forming a protective layer having a thickness of 8 μm.

Electrophotographic photoreceptors are obtained by the above-described method. The photoreceptor is referred to as photoreceptor 12.

Evaluation

The photoreceptor thus obtained is evaluated in the same manner as in Example 1. The results are shown in Tables 3 and 4.

Examples 13 to 15

Production of Electrophotographic Photoreceptor

The steps up to the formation of the charge transport layer are conducted in the same manner as those in Example 1. The ingredients of the protective layer are changed to those shown in Table 2. The compound represented by Formula (I), the monomer having no charge transport capability, the initiator, and the compound represented by Formula (M1) listedshown in Table 2 are dissolved in 180 parts by weight of tetrahydrofuran (THF), thereby obtaining a protective layer forming coating liquid. The coating liquid is coated no the charge transport layer, and heated at 145° C. for 40 minutes in an atmosphere having an oxygen concentration of about 100 ppm, thereby forming a charge transport layer having a thickness of 17 μm.

Electrophotographic photoreceptors are obtained by the above-described method. These photoreceptors are referred to as photoreceptors 13 to 15 respectively.

Evaluation

The photoreceptors thus obtained are evaluated in the same manner as in Example 1. The results are shown in Table 4.

TABLE 1

| Ingredients | | Example 1 *1 | Example 2 *2 | Example 3 *3 | Example 4 *4 | Example 5 *5 | Example 6 *6 | Example 7 *7 | Example 8 *8 | Example 9 *9 | Example 10 *10 |
|---|---|---|---|---|---|---|---|---|---|---|---|
| Compound represented by formula (I) | Type 1 | ii-22 | ii-19 | ii-19 | ii-19 | ii-19 | ii-19 | ii-19 | ii-19 | ii-19 | iv-17 |
| | Amount (part by weight) | 120 | 120 | 120 | 120 | 120 | 120 | 120 | 120 | 160 | 120 |
| (Other monomer having charge transport capability) | Type 2 | — | — | — | — | — | — | — | — | — | — |
| | Amount (part by weight) | — | — | — | — | — | — | — | — | — | — |
| Monomer having no charge transport capability | Type 1 | A-DCP | A-DCP | A-DCP | A-DCP | A-DCP | A-DCP | A-DCP | A-DCP | A-DCP | A-DCP |
| | Amount (part by weight) | 40 | 40 | 40 | 40 | 40 | 40 | 40 | 40 | 40 | 40 |
| | Type 2 | — | — | — | — | — | — | — | — | — | — |
| | Amount (part by weight) | — | — | — | — | — | — | — | — | — | — |
| Initiator | Type | VE-73 | VE-73 | VE-73 | V-601 | OTazo15 | V-60 | V-70 | LUPEROX 26 | VE-73 | VE-73 |
| | Amount (part by weight) | 3 | 3 | 3 | 3 | 3 | 3 | 3 | 3 | 3 | 3 |
| Compound represented by formula (M1) | Type | M-1 | M-6 | M-8 | M-1 | M-1 | M-1 | M-1 | M-1 | M-1 | M-1 |
| | Amount (part by weight) | 5 | 5 | 5 | 5 | 5 | 5 | 5 | 5 | 5 | 5 |

*Photoreceptor

TABLE 2

| Ingredients | | Example 11 Photoreceptor 11 | Example 12 Photoreceptor 12 | Example 13 Photoreceptor 13 | Example 14 Photoreceptor 14 | Example 15 Photoreceptor 15 | Comparative Example 1 Comparative Photoreceptor 1 |
|---|---|---|---|---|---|---|---|
| Compound represented by formula (I) | Type 1 | i-9 | ii-19 | iv-17 | iv-17 | ii-19 | ii-22 |
| | Amount (part by weight) | 80 | 120 | 100 | 100 | 120 | 120 |
| (Other monomer having charge transport capability) | Type 2 | — | — | — | TDP | | — |
| | Amount (part by weight) | — | — | — | 30 | | — |
| Monomer having no charge transport capability | Type 1 | A-DPH | A-DCP | Z-400 | Z-400 | A-DCP | A-DCP |
| | Amount (part by weight) | 40 | 40 | 25 | 25 | 40 | 40 |
| | Type 2 | | | | | | — |
| | Amount (part by weight) | | | | | | — |
| Initiator | Type | VE-73 | Irganox819 | VE-73 | VE-73 | VE-73 | VE-73 |
| | Amount (part by weight) | 4 | 3 | 3 | 3 | 3 | 3 |
| Compound represented by formula (M1) | Type | M-1 | M-1 | M-1 | M-1 | M-7 | — |
| | Amount (part by weight) | 5 | 5 | 5 | 5 | 5 | — |

TABLE 3

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Test (1) | Density Unevenness | A | A | A | A | A | A | A | A | A | A |
| | Streaks | A | A | A | A | A | A | A | A | A | A |
| | Image Degradation | A | A | A | A | A | A | A | A | A | A |
| | Ghosting | A | A | A | A | A | A | A | A | A | A |
| | Surface Observation | A | A | A | A | A | A | B | B | A | A |
| Test (2) | Density Unevenness | A | A | A | A | A | A | B | B | A | A |
| | Streaks | A | A | A | A | A | A | A | A | A | A |
| | Image Degradation | A | A | A | A | A | A | A | A | A | B |
| | Ghosting | A | B | B | A | A | A | B | B | A | B |
| | Surface Observation | A | B | B | B | B | B | B | B | B | A |

TABLE 4

| | | Example 11 | Example 12 | Example 13 | Example 14 | Example 15 | Comparative Example 1 |
|---|---|---|---|---|---|---|---|
| Test (1) | Density Unevenness | A | B | A | A | A | B |
| | Streaks | A | A | A | A | A | B |
| | Image Degradation | A | A | A | A | A | A |
| | Ghosting | A | A | A | A | A | A |
| | Surface Observation | B | A | B | B | A | B |
| Test (2) | Density Unevenness | B | B | A | A | A | C |
| | Streaks | B | B | B | B | A | C |
| | Image Degradation | A | A | A | A | A | B |
| | Ghosting | B | B | B | A | B | B |
| | Surface Observation | B | A | B | B | A | B |

The above results indicate that Examples 1 to 15 achieve comprehensively better results in terms of density unevenness, streaks, image degradation, and surface observation than those of Comparative Example 1.

The abbreviations in Tables 1 to 4 are as follows:

M-1: compound represented by Formula (M1) (trade name: triphenylmethane, manufactured by Tokyo Chemical Industry Co., Ltd.)

M-6: compound represented by Formula (M1) (trade name: BisP-IOTD, manufactured by Honshu Chemical Industry Co., Ltd.)

M-7: compound represented by Formula (M1) (trade name: BisP-BA, manufactured by Honshu Chemical Industry Co., Ltd.)

M-8: compound represented by Formula (M1) (trade name: BisP-PHBA, manufactured by Honshu Chemical Industry Co., Ltd.)

TPD: N,N'-diphenyl-N,N'-bis(3-methylphenyl)-[1,1']biphenyl-4,4'-diamine

A-DCP: monomer having no charge transport capability (trade name: A-DCP, manufactured by Shin-Nakamura Chemical Co., Ltd.)

A-DPH: monomer having no charge transport capability (trade name: A-DPH, manufactured by Shin-Nakamura Chemical Co., Ltd.)

Z-400: polymer having no charge transport capability (bisphenol Z polycarbonate, manufactured by Mitsubishi Chemical Corporation)

VE-73: initiator (trade name: VE-73, heat radical generator, manufactured by Wako Pure Chemical Industries, Ltd.)

VE-75: initiator (trade name: VE-75, heat radical generator, manufactured by Wako Pure Chemical Industries, Ltd.)

V-601: initiator (trade name: V-601, heat radical generator, manufactured by Wako Pure Chemical Industries, Ltd.)

V-60: initiator (trade name: V-60, heat radical generator, manufactured by Wako Pure Chemical Industries, Ltd.)

V-70: initiator (trade name: V-70, heat radical generator, manufactured by Wako Pure Chemical Industries, Ltd.)

$OT_{azo}15$: initiator (trade name: $OT_{AZO}$-15, heat radical generator, manufactured by Otsuka Chemical Co., Ltd.)

LUPEROX 26: initiator (trade name: LUPEROX 26, heat radical generator, manufactured by Arkema Yoshitomi, Ltd.)

Irganox 819: initiator (trade name: Irganox 819, photo radical generator, manufactured by Ciba Specialty Chemicals)

Example 16

Production of Organic Electroluminescent Device

An ITO glass substrate composed of a glass substrate having provided thereon an ITO film is prepared, and the ITO film is etched in the form of a strip having a width of 2 mm, thereby forming an ITO electrode (anode). The ITO glass substrate is ultrasonically cleaned in isopropanol (for electronic use, manufactured by Kanto Chemical Co., Inc.), and then dried using a spin coater.

Thereafter, copper phthalocyanine, which had been purified by sublimation, was vacuum deposited on the ITO glass substrate at the side of the ITO electrode thus formed, thereby forming a thin film having a thickness of 0.015 μm.

Subsequently, 1.2 parts by weight of the compound represented by Formula (I) (compound ii-22), 0.2 parts by weight of a monomer having no charge transport capability (trade name: A-DCP, manufactured by Shin-Nakamura Chemical Co., Ltd.) are dissolved in 100 parts by weight tetrahydrofuran (THF). Further, 0.03 parts by weight of an initiator VE-73 (trade name: VE-73, manufactured by Wako Pure Chemical Industries, Ltd.) and 0.05 parts by weight of the compound represented by Formula (M1) (compound M-1, trade name: triphenylmethane, manufactured by Tokyo Chemical Industry Co., Ltd.) are dissolved in the solution, thereby obtaining a coating liquid. The coating liquid is coated on the copper phthalocyanine film, heated at 145° C. for 40 minutes in an atmosphere having an oxygen concentration of about 100 ppm, thereby forming a thin film having a thickness of 0.05 In this manner, a hole transporting layer having a two layer structure is formed on the ITO electrode.

Thereafter, as a luminescent material, the compound (Alq3) represented by the following formula is vapor deposited on the hole transporting layer, thereby forming a luminescent layer having a thickness of 0.060 μm.

Further, an Mg—Ag alloy is co-deposited by vapor deposition on the luminescent layer, thereby forming an Mg—Ag electrode (cathode) in the form of a strip having a width of 2 mm and a thickness of 0.13 μm, and thus obtaining an organic electroluminescent device. The ITO electrode and Mg—Ag electrode are formed in such a manner that their extending directions are orthogonal to each other. The organic electroluminescent device thus obtained has an effective area of 0.04 $cm^2$.

Compound Alq3

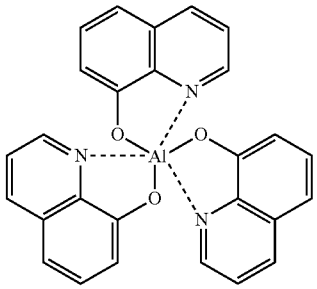

Evaluation of Device Properties

The organic electroluminescent device thus obtained is examined for the device properties as follows. A direct current voltage is applied in vacuo (0.125 Pa) between the ITO electrode as an anode and the Mg—Ag electrode as a cathode thereby producing luminescence, and the highest luminance and luminescent color are evaluated. These results are shown in Table 5.

Further, the luminescence life of the organic electroluminescent device is measured in dry nitrogen as follows. The electric current value is set so as to achieve an initial luminance of 50 cd/$m^2$, and the number of hours before the luminance drops down to 50% of its initial value is determined as the device life. The driving current density is shown in Table 5 together with the device life.

Comparative Example

Copper phthalocyanine was vacuum deposited to form a thin film having a thickness of 0.015 μm in the same manner as in Example 16, and then the benzidine compound R represented by the following formula is vapor deposited thereby forming a thin film having a thickness of 0.050 μm. In this manner, a hole transporting layer having a two-layer structure is formed on the ITO electrode. Subsequently, a luminescent layer and an electrode are formed on the hole transporting layer in the same manner as in Example 16.

The organic electroluminescent device thus obtained has an effective area of 0.04 $cm^2$.

The organic electroluminescent device is examined in the same manner as in Example 16.

Benzidine Compound R

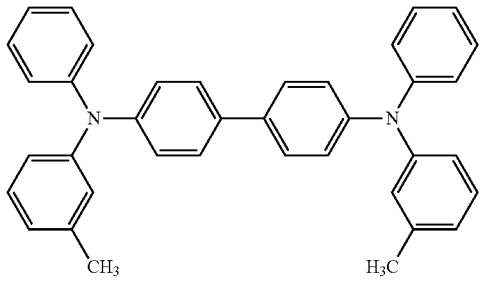

TABLE 5

| | Highest Luminance (cd/$m^2$) | Driving Current Density (mA/$cm^2$) | Device Life (hour) |
|---|---|---|---|
| Example 16 | 820 | 8.5 | 45 |
| Comparative Example 2 | 650 | 9.3 | 17 |

The above results indicates that Example 16 achieves better results in terms of highest luminance, driving current density, and device life than those of Comparative Example 2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

a photosensitive layer provided on or above the conductive substrate; and a protective layer that constitutes an outermost surface layer on the photosensitive layer and is made of a cured film obtained by curing a composition comprising a compound represented by the following Formula (M1)

and a charge transporting material having a chain polymerizable functional group represented by the following Formula (I):

(M1)

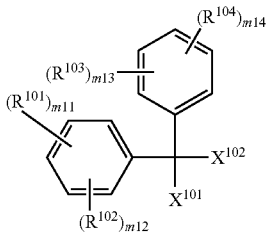

wherein, in Formula (M1), X101 and X102 each independently represent a hydrogen atom, a halogen atom, an alkyl group having 1 to 15 carbon atoms, an alkoxy group having 1 to 15 carbon atoms, a cyano group, a phenoxy group, an aryl group having 6 to 30 carbon atoms, —Y101-X103 (wherein Y101 represents an azo group or a siloxy group; X103 represents an alkyl group having 1 to 15 carbon atoms, an alkoxy group having 1 to 15 carbon atoms, a cyano group, a phenoxy group, or an aryl group having 6 to 30 carbon atoms), or a substituent composed of any of these groups; R101 and R103 each independently represent a hydroxyl group or an alkoxy group having 1 to 15 carbon atoms; m11 and m13 each independently represent an integer of 0 or 1; R102 and R104 each independently represent an alkyl group having 1 to 15 carbon atoms; and m12 and m14 each independently represent an integer of 0, 1, 2, or 3;

(I)

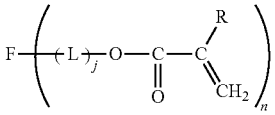

wherein, in Formula (I), F represents a hole-transporting organic group having an n valence; R represents a hydrogen atom or an alkyl group; L represents a divalent organic group; n represents an integer of 2 or more; and j represents 0 or 1; and wherein a content of the compound represented by the Formula (M1) is from 0.1% to 5% by weight with respect to a weight of the composition for obtaining the cured film of the outermost surface layer, and a content of the charge transporting material having a chain polymerizable functional group represented by the Formula (I) is 40% by weight or more with respect to the weight of the composition for obtaining the cured film of the outermost surface layer.

2. The electrophotographic photoreceptor according to claim 1, wherein the photosensitive layer is a monolayer photosensitive layer or a multilayer photosensitive layer comprising a charge generating layer and a charge transport layer.

3. The electrophotographic photoreceptor according to claim 1, further comprising an undercoat layer provided on the conductive substrate.

4. A process cartridge comprising:

the electrophotographic photoreceptor according to claim 1;

at least one unit selected from the group consisting of a charging unit for charging the electrophotographic photoreceptor;

a development unit for developing an electrostatic latent image formed on the electrophotographic photoreceptor with a toner; and a toner removal unit for removing residual toner from the surface of the electrophotographic photoreceptor.

5. An image forming apparatus comprising:

the electrophotographic photoreceptor according to claim 1;

a charging unit for charging the electrophotographic photoreceptor;

an electrostatic latent image forming unit for forming an electrostatic latent image on the charged electrophotographic photoreceptor;

a development unit for developing the electrostatic latent image formed on the electrophotographic photoreceptor with a toner thereby forming a toner image; and a transfer unit for transferring the toner image to a transferred image-receiving medium.

6. The electrophotographic photoreceptor according to claim 1, wherein the photosensitive layer comprises, in the following order from the conductive substrate:

a charge generating layer; and a charge transport layer disposed on the charge generating layer.

* * * * *